US006496194B1

(12) United States Patent
Mikoshiba et al.

(10) Patent No.: US 6,496,194 B1
(45) Date of Patent: Dec. 17, 2002

(54) HALFTONE DISPLAY METHOD AND DISPLAY APPARATUS FOR REDUCING HALFTONE DISTURBANCES OCCURRING IN MOVING IMAGE PORTIONS

(75) Inventors: Shigeo Mikoshiba, 43-17, Izumi 2-chome, Suginami-ku, Tokyo (JP); Tomokazu Shiga, Hachioji (JP); Yiwen Zhu, Chofu (JP); Kiyoshi Igarashi, Tokyo (JP); Kosaku Toda, Kawasaki (JP); Toshio Ueda, Kawasaki (JP); Kyoji Kariya, Kawasaki (JP); Takayuki Ooe, Kawasaki (JP); Kazuki Sawa, Chofu (JP)

(73) Assignees: Fujitsu Limited, Kawasaki (JP); Shigeo Mikoshiba, Tokyo (JP)

( * ) Notice: Subject to any disclaimer, the term of this patent is extended or adjusted under 35 U.S.C. 154(b) by 0 days.

(21) Appl. No.: 09/427,936

(22) Filed: Oct. 27, 1999

Related U.S. Application Data

(63) Continuation-in-part of application No. 09/248,109, filed on Feb. 11, 1999.

(30) Foreign Application Priority Data

Jul. 30, 1998 (JP) ..... 10-216024
Jun. 29, 1999 (JP) ..... 11-184028

(51) Int. Cl.[7] ..... G09G 5/02; G09G 3/28
(52) U.S. Cl. ..... 345/596; 345/63
(58) Field of Search ..... 345/60, 63, 89, 345/589, 596, 597, 598, 599; 358/429, 455, 456, 457, 458, 459, 534, 536; 382/168, 169, 274; 315/169.3, 169.4

(56) References Cited

U.S. PATENT DOCUMENTS 5,818,419 A * 10/1998 Tajima et al. ..... 345/63
5,907,316 A 5/1999 Mikoshiba et al. ..... 345/596
6,069,610 A * 5/2000 Denda et al. ..... 345/694
6,249,265 B1 * 6/2001 Tajima et al. ..... 345/63

FOREIGN PATENT DOCUMENTS

| | | |
|---|---|---|
| EP | 0 720 139 A2 | 7/1996 |
| EP | 0 822 536 | 2/1998 |
| EP | 0 837 441 A1 | 4/1998 |
| EP | 0 840 274 | 5/1998 |
| FR | 2 733 070 | 10/1996 |
| JP | 8-54852 | 2/1996 |
| JP | 8-211848 | 8/1996 |
| JP | 10-39828 | 2/1998 |
| JP | 10-133623 | 5/1998 |

* cited by examiner

*Primary Examiner*—Steven Saras
*Assistant Examiner*—Paul A. Bell
(74) *Attorney, Agent, or Firm*—Staas & Halsey LLP

(57) ABSTRACT

A halftone display method utilizes an activation sequence, having a plurality of luminance blocks predefined in each frame or field to display an image and having redundancy, that enables one gray-scale level to be expressed by any one of a plurality of combinations of subframes (luminance blocks). When determining luminance blocks for use to display gray scale of an arbitrary first pixel, the luminance blocks to be used for the first pixel are selected in accordance with a predetermined rule, based on how the luminance blocks are used for a second pixel located in close proximity to the first pixel. In this way, by actively utilizing the redundancy of the activation sequence, the occurrence of moving-image false contours (false color contours) in video can be minimized, and also a motion compensation equalizing pulse method can be effectively applied to further improve the image display quality.

48 Claims, 40 Drawing Sheets

Fig. 32

| | COLUMN 1 (X 1) | COLUMN 2 (X 2) | COLUMN 3 (X 3) | COLUMN 4 (X 4) | COLUMN 5 (X 5) → X |
|---|---|---|---|---|---|
| LINE 1 (Y 1) | PXL11<br>159−AA | PXL12<br>159−AA | PXL13<br>159−AA | PXL14<br>159−AA | PXL15<br>159−AA |
| LINE 2 (Y 2) | PXL21<br>159−AA | PXL22<br>159−AA | PXL23<br>159−AA | PXL24<br>159−AA | PXL25<br>159−AA |
| LINE 3 (Y 3) | PXL31<br>159−AA | PXL32<br>160−BB | PXL33<br>159−AA | PXL34<br>159−AA | PXL35<br>159−AA |
| LINE 4 (Y 4) | PXL41<br>159−AA | PXL42<br>159−AA | PXL43<br>159−AA | PXL44<br>159−AA | PXL45<br>159−AA |
| LINE 5 (Y 5) ↓ Y | PXL51<br>159−AA | PXL52<br>159−AA | PXL53<br>159−AA | PXL54<br>159−AA | PXL55<br>159−AA |

Fig.33

| | X 1 | X 2 | X 3 | X 4 | X 5 → X |
|---|---|---|---|---|---|
| Y 1 | PXL11<br>159−AA | PXL12<br>159−AA | PXL13<br>159−AA | PXL14<br>159−AA | PXL15<br>159−AA |
| Y 2 | PXL21<br>159−AA | PXL22<br>159−AA | PXL23<br>159−AA | PXL24<br>159−AA | PXL25<br>159−AA |
| Y 3 | PXL31<br>159−AA | PXL32<br>160−BB | PXL33<br>159−BB | PXL34<br>159−BB | PXL35<br>159−BB |
| Y 4 | PXL41<br>159−AA | PXL42<br>159−AA | PXL43<br>159−AA | PXL44<br>159−AA | PXL45<br>159−AA |
| Y 5 ↓ Y | PXL51<br>159−AA | PXL52<br>159−AA | PXL53<br>159−AA | PXL54<br>159−AA | PXL55<br>159−AA |

Fig.34

| | X 1 | X 2 | X 3 | X 4 | X 5 → X |
|---|---|---|---|---|---|
| Y 1 | PXL11<br>159—AA | PXL12<br>159—AA | PXL13<br>159—AA | PXL14<br>159—AA | PXL15<br>159—AA |
| Y 2 | PXL21<br>159—AA | PXL22<br>159—AA | PXL23<br>159—AA | PXL24<br>159—AA | PXL25<br>159—AA |
| Y 3 | PXL31<br>159—AA | PXL32<br>160—BB | PXL33<br>159—AA | PXL34<br>159—AA | PXL35<br>159—AA |
| Y 4 | PXL41<br>159—AA | PXL42<br>159—AA | PXL43<br>159—AA | PXL44<br>159—AA | PXL45<br>159—AA |
| Y 5 ↓ Y | PXL51<br>159—AA | PXL52<br>159—AA | PXL53<br>159—AA | PXL54<br>159—AA | PXL55<br>159—AA |

Fig.35

| | X 1 | X 2 | X 3 | X 4 | X 5 → X |
|---|---|---|---|---|---|
| Y 1 | PXL11<br>159−AA | PXL12<br>159−AA | PXL13<br>159−AA | PXL14<br>159−AA | PXL15<br>159−AA |
| Y 2 | PXL21<br>159−AA | PXL22<br>159−AA | PXL23<br>159−AA | PXL24<br>159−AA | PXL25<br>159−AA |
| Y 3 | PXL31<br>159−AA | PXL32<br>160−BB | PXL33<br>159−AA | PXL34<br>159−AA | PXL35<br>159−AA |
| Y 4 | PXL41<br>159−AA | PXL42<br>159−AA | PXL43<br>159−AA | PXL44<br>159−AA | PXL45<br>159−AA |
| Y 5 ↓ Y | PXL51<br>159−AA | PXL52<br>159−AA | PXL53<br>159−AA | PXL54<br>159−AA | PXL55<br>159−AA |

Fig.36

| | X 1 | X 2 | X 3 | X 4 | X 5 → X |
|---|---|---|---|---|---|
| Y 1 | PXL11<br>159—AA | PXL12<br>159—AA | PXL13<br>159—AA | PXL14<br>159—AA | PXL15<br>159—AA |
| Y 2 | PXL21<br>159—AA | PXL22<br>159—AA | PXL23<br>159—AA | PXL24<br>159—AA | PXL25<br>159—AA |
| Y 3 | PXL31<br>159—AA | PXL32<br>160—BB | PXL33<br>159—AA | PXL34<br>159—AA | PXL35<br>159—AA |
| Y 4 | PXL41<br>159—AA | PXL42<br>159—AA | PXL43<br>159—AA | PXL44<br>159—AA | PXL45<br>159—AA |
| Y 5 ↓ Y | PXL51<br>159—AA | PXL52<br>159—AA | PXL53<br>159—AA | PXL54<br>159—AA | PXL55<br>159—AA |

Fig.37

| | X 1 | X 2 | X 3 | X 4 | X 5 → X |
|---|---|---|---|---|---|
| Y 1 | PXL11<br>159−AA | PXL12<br>159−AA | PXL13<br>159−AA | PXL14<br>159−AA | PXL15<br>159−AA |
| Y 2 | PXL21<br>159−AA | PXL22<br>(3)<br>159−AA | PXL23<br>(2)<br>159−AA | PXL24<br>(1)<br>159−AA | PXL25<br>159−AA |
| Y 3 | PXL31<br>159−AA | PXL32<br>(2)<br>160−BB | PXL33<br>159−AA | PXL34<br>159−AA | PXL35<br>159−AA |
| Y 4 | PXL41<br>159−AA | PXL42<br>(1)<br>159−AA | PXL43<br>159−AA | PXL44<br>159−AA | PXL45<br>159−AA |
| Y 5 ↓ Y | PXL51<br>159−AA | PXL52<br>159−AA | PXL53<br>159−AA | PXL54<br>159−AA | PXL55<br>159−AA |

HALFTONE DISPLAY METHOD AND DISPLAY APPARATUS FOR REDUCING HALFTONE DISTURBANCES OCCURRING IN MOVING IMAGE PORTIONS

CROSS REFERENCE TO RELATED APPLICATION

This application is a Continuation-in-Part of application Ser. No. 09/248,109, filed Feb. 11, 1999, now pending.

BACKGROUND OF THE INVENTION

1. Field of the Invention

The present invention relates to a halftone display method and display apparatus for displaying halftone gray scale images by using an intraframe or intrafield time-division method, and more particularly, to a halftone display method and display apparatus which can reduce halftone disturbances occurring in moving image portions displayed on a gas discharge display panel and can prevent the occurrence of moving-image false contours (false color contours) in such images.

2. Description of the Related Art

In recent years, with increasing display screen size, the need for thin display apparatuses has been increasing, and various types of thin display apparatus have been commercially implemented. Examples include matrix display panels that display images by directly using digital signals, such as plasma displays and other gas discharge display panels, the Digital Micromirror Device (DMD), EL display devices, fluorescent display tubes, liquid crystal display devices, etc.

Among such thin display devices, gas discharge display panels are considered to be the most promising candidate for large-area, direct-view HDTV (high-definition television) display devices, since they can be easily made large in area because of their simple fabrication process, can provide good display quality because of their self-luminescent characteristics, and can have high response speed. Such display devices, however, have the problem that disturbances occur in halftone areas of moving images, impairing the display quality.

To address this problem, it has been proposed to reduce false contours by superimposing positive or negative equalizing pulses on the source signal. However, as the image moving speed increases, the image disturbances become visible.

In the prior art, if the gray-scale level change is smooth, that is, if the pitch (number of pixels) over which the same luminance block having the largest weight changes is greater than the image moving distance per frame, then correct motion compensation is possible since the number of pixels to which equalizing pulses are applied is equal to the moving speed. However, in the case of a fine pattern, it is difficult to detect the correct speed, and the moving speed may be detected, for example, as being one pixel per frame, resulting in an inability to reduce the disturbances sufficiently. Namely, in the prior art, a halftone displaying technique has been proposed that does not cause disturbances in halftone display, but it is desired to further improve the display quality.

Prior art and the problems thereof will be explained later with reference to accompanying drawings.

SUMMARY OF THE INVENTION

An object of the present invention is to provide a halftone display method and display apparatus which, when using an activation sequence having redundancy that enables one gray-scale level to be displayed by any one of a plurality of combinations of subframes (luminance blocks), can reduce the occurrence of moving-image false contours (false color contours) in video by actively utilizing the redundancy.

According to the present invention, there is provided a halftone display method which predefines a plurality of luminance blocks in each frame or field to display an image, and which is capable of displaying one gray-scale level by any one of a plurality of combinations of the luminance blocks, wherein when determining luminance blocks for use to display the gray scale of an arbitrary first pixel, the luminance blocks to be used for the first pixel are selected in accordance with a predetermined rule, based on how the luminance blocks are used for a second pixel located in close proximity to the first pixel.

Further, according to the present invention, there is also provided a display apparatus which predefines a plurality of luminance blocks in each frame or field to display an image, and which is capable of displaying one gray-scale level by any one of a plurality of combinations of the luminance blocks, comprising an image display; a driving unit for driving the image display; a control unit for controlling the driving unit; and a luminance block selection and luminance adjusting luminance block insertion unit for selecting luminance blocks, and for inserting a luminance adjusting luminance block into a source signal, and wherein when determining luminance blocks for use to display gray scale of an arbitrary first pixel, the luminance block selection and luminance adjusting luminance block insertion unit selects the luminance blocks to be used for the first pixel in accordance with a predetermined rule, based on how the luminance blocks are used for a second pixel located in close proximity to the first pixel.

The second pixel may be a pixel that is producing the same color as the first pixel, and that is located closest to the first pixel horizontally or vertically. If the second pixel does not exist on a display screen, the second pixel may be assumed to be displaying an arbitrarily set gray-scale level.

The plurality of luminance blocks predefined in each frame or field may be provided with redundancy such that more than one luminance block is assigned the largest luminance weight. How the luminance blocks with the largest luminance weight are to be used for said first pixel may be determined based on how the luminance blocks with the largest luminance weight are used for said second pixel. How many luminance blocks with the largest luminance weight are to be used for the first pixel may be determined based on how many luminance blocks with the largest luminance weight are used for the second pixel.

All gray-scale levels may be classified into groups according to the number of luminance blocks with the largest luminance weight that are allowed to be used; the first and the second pixel may be assigned group numbers from the classified groups according to the gray-scale levels that the first and the second pixel display; and the group numbers assigned to the first and the second pixel may be compared with each other and, in accordance with the result of which, one of the plurality of combinations of the luminance blocks is selected to display the gray-scale level of the first pixel. The gray-scale level to be displayed by each pixel may be expressed by one of two descriptions, the first description using a smaller number of luminance blocks with the largest luminance weight than the second description; and the number of luminance blocks with the largest luminance weight to be used for the first pixel may be determined by comparing the group number, denoted as GA, of the first pixel with the group number, denoted as GB, of the second pixel, and by selecting one of the two descriptions in such a manner that when GB<GA, the first description may be selected; when GB=GA, the same description as used for the second pixel may be used; and when GB<GA, the second description may be selected.

How the luminance blocks with the largest luminance weight to be used for the first pixel are selected from among the luminance blocks with the largest luminance weight may be determined according to how the luminance blocks with the largest luminance weight are selected and used for the second pixel. When there occurs a state change between successive frames or fields in any one of the luminance blocks with the largest luminance weight in the first pixel, the number of linearly contiguous pixels on a display screen that exhibit the same change as the change in the one of the luminance blocks with the largest luminance weight in the first pixel may be detected; a predetermined luminance adjusting luminance block may be selected based on the detected number of contiguous pixels and on the change in the one of the luminance blocks with the largest luminance weight in the first pixel; and the selected luminance adjusting luminance block may be applied to a source signal of each of the contiguous pixels.

The selected luminance adjusting luminance block may be applied not only to the source signal of each of the detected contiguous pixels but also to the source signal of an additional pixel located on the opposite side of the contiguous pixels from the second pixel. The detection of a state change between successive frames or fields in the luminance blocks with the largest luminance weight may be performed in sequence, starting with the luminance block located on the smaller luminance weight side of the luminance blocks with the largest luminance weight.

When there occurs a state change between successive frames or fields in any one of the luminance blocks with the largest luminance weight in the first pixel, the number of linearly contiguous pixels on a display screen that exhibit the same change as the change in the one of the luminance blocks with the largest luminance weight in the first pixel may be detected in a horizontal and a vertical direction; a predetermined luminance adjusting luminance block may be selected based on the detected number of horizontally or vertically contiguous pixels, whichever is smaller, and on the change in the one of the luminance blocks with the largest luminance weight in the first pixel; and the selected luminance adjusting luminance block may be applied to a source signal of each of the contiguous pixels.

The selected luminance adjusting luminance block may be applied not only to the source signal of each of the horizontally or vertically detected contiguous pixels, whichever are smaller in number, but also to the source signal of an additional pixel located on the opposite side of the contiguous pixels from the second pixel. The plurality of luminance blocks may be 10 in number, and the luminance weights of the luminance blocks may be set to provide gray-scale levels 1, 2, 4, 8, 16, 32, 48, 48, 48, and 48, respectively.

According to the present invention, there is provided a halftone display method which predefines a plurality of luminance blocks in each frame or field to display an image, and which is capable of displaying one gray-scale level by any one of a plurality of combinations of the luminance blocks, wherein when determining luminance blocks for use to display a gray scale of an arbitrary first pixel, the luminance blocks to be used for the first pixel are selected in accordance with a predetermined procedure based on the state of the luminance blocks in at least two reference pixels around the first pixel.

Further, according to the present invention, there is also provided a display apparatus which predefines a plurality of luminance blocks in each frame or field to display an image, and which is capable of displaying one gray-scale level by any one of a plurality of combinations of the luminance blocks, comprising an image display; a driving unit for driving the image display; a control unit for controlling the driving unit; and a luminance block selection and luminance adjusting luminance block insertion unit for selecting luminance blocks, and of inserting a luminance adjusting luminance block into a source signal, and wherein, when determining luminance blocks for use to display a gray scale of an arbitrary first pixel, the luminance blocks to be used for the first pixel are selected in accordance with a predetermined procedure based on the state of the luminance blocks in at least two reference pixels around the first pixel.

The reference pixels may be located directly adjacent to the first pixel. The reference pixels may be located directly adjacent to or in proximity to the first pixel through other pixels.

The luminance blocks to be used for the first pixel may be selected based on the state of the luminance blocks exceeding a majority of the reference pixels. The reference pixels may be an even number, and in the case where the reference pixels of different luminance blocks are equally divided in number, the luminance blocks to be used for the first pixel may be maintained without changing.

The reference pixels may be weighted according to the relative position thereof with the first pixel, respectively, and the luminance blocks to be used for the first pixel may be selected based on the state of the luminance blocks of the weighted reference pixels. In the case where the weighted reference pixels of different luminance blocks are the same, the luminance blocks to be used for the first pixel may be maintained without being changed.

The display apparatus may further comprise a lighting pattern setting unit for setting the whole display screen in a predetermined lighting pattern. The lighting pattern setting unit may set each pixel of the whole display screen in a luminance state using a maximum number of luminance blocks having the largest luminance weight.

BRIEF DESCRIPTION OF THE DRAWINGS

The present invention will be more clearly understood from the description of the preferred embodiments as set forth below with reference to the accompanying drawings, wherein:

FIG. 32 is a diagram showing an example of a display image of a display apparatus to which the halftone display method according to the present invention is applied;

FIG. 33 is a diagram for explaining the problem posed by an application of the present invention to the display image shown in FIG. 32;

FIG. 34 is a diagram for explaining the halftone display method according to the first embodiment as another aspect of the present invention;

FIG. 35 is a diagram for explaining the halftone display method according to the second embodiment as another aspect of the present invention;

FIG. 36 is a diagram for explaining the halftone display method according to the third embodiment as another aspect of the present invention; and FIG. 37 is a diagram for explaining the halftone display method according to the fourth embodiment as another aspect of the present invention.

DESCRIPTION OF THE PREFERRED EMBODIMENTS

Before proceeding to the detailed description of the preferred embodiments of the present invention, the prior art and problems associated with the prior art will be described.

Traditionally, a halftone display method for a memory-type gas discharge panel employs an intraframe or intrafield time-division technique, and produces one frame (or one field, either being a period defining, for example, a 60 Hz cycle) with N rasters (subframes or luminance blocks) having different luminance weights. Here, the field is a generic term for rasters forming one frame with two fields in interlaced scanning operation or with more fields in other display operation (display processing), and is essentially equivalent to the frame.

Traditionally, the subframes (luminance blocks) are labeled SF0, SF1, SF2, . . . , SF(N−1) in increasing order of their luminance weights, and their luminance weight ratios are $2^0$, $2^1$, $2^2$, . . . , $2^{N-1}$, respectively. Halftone luminance within one frame is produced by selecting the turning on or off of each subframe. The luminance perceived by the human eye is expressed by the sum of the luminance levels of the subframes, utilizing the visual characteristics of the human eye, that is, the persistence of human vision. The number of reproducible gray-scale levels attainable at this time, that is, the number of possible combinations of subframe luminance levels within one frame, is $2^N$. The subframe activation sequence to which the present invention is applicable has redundancy that enables one gray-scale level to be displayed by any one of a plurality of subframe combinations, as shown, for example, in FIG. 19 which will be described later. To start with, a description will be given of an activation sequence in which the subframe luminance weight ratios are $2^0$, $2^1$, $2^2$, . . . $2^{N-1}$.

Figure 1:
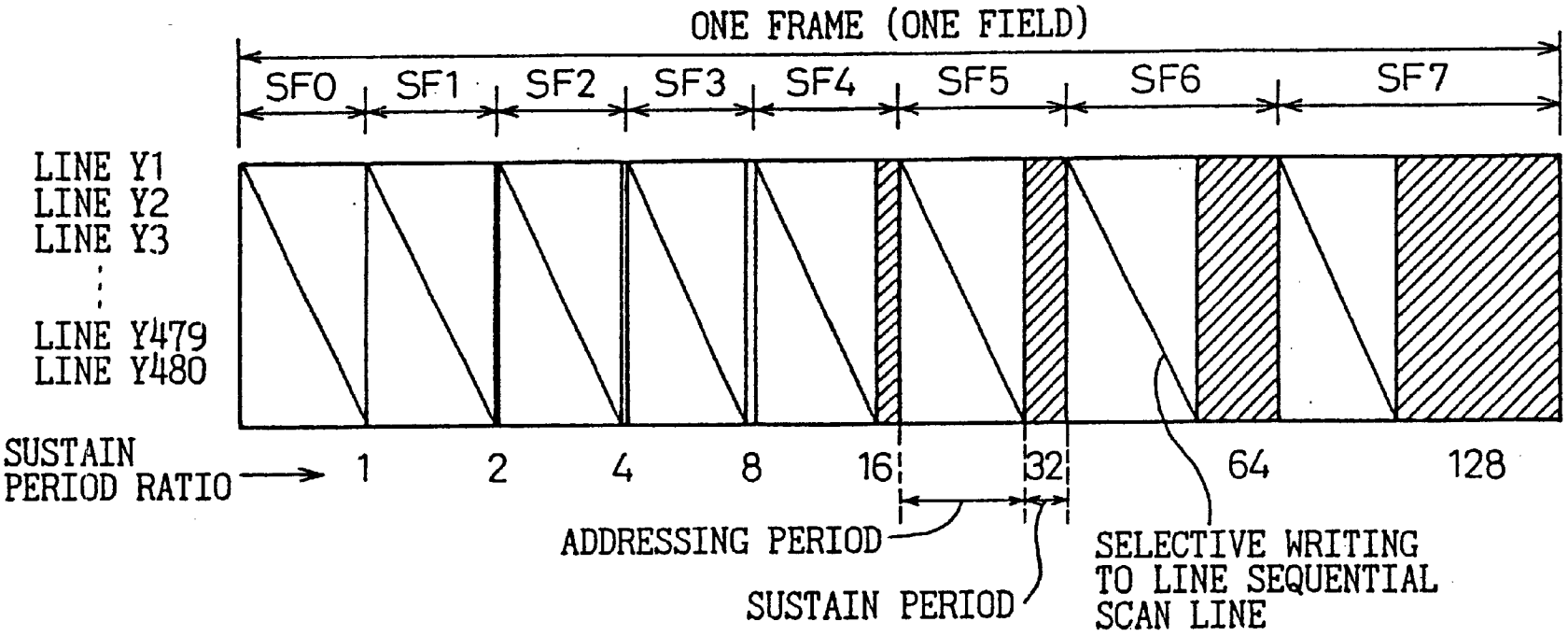
Fig.1 PRIOR ART
FIG. 1 is a diagram showing one example of a subframe activation sequence according to the prior art.

FIG. 1 is a diagram showing one example of a subframe activation sequence according to the prior art; shown here is the activation sequence within one frame when the above-described prior art halftone display method is used.

As shown in FIG. 1, one frame (one field) consists of eight (N=8) subframes (luminance blocks) having different luminance weights and labeled SF7, SF6, . . . , SF0 in decreasing order of their luminance weights. Here, SF7 is called the most significant bit (MSB) frame, and SF0 the least significant bit (LSB) frame. The subframes within one frame are arranged in increasing order of their luminance weights, that is, in the order of SF0, SF1, . . . , SF7.

However, in the case of the activation sequence where the subframes are arranged as shown in FIG. 1 (in the case of 256 gray scale levels), it is known that if gray-scale levels with approximately the same luminance value, and with no or little temporal overlapping of ON subframes between them, are produced in alternating fashion between frames, the activation cycle of the cell becomes equal to one half of the frame repetition rate, thus causing flicker and greatly degrading display quality.

Figure 2:
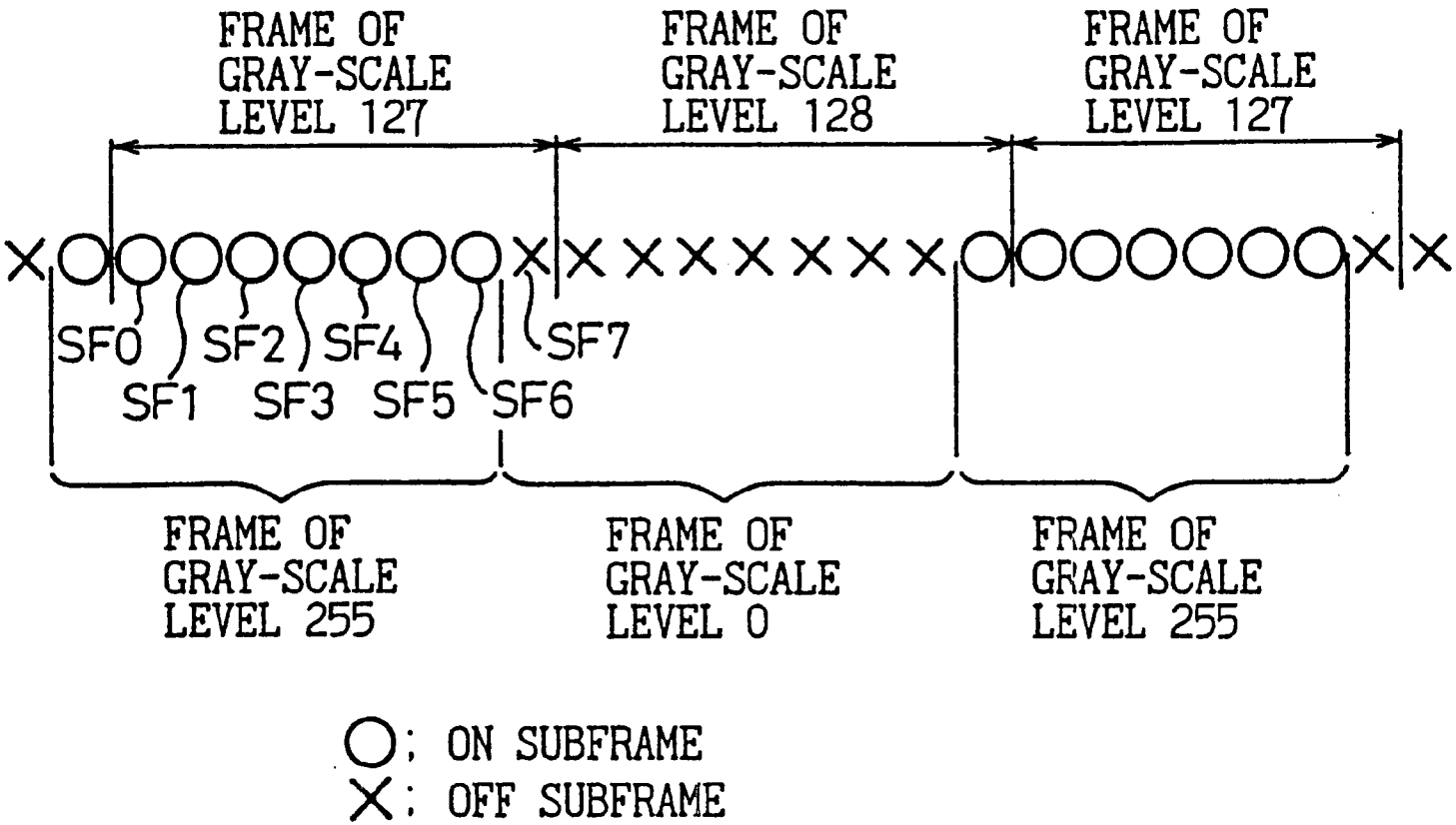
Fig.2 PRIOR ART
FIG. 2 is a diagram for explaining one example of subframe activation when displaying gray-scale levels 127 and 128.

FIG. 2 is a diagram showing one example of subframe activation when displaying gray-scale levels 127 and 128. As can be seen from FIG. 2, for the gray-scale level 127 the subframes SF0 to SF6 are all ON while only SF7 is OFF, and for the gray-scale level 128, only SF7 is ON while the other subframes SF0 to SF6 are OFF.

That is, when the gray-scale levels 127 and 128 alternate between frames as shown in FIGS. 2, for example, a period of full OFF state alternates with a period of full ON state, as a result of which the activation cycle becomes equal to one half of the frame repetition rate, causing flicker. In the A/D conversion of analog video display data representing portions of gradually changing luminance, for example, a display alternating between such particular gray-scale levels is constantly produced due to the effects of noise, conversion errors between frames (or between fields), etc. The resulting problem is that such A/D conversion errors, noise, etc. are amplified and displayed as flicker, degrading the display quality.

To address this problem, a halftone display method aiming at reducing such flicker has been proposed, in the prior art, in which the subframes are arranged, for example, in the order of SF0, SF2, SF4, SF6, SF7, SF5, SF3, and SF1, as disclosed in Japanese Unexamined Publication (Kokai) No. 3-145691.

Further, in the halftone display method of FIG. 1, if gray-scale levels with approximately the same luminance value, and with no or little temporal overlapping of ON subframes between them, are produced one adjacent to the other, flicker occurs at the boundary between them and the display quality significantly degrades. It is known that this display quality degradation becomes more pronounced at higher luminance levels. To address this flicker problem, it is proposed to divide the MSB subframe into two halves and arrange these two halves by sandwiching a smaller subframe between them, as disclosed, for example, in Japanese Unexamined Patent Publication (Kokai) No. 4-127194.

One drawback of the above-described halftone display method is that moving images lack smoothness of motion, impairing image quality, as is reported, for example, in Japanese Unexamined Patent Publication (Kokai) No. 5-127612, which proposes a method for alleviating the problem.

In the halftone display method of Japanese Unexamined Patent Publication (Kokai) No. 5-127612, a means for doubling the frame frequency of the display is provided in an input section where an image signal of a frame frequency of 70 Hz or less is input, and each frame having this doubled frame frequency is made up of one or more normal-bit subframes each displaying a normal bit, including the subframe displaying the most significant bit, and one or more non-normal-bit subframes displaying fractions of the normal bit. For a still image, the frames having the doubled frame frequency are processed two frames at a time, and for a moving image, the frames are processed one frame at a time, to reproduce a halftone gray scale. Furthermore, a new image signal (display signal) is created based on the input image signal, in order to create display data for the frames having the doubled frame frequency.

Figure 3:
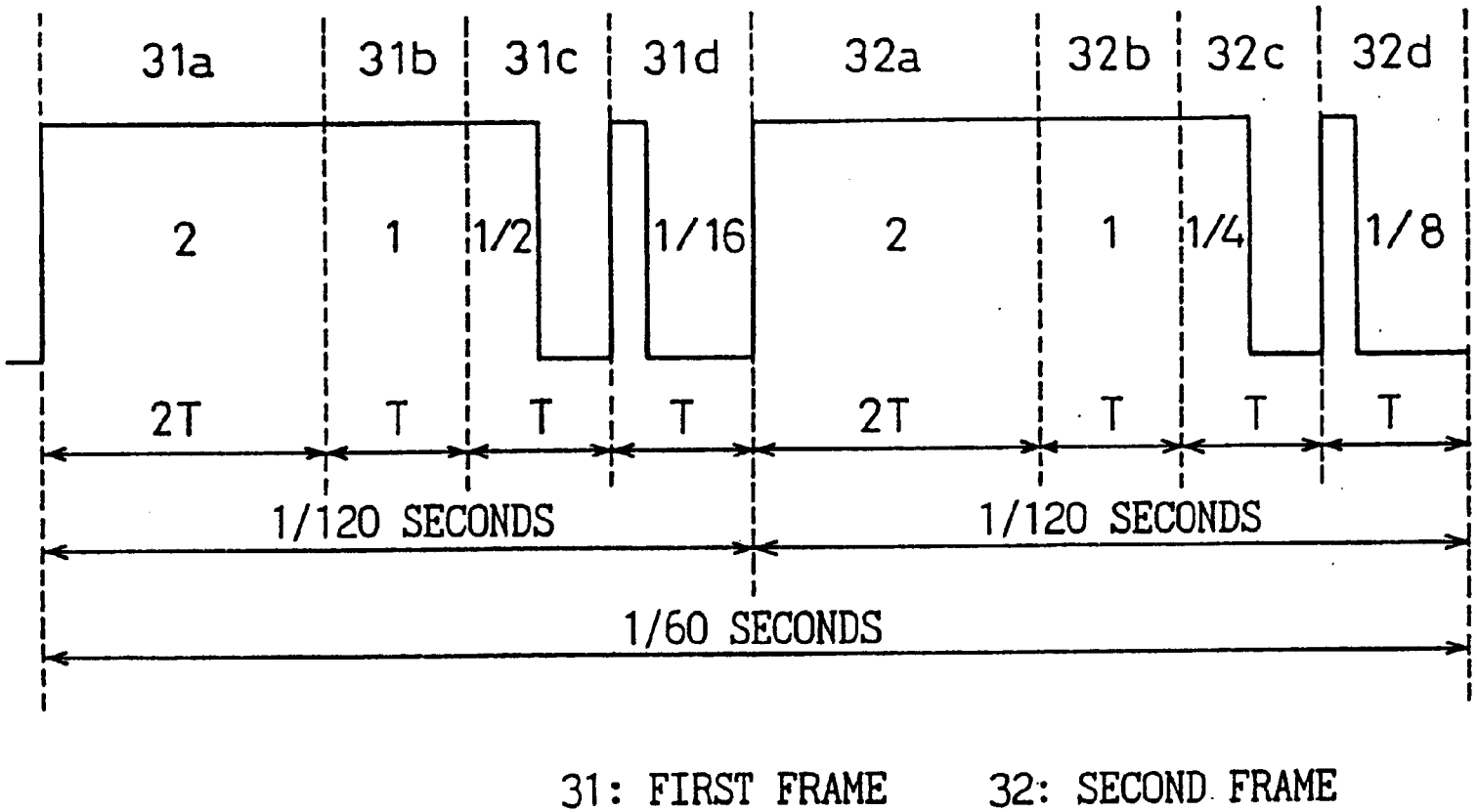
Fig. 3 PRIOR ART
FIG. 3 is a diagram for explaining activation states in first and second frames.

FIG. 3 is a diagram for explaining activation states in first and second frames. In FIG. 3, reference numeral 31 designates the first frame, and 32 the second frame, both frames having the doubled frame frequency. Here, the subframes having the same luminance weights between the first and second frames are termed the normal-bit subframes which are designated by 31*a*, 31*b*, 32*a*, and 32*b*. The other subframes are termed the non-normal-bit subframes.

While the above prior art alleviates the problem of halftone disturbances in still images and slow-moving images, halftone disturbances still occur in the case of fast-moving images. The mechanism by which halftone disturbances are caused will be explained with reference to FIGS. 4 to 7 for the case where the subframes within a frame are arranged in the order of SF5, SF4, SF3, SF2, SF1, and SF0 from the beginning of the frame (in the case of 64 gray scale levels).

Figure 4:
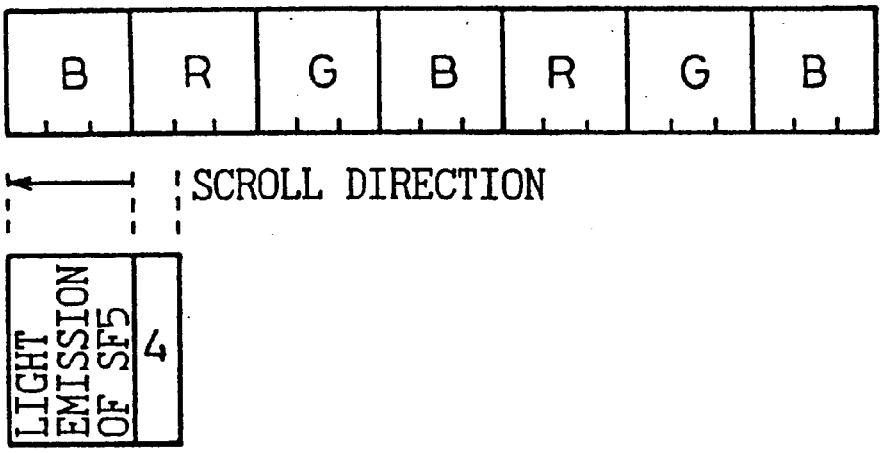
Fig.4 PRIOR ART
FIG. 4 is a diagram for explaining one example of a cause for halftone luminance disturbances in one example of the prior art halftone display method.
Figure 5:
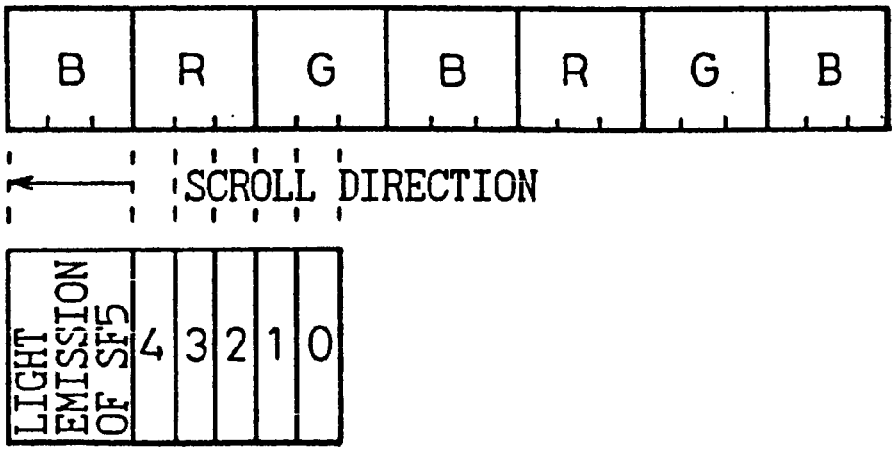
FIG. 5 is a diagram for explaining another example of a cause for halftone luminance disturbances in one example of the prior art halftone display method.
Figure 6:
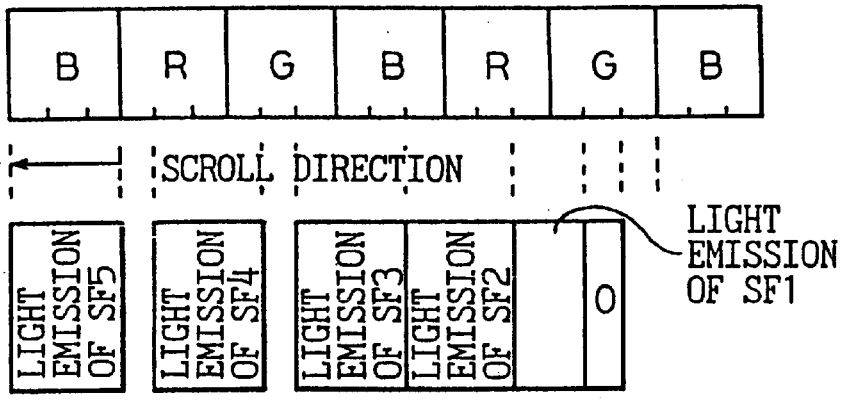
Fig.6 PRIOR ART
FIG. 6 is a diagram for explaining still another example of a cause for halftone luminance disturbances in one example of the prior art halftone display method.
Figure 7:
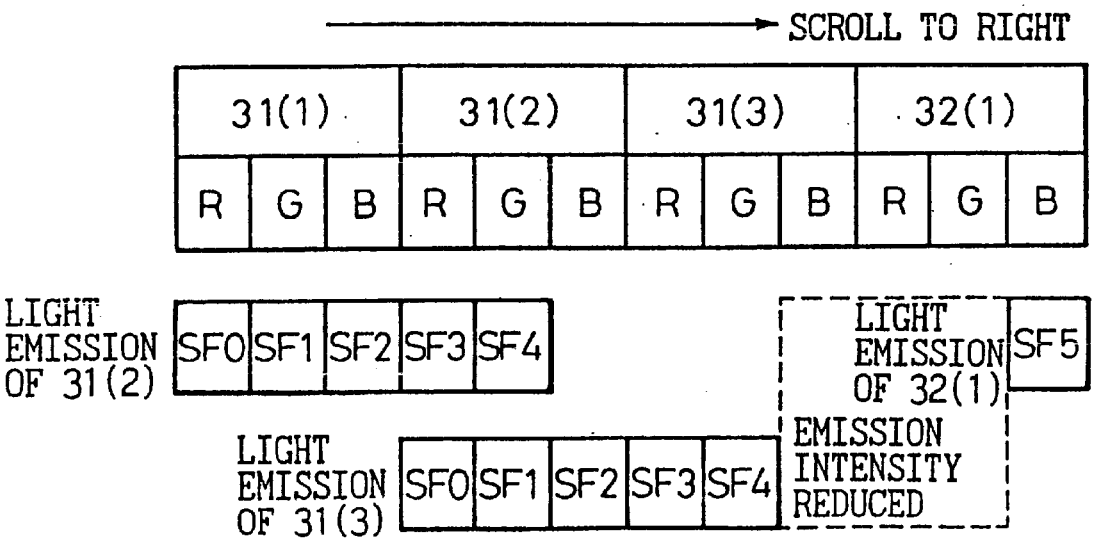
Fig.7 PRIOR ART
FIG. 7 is a diagram showing one example of subframe separation occurring when the gray-scale level changes from 31 to 32.

FIG. 4 is a diagram for explaining one example of a cause for halftone luminance disturbances in one example of the prior art halftone display method, FIG. 5 is a diagram for explaining another example of a cause for halftone luminance disturbances in one example of the prior art halftone display method, FIG. 6 is a diagram for explaining still another example of a cause for halftone luminance disturbances in one example of the prior art halftone display method, and FIG. 7 is a diagram showing one example of subframe separation occurring when the gray-scale level changes from 31 to 32.

For example, when producing a display where SF5 is turned on to display a blue vertical line and is scrolled from right to left, as shown in FIG. 4, if the blue line is moved at a speed of one pixel per frame (field), the line appears as if it is moving across other colored cells held in the OFF state, and a smooth motion is thus observed. This smooth motion is observed even when the blue line moves at a speed of a considerably large number of pixels per frame. This phenomenon is called the apparent motion or β motion in the field of psychology.

Next, if the blue vertical line with SF5 an SF4 turned on is scrolled from right to left at a speed of one pixel per frame, light emission of the subframes is observed as being spatially separated as shown in FIG. 4. For the sake of convenience, the light emission of SF5 is shown on the blue cell (B), but for the same reason as described above, the emitted light appears as if it is moving across the red cell (R) and green cell (G).

This is because, when SF4 is turned on with a time lag equivalent to the data write period of about 2 msec after SF5 is turned on, for example, the light emission of SF5 appears to have moved in the scrolling direction and, because of the apparent motion, the human eye perceives it as if the light emission of SF4 is following the light emission of SF5. Likewise, if all subframes within one frame are turned on and scrolled, it appears as if SF5 to SF0 are emitting light spatially separated from one another within one pixel, as shown in FIG. 5.

FIG. 6 shows the result of the observation in the case of a movement at a speed of two pixels per frame. In this case, the spacing between actually turned on cells is extended to two pixels, and the speed of the light appearing to be moving due to the apparent motion increases in proportion to the increase in the moving distance. Accordingly, when SF4 is turned on with a time lag of about 2 msec after SF5 is turned on, for example, the light emission of SF5 appears to have moved farther away, and it appears as if the spatial spacing of subframe light emission is spread further apart. From the result of the observation, it can be seen that the subframe light emission, in the presence of the apparent motion, is spatially spread out (separated) over the pixels across which the emitted light moves in one frame period.

As a result, in the case of a moving image, the subframes that are supposed to emit light in the same cell emit light in different sites (cells), rendering it impossible to express the halftone luminance of each cell by the sum of the respective subframes, and thus causing halftone luminance disturbances in moving image portions.

In a specific example, when a single-color gradation display is scrolled in the direction of the gradient, bright lines or dark lines are produced at the boundaries between particular gray-scale levels. This will be explained with reference to FIGS. 7 to 9.

In a display method in which there are six subframes in one frame (field) and the subframes are arranged in decreasing order of their luminance weights from the beginning of the frame, when a blue color gradation display is produced with the gray-scale level increasing from the left to the right of the display screen, and is scrolled in the gradient direction that increases the luminance, that is, in the rightward direction, dark lines are produced at the boundaries between gray-scale levels across which the number of ON subframes differs greatly. More specifically, the dark lines are produced at the boundaries between the halftone gradation levels 31 and 32, 15 and 16, and 7 and 8, for example. FIG. 7 is a diagram schematically illustrating how the dark line is produced at the boundary between the gray-scale levels 31 and 32 when the display is scrolled at a speed of two pixels per frame.

As shown in FIG. 7, since spatial subframe separation occurs in a moving image portion, OFF cells equivalent to one pixel are located at the boundary between the gray-scale levels 31 and 32, as a result of which the dark line is produced.

Figure 8:
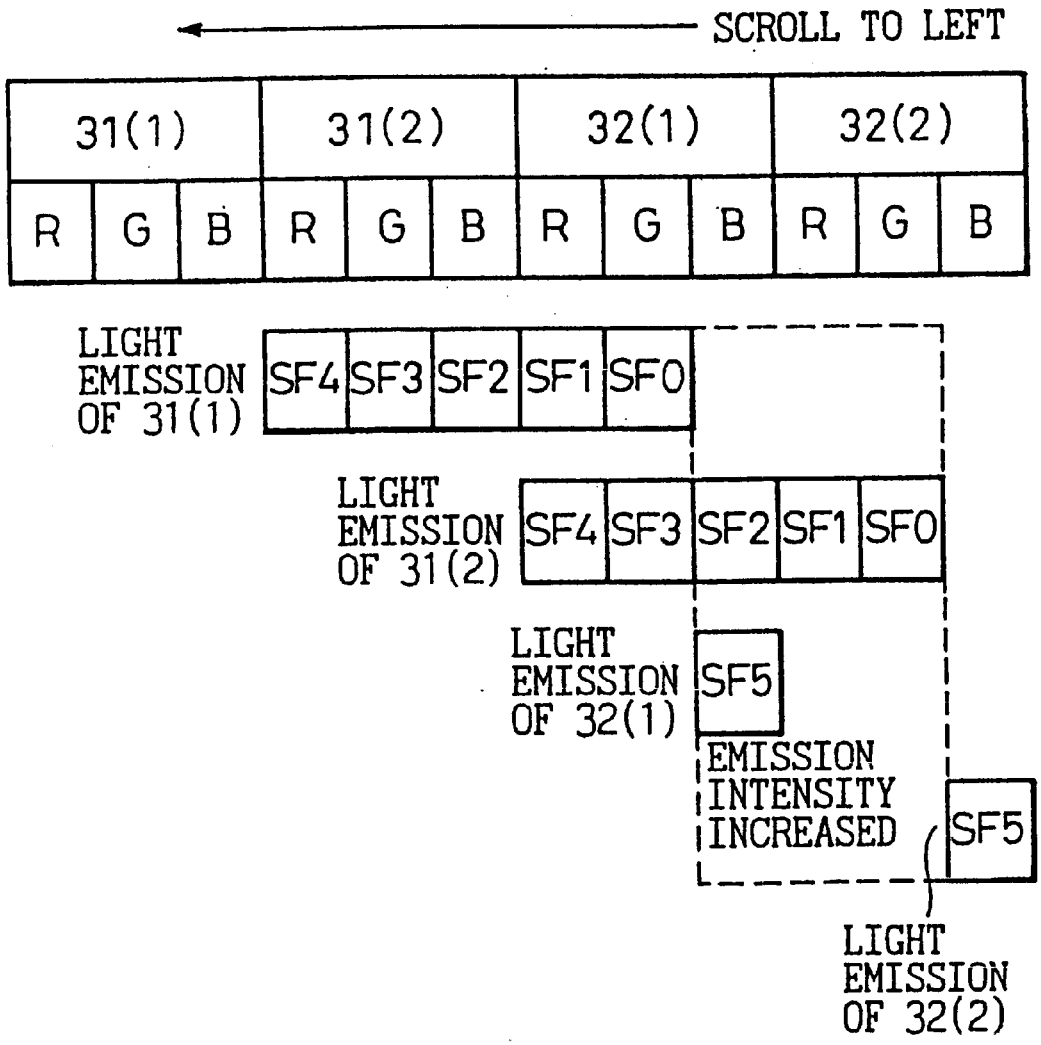
Fig.8 PRIOR ART
FIG. 8 is a diagram showing one example of subframe separation occurring when an image is scrolled to the right in the example of FIG. 7.
Figure 9:
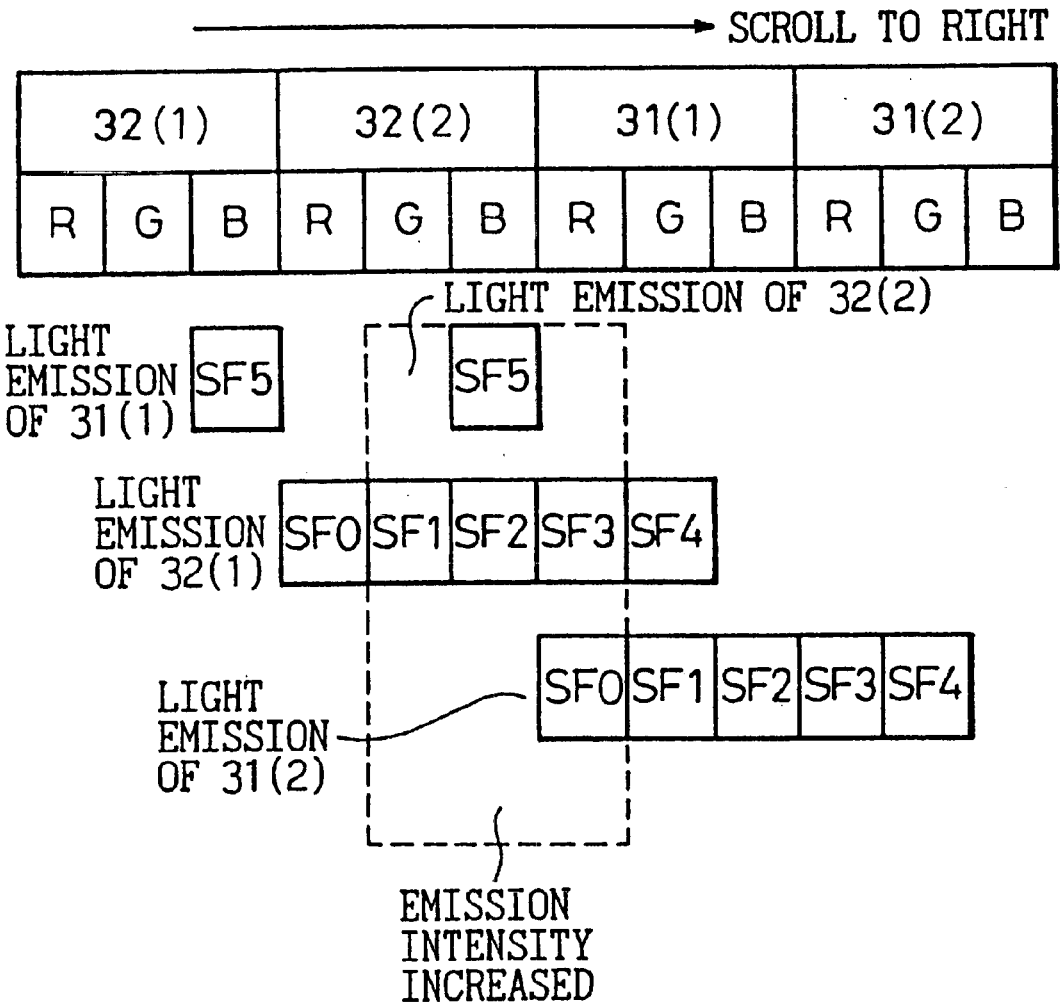
Fig.9 PRIOR ART
FIG. 9 is a diagram showing one example of subframe separation occurring when the gray-scale level changes from 32 to 31.

On the other hand, when the display is scrolled in the gradient direction that reduces the luminance, that is, in the leftward direction, the light intensity increases at the boundary between the gray-scale levels 31 and 32, increasing the luminance at the boundary, as shown in FIG. 8, resulting in the formation of a bright line. Even when the display is scrolled to the right, if it is scrolled in the gradient direction that reduces the luminance, as shown in FIG. 9, the light intensity increases likewise, increasing the luminance, resulting in the formation of a bright line.

Here, in the case of a single-color or colorless display, that is, if the ON subframes are the same for every color within a pixel, the halftone disturbances occurring in moving image portions manifest themselves in the form of bright lines or dark lines, and in the case of displaying an intermediate color, that is, if the ON subframes are different for each color within a pixel, different colors are produced than those produced when displaying a still image.

Referring now to FIGS. 10A to 12C, a detailed description will be given of how false moving-image contours (false color contours) occur when a moving image is displayed by applying the above-described prior art.

Figure 10A:
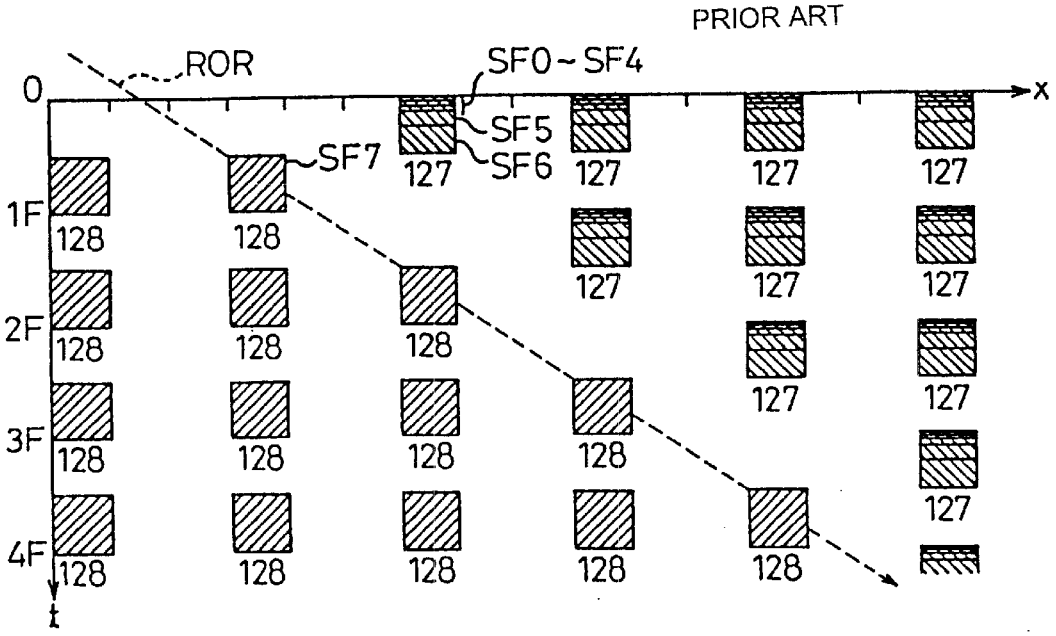
FIGS. 10A and 10B are diagrams showing the condition in which a display image is scrolled.
Figure 10B:
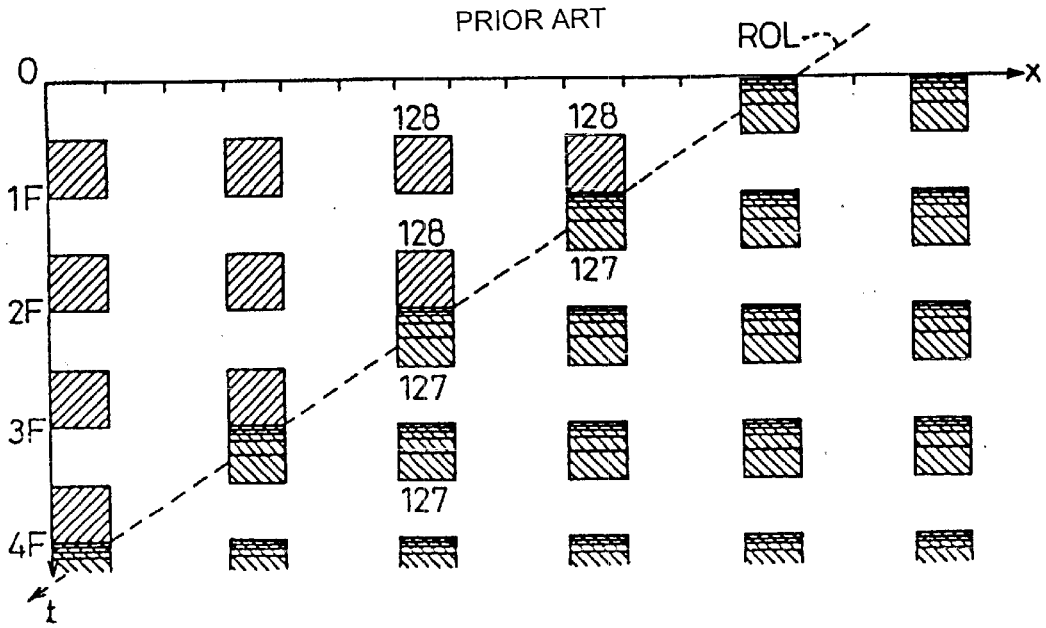

FIGS. 10A and 10B are diagrams showing the condition in which a display image is scrolled. FIG. 10A shows the condition in which the display image is scrolled from left to right at a speed of one pixel per frame, and FIG. 10B shows the condition in which the display image is scrolled from right to left at a speed of one pixel per frame. In FIGS. 10A and 10B, the vertical axis represents time t, and the horizontal axis corresponds to spatial position x. Reference characters 1F to 4F designate frames (fields).

Figure 11A:
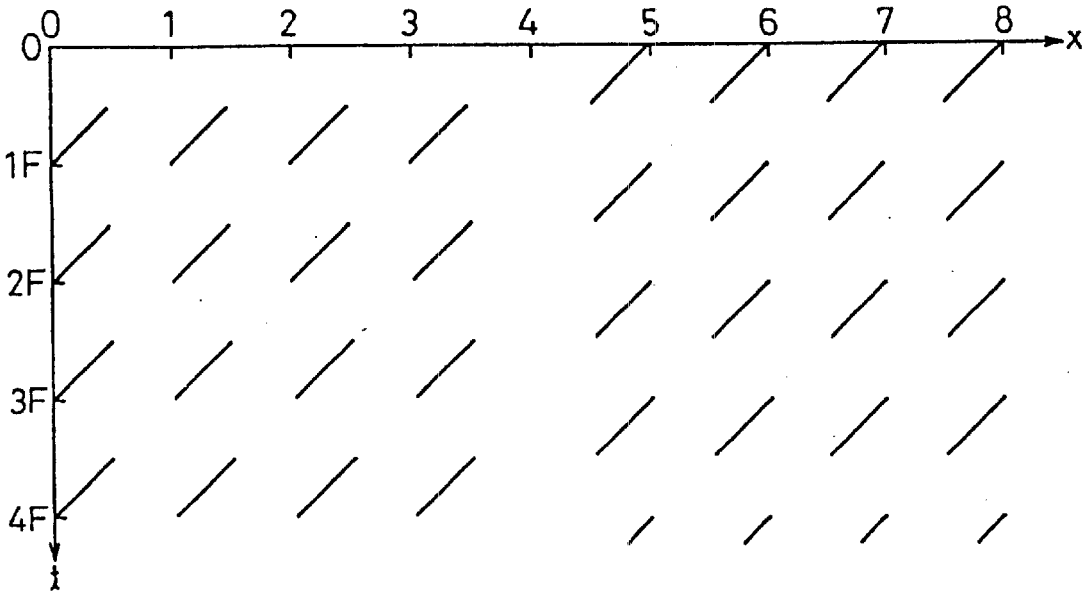
Fig.11A PRIOR ART
FIGS. 11A, 11B, and 11C are diagrams for explaining the problem that occurs when the display image is scrolled from left to right.
Figure 11B:
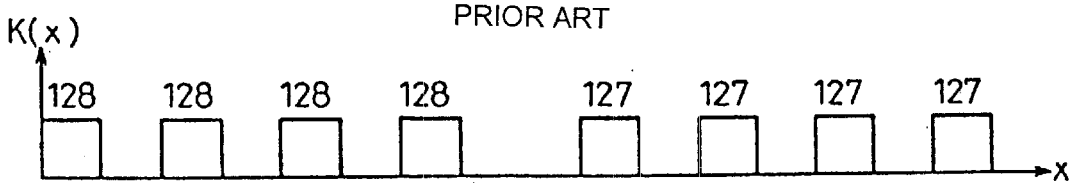
Fig.11B PRIOR ART
Figure 11C:
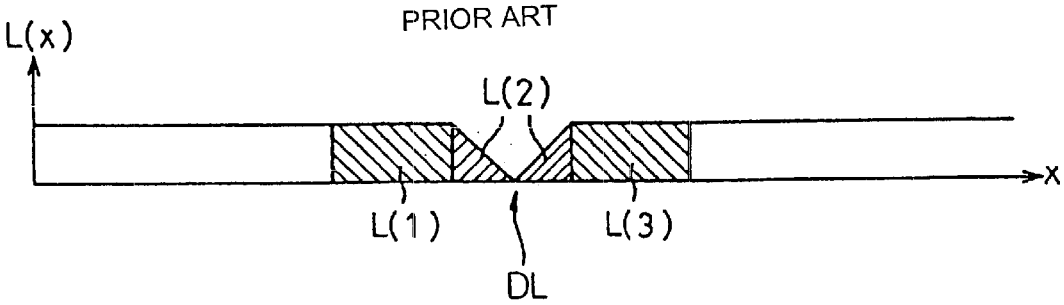
Fig.11C PRIOR ART
Figure 12A:
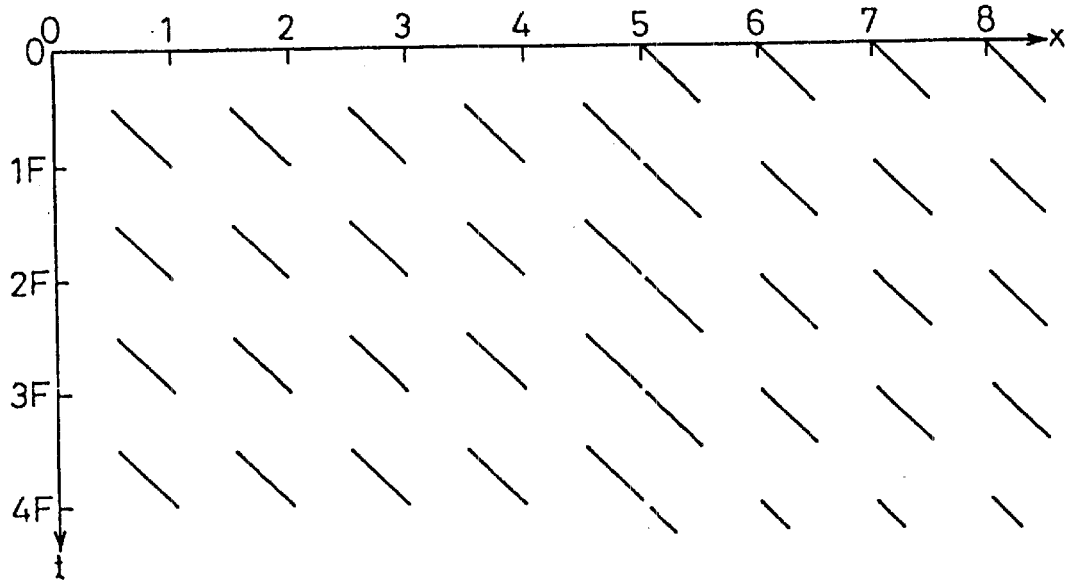
Fig.12A PRIOR ART
FIGS. 12A, 12B, and 12C are diagrams for explaining the problem that occurs when the display image is scrolled from right to left.
Figure 12B:
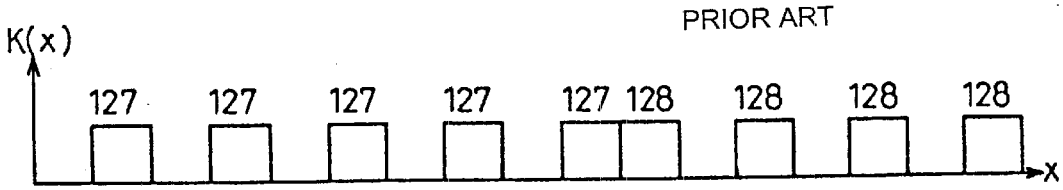
Fig.12B PRIOR ART
Figure 12C:
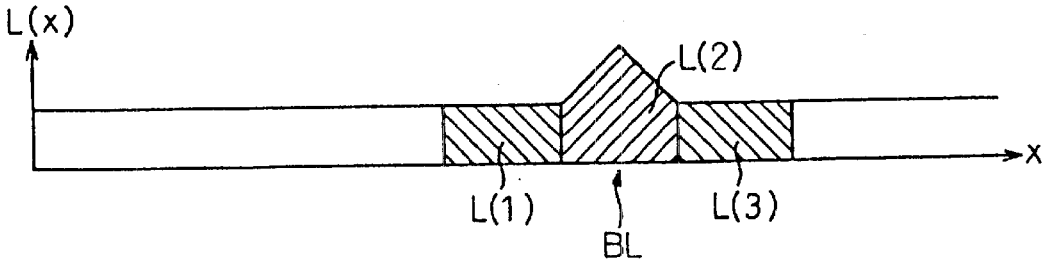
Fig.12C PRIOR ART

FIGS. 11A to 11C are diagrams for explaining the problem that occurs when the display image is scrolled from left to right, and FIGS. 12A to 12C are diagrams for explaining the problem that occurs when the display image is scrolled from right to left.

When the image with gray-scale levels 128 and 128 displayed adjacent each other is scrolled from left to right at a speed of one pixel per frame, as shown in FIG. 10A, the coordinate origin on the retina of the human eye moves along the dashed arrow (ROR) in the figure, since the human eye has the tendency to follow a moving object. FIG. 11A shows this condition redrawn with the coordinates on the retina fixed. Scales on the horizontal axis show the position on the retina, with the distance (length on the retina) that the display image moves in one frame period being 1.

Likewise, when the image with gray-scale levels 128 and 128 displayed adjacent each other is scrolled from right to left at a speed of one pixel per frame, as shown in FIG. 10B, the coordinate origin on the retina of the human eye moves along the dashed arrow (ROL) in the figure, since the human eye has the tendency to follow a moving object. FIG. 12A shows this condition redrawn with the coordinates on the retina fixed. Scales on the horizontal axis in FIG. 12A are the same as the scales on the horizontal axis in FIG. 11A.

Here, the gray-scale level 127 is achieved by a condition in which the subframes SF0 to SF6 are all ON and only SF7 is OFF, and the gray-scale level 128 by a condition in which the subframes SF0 to SF6 are all OFF and only SF7 is ON. In FIGS. 11A and 12A, each discharge cell is shown as having no area, to simplify the explanation.

First, when the display image with the gray-scale levels 128 and 127 displayed adjacent each other is scrolled from left to right, as shown in FIG. 11B, there occurs a discontinuity in luminance K(x) at the position (x) on the retina between the gray-scale levels 128 and 127. As a result, the amount of retinal stimulus L(x) abruptly drops (in the form of a valley) where the discontinuity exists between the gray-scale levels 128 and 127, as shown in FIG. 1C.

That is, when the amount of stimulus is integrated over the intervals x=2.5 to 3.5, 3.5 to 4.5, and 4.5 to 5.5, respectively, and the values of the integrals are denoted by L(1), L(2), and L(3), respectively, as shown in FIG. 11C, it can be seen that the following relation exists.

$$L(1) \approx L(3) >> L(2)$$

This means that a dark line DL is produced at the boundary between the gray-scale levels 128 and 127. This phenomenon causes halftone disturbances.

The amount of retinal stimulus L(x) is expressed by $$L(x) = \int_{\lambda-0.5}^{\lambda+0.5} K(x)\,dx$$

where λ is an arbitrary integer. In the above equation, the limits of the integral are shown as being λ−0.5 and λ+0.5, but the limits of the integral can be taken arbitrarily, and should preferably be set approximately equal to the limits within which halftone disturbances are expected to occur.

Next, when the display image with the gray-scale levels 128 and 127 displayed adjacent each other is scrolled from right to left, as shown in FIG. 12B, the luminance K(x) at the position (x) on the retina becomes continuous between the gray-scale levels 128 and 127. As a result, the amount of retinal stimulus L(x) shows a peak at the boundary between the gray-scale levels 128 and 127, as shown in FIG. 12C.

That is, when the amount of stimulus is integrated over the intervals x=2.5 to 3.5, 3.5 to 4.5, and 4.5 to 5.5, respectively, and the values of the integrals are denoted by L(1), L(2), and L(3), respectively, as shown in FIG. 12C, it can be seen that the following relation exists.

$$L(1)\approx L(3)<<L(2)$$

This means that a bright line BL is produced at the boundary between the gray-scale levels 128 and 127.

When colored gray-scale levels are moved, for example, when green color gray-scale levels 128 and 127 and red color gray-scale level 64 are moved from right to left, a dark line is produced at the boundary between the green color gray-scale levels, but the red color shows a constant luminance level (gray-scale level) because there is no gray-scale level boundary in the red color. Since the human eye sees the result of color combination, the red color becomes visible in the dark line area of the green color, thus causing a color contour.

This phenomenon becomes pronounced particularly in flesh-tone areas where the gray-scale level changes smoothly, and in a video image, this causes a red or green contour (false color contour) to be formed on a person's cheek when the person looks back over his shoulder.

Namely, in the plasma display panel (PDP), when a moving image is displayed, the image is disturbed by the after-image effect on the eyes. This disturbance normally appears conspicuously especially along the contour of the face, and therefore called the moving image false contour. This is a major cause of deteriorated image quality of a PDP. Under the circumstances, the number of gray scales is reduced and the overlapping process are employed as a technique for making the moving image false contour less conspicuous. The number of gray scales reduced by this process is increased to 256 scales by the error diffusion process in simulation. The use of these methods, however, makes it impossible to obtain a natural image expression. For the natural image expression to be obtained down to the low gray-scale portion, the moving image false contour is required to be reduced without reducing the number of gray scales.

To address this problem, the present inventor et al. have proposed in Japanese Unexamined Patent Publication (Kokai) No. 10-39828 a halftone display method and display apparatus in which, when the gray-scale level of a pixel changes, a predetermined luminance block (equalizing pulse) for luminance adjustment is added to or subtracted from the pixel, depending on the state of the change.

FIGS. 13A to 13I are diagrams for explaining the prior art halftone display method proposed in Japanese Unexamined Patent Publication (Kokai) No. 10-39828.

Figure 13A:
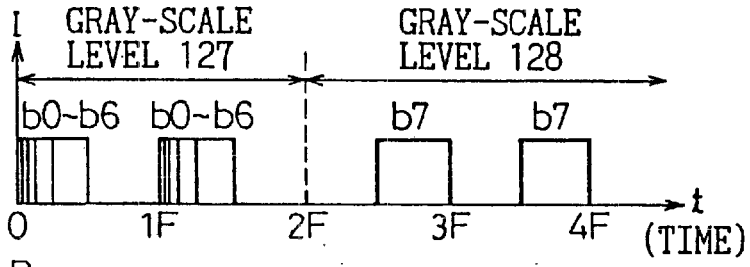
Fig.13A PRIOR ART
FIGS. 13A, 13B, 13C, 13D, 13E, 13F, 13G, 13H, and 13I are diagrams for explaining another example of the prior art halftone display method.

FIG. 13A shows the emission intensity I(t) of a discharge cell when the gray-scale level changes from level 127 to level 128. The horizontal axis t represents time. As shown in FIG. 13A, the first two frames (fields: 1F and 2F) are displayed with level 127, and the next two frames (3F and 4F) with level 128.

Figure 13B:
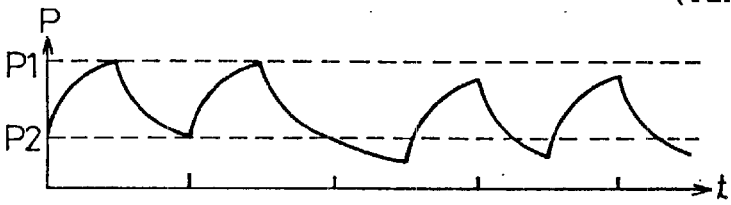
Fig.13B PRIOR ART

FIG. 13B shows retinal stimulus intensity P(t) which is a measure of the emission intensity I perceived by the human eye. The retinal stimulus intensity P cyclically changes between P1 and P2 during the display period of level 127, but at the beginning of the frame (3F) that displays level 128, the intensity value drops below P2. When the frames of level 128 (F4, . . . ) continue successively, the stimulus intensity again oscillates between P1 and P2.

This temporary drop in the stimulus intensity P is observed as halftone disturbances by the human eye. Visually perceived intensity B(t) is given by the integral of the retinal stimulus intensity P(t) over afterimage time, and is substantially the same as that shown in FIG. 13C. In the figure, if the relation S1<S2<S3 were satisfied, no halftone disturbances would be observed. As it is, however, the result shown in FIG. 13C clearly does not satisfy this relation. In this case, the gray scale boundary appears darker than the original image. Here, if intensity ΔS is added to S2 to yield S1<S2+ΔS<S3, no halftone disturbances will occur.

Figure 13C:
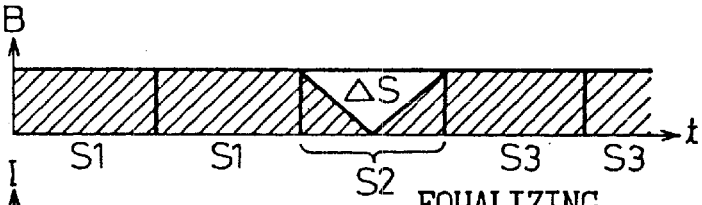
Fig.13C PRIOR ART
Figure 13D:
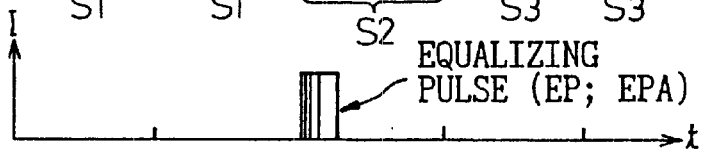
Fig.13D PRIOR ART
Figure 13E:
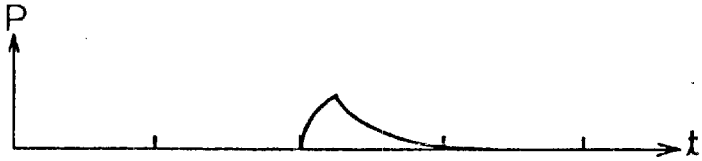
Fig.13E PRIOR ART
Figure 13F:
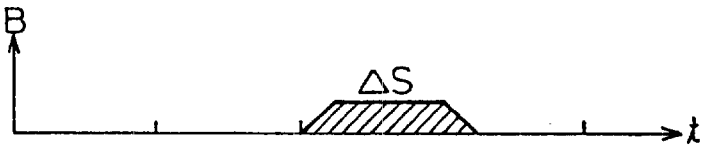
Fig.13F PRIOR ART
Figure 13G:
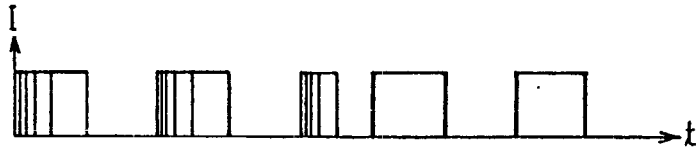
Fig.13G PRIOR ART
Figure 13H:
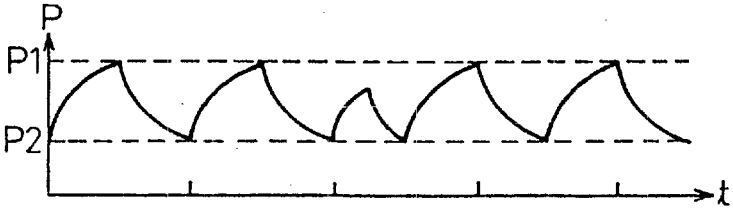
Fig.13H PRIOR ART

In view of this, in the halftone display method proposed in Japanese Unexamined Patent Publication (Kokai) No. 10-39828, an equalizing pulse EP whose emission intensity is shown in FIG. 13D is added. The retinal stimulus intensity P(t) due to the equalizing pulse EP is shown in FIG. 13E, and its visually perceived intensity B(t) is shown in FIG. 13F. The emission intensity I(t), retinal stimulus intensity P(t), and visually perceived intensity B(t), after the addition of the equalizing pulse EP, are shown in FIGS. 13G, 13H, and 13I, respectively.

Figure 13I:
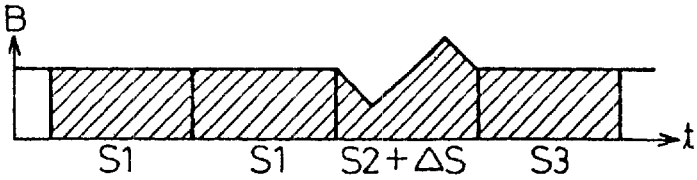
Fig.13I PRIOR ART

As can be seen from a comparison between FIGS. 13C and 13I, the addition of the equalizing pulse EP (EPA) contributes to reducing the disturbance in the visually perceived intensity. There may be a case where a negative equalizing pulse EP (EPS) is inserted here. In that case, the width of the luminance block is reduced to reduce the luminance.

Figure 14:
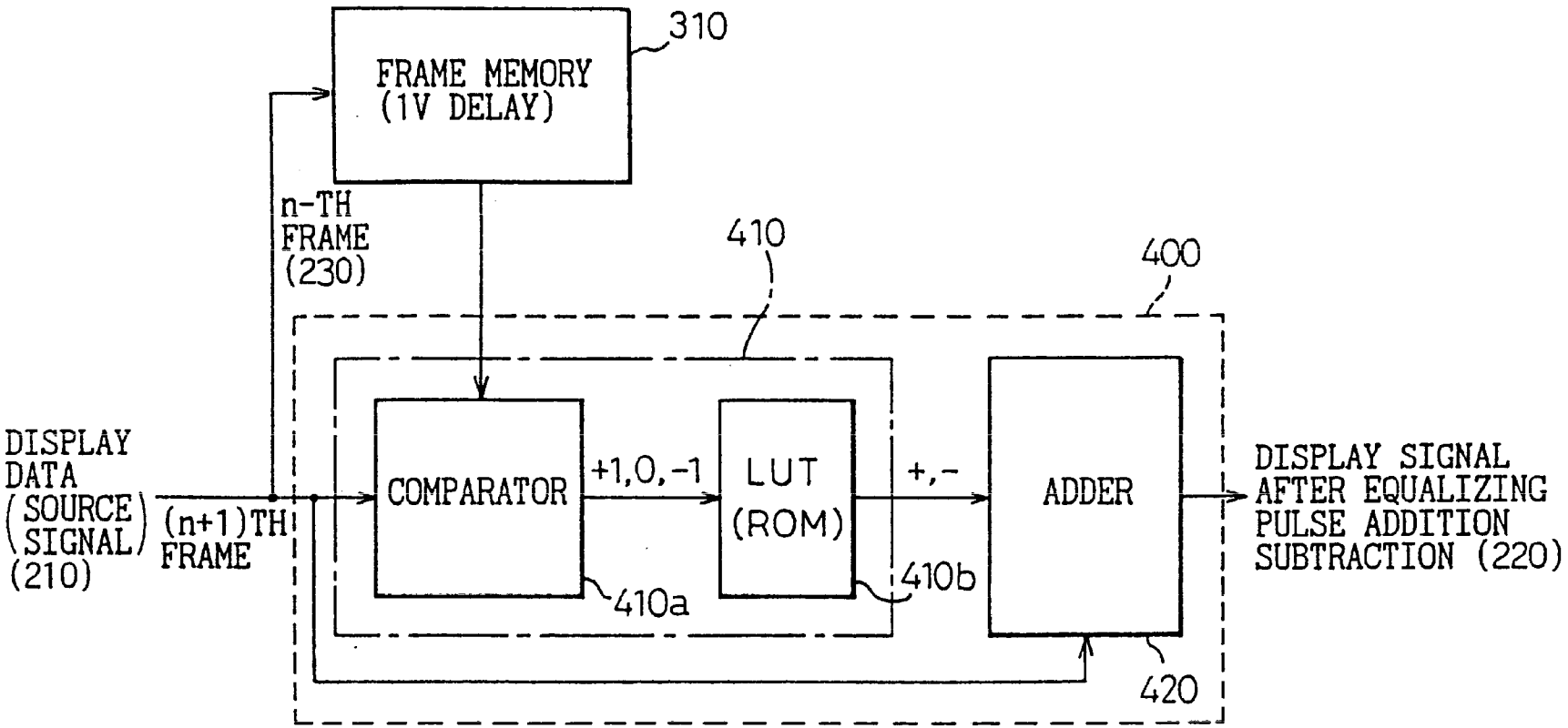
Fig.14 PRIOR ART
FIG. 14 is a block diagram showing one example of a luminance adjusting luminance block insertion circuit according to the prior art.

The insertion of the equalizing pulse is accomplished using, for example, a circuit such as that shown in FIG. 14.

FIG. 14 is a block diagram showing one example of a luminance adjusting luminance block insertion circuit according to the prior art. In FIG. 14, reference numeral 310 is a frame memory for providing a delay equivalent to one vertical synchronization period (1V), 400 is a luminance adjusting luminance block adding circuit, 410 is an equalizing pulse discrimination circuit, and 420 is an equalizing pulse adding circuit.

In the luminance adjusting luminance block insertion circuit shown in FIG. 14, the equalizing pulse discrimination circuit 410 consists of a comparison circuit (comparator) 410*a* and a lookup table (LUT: ROM) 410*b*, while the equalizing pulse adding circuit 420 is configured as an adder (addition circuit). The comparator 410*a* compares bit data in the n-th frame with bit data in the (n+1)th frame, the frame immediately following the n-th frame, and outputs "+1" for any bit in the bit data that changed from ON to OFF, "−1" for any bit that changed from OFF to ON, and "0" for any bit that did not change state between the frames.

The LUT 400*b* is configured, for example, as a ROM in which prescribed data are prewritten, and outputs a prescribed (prewritten) equalizing pulse according to the output of the comparator 410*a*. The equalizing pulse output from the LUT 410*b* has a positive or negative sign.

The adder 420 adds the equalizing pulse (with positive or negative sign) to the source signal (display data 210) (in the case of the negative sign, the equalizing pulse is subtracted from the source signal), and outputs a display signal (220) after adding or subtracting the equalizing pulse.

The prior art halftone display method (equalizing pulse method) proposed in Japanese Unexamined Patent Publication (Kokai) No. 10-39828 is excellent in that the total luminous flux entering the eye becomes equal to the source signal. That is, the total amount in the interval of S2+SΔ in FIG. 13I is substantially equal to that in S1 or S3, though there are temporal fluctuations in the visually perceived intensity. Accordingly, when the display image is viewed a sufficient distance away from the display apparatus (PDP screen), halftone disturbances are not discernible by the eye, thus alleviating the problem of halftone luminance disturbances.

The above statement that the total luminous flux becomes equal to the source signal holds true for moving images as well as for still images, but when the spatial nonuniformity of the visually perceived intensity increases, as is the case with a fast-moving image, satisfactory image quality cannot always be obtained.

In view of this, the present inventor et al. have proposed, in Japanese Unexamined Patent Publication (Kokai) No. 10-133623, a halftone display method and display apparatus that can minimize moving-image false color contours occurring in a moving image moving at high speed. According to the halftone display method proposed in Japanese Unexamined Patent Publication (Kokai) No. 10-133623, when the activation pattern of particular luminance blocks in a pixel changes between successive frames or fields, the number of linearly contiguous pixels on the display screen that exhibit the same change as the interframe or interfield change of the above activation pattern is computed. Further, the states of the ON blocks within the frame or field in two pixels on both sides of the contiguous pixel sequence are detected, and a predetermined luminance adjusting luminance block is selected based on the number of contiguous pixels, the states of the two pixels on both sides of the contiguous pixel sequence, and the state of the interframe or interfield change of the activation pattern. Then, the selected luminance adjusting luminance block is added to or subtracted from the source signals of the contiguous pixels.

FIGS. 15 to 18B are diagrams for explaining one example of the halftone display method (motion compensation equalizing pulse method) proposed in Japanese Unexamined Patent Publication (Kokai) No. 10-133623, showing the case where a weighted positive equalizing pulse EPA is added. The explanation given hereinafter with reference to FIGS. 15 to 18B assumes the use of the activation sequence previously shown in FIG. 1 in which a gray scale display is produced by dividing one frame into eight subframes SF0 to SF7 each consisting of one bit.

Figure 15:
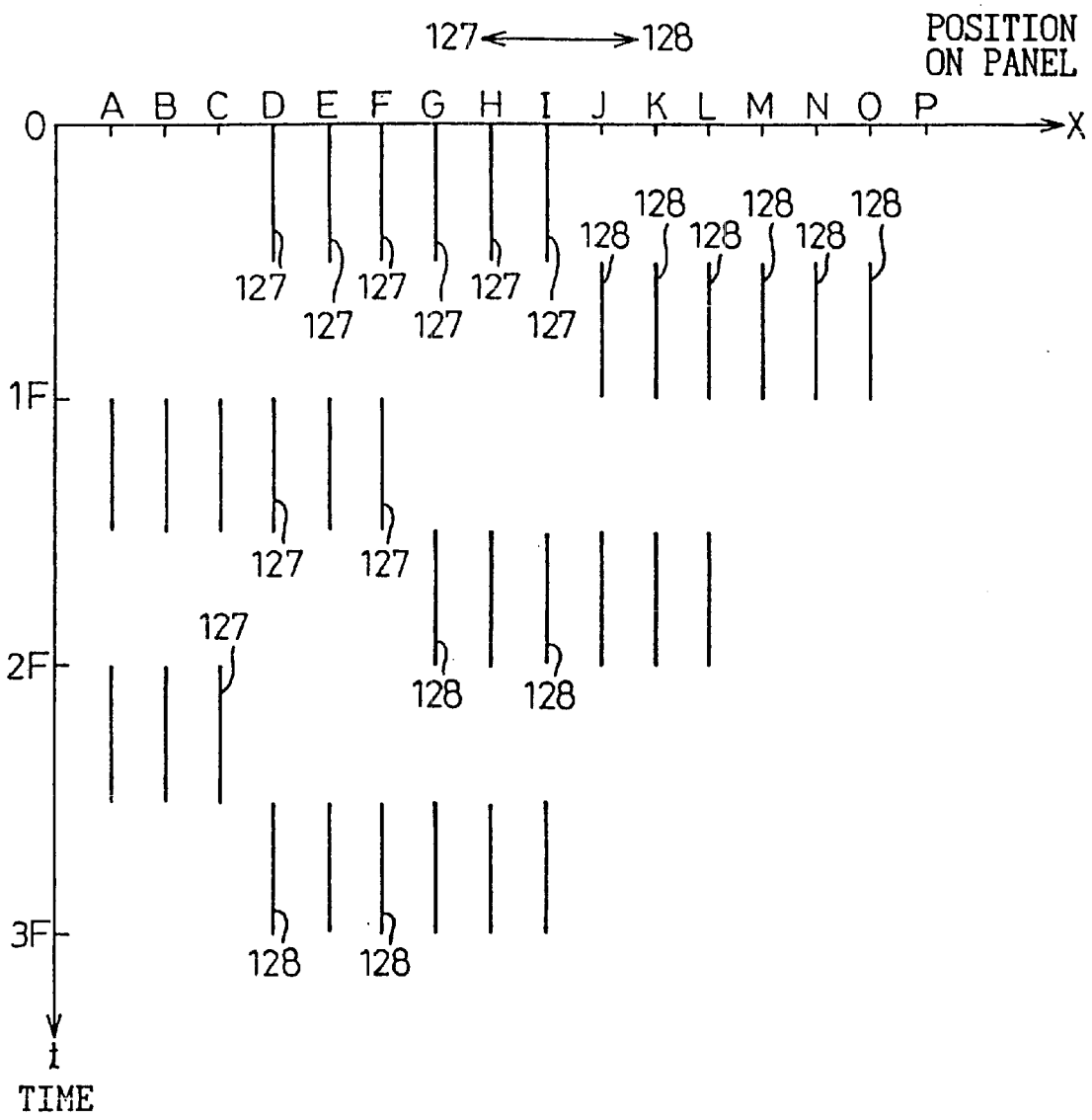
Fig.15 PRIOR ART
FIG. 15 is a diagram (part 1) for explaining a further example of the prior art halftone display method.

FIG. 15 shows the situation in which an image is moved from right to left at a speed of three pixels per frame; time t (frame time: 1F, 2F, 3F) is plotted along the vertical axis, and the position X (pixels A, B, C, . . . , P) on a horizontal line on the display panel is plotted along the horizontal axis. To simplify the explanation, the case of a single-color display is considered; in the case of a multi-color display, each color (R, G, B) should be treated individually and, thereafter, the respective colors should be combined. In the figure, the pixel area is shown sufficiently small.

In FIG. 15, each vertical line indicates the light emission state of a pixel. In the first frame ($0 \leqq t < 1F$), pixels A to C and P are OFF, pixels D to I are ON with gray-scale level 127, and pixels J to O are ON with gray-scale level 128. Therefore, in the first half of the frame, the pixels D to I emit light, and in the second half, the pixels J to O emit light. In the second frame ($1F < t < 2F$), pixels A to F are ON with gray-scale level 127, and pixels G to L are ON with gray-scale level 128; accordingly, in the first half of the second frame, the pixels A to F emit light, and in the second half, the pixels G to L emit light. Thereafter, similar light emission patterns are repeated.

If the same pattern is displayed on all the horizontal lines on the display panel, a viewer will see a long, vertically extending belt pattern on the screen. The six pixels in the left half of this belt pattern are emitting light to display gray-scale level 127, and the six pixels in the right half are emitting light to display gray-scale level 128, the belt pattern moving from right to left at a speed of three pixels per frame. Although the light emission points and their temporal changes are discrete, the human eye perceives this as a smooth motion, and the center of the retina follows the moving belt pattern.

Figure 16A:
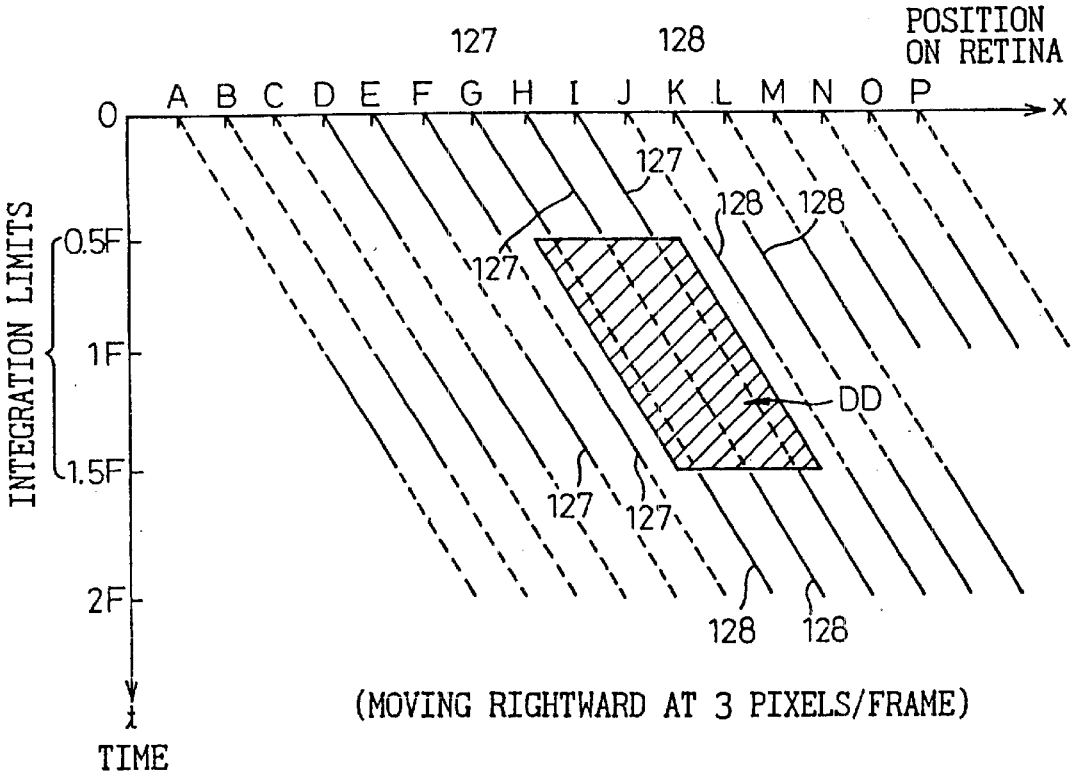
Fig.16A PRIOR ART
FIGS. 16A and 16B are diagrams (part 2) for explaining a further example of the prior art halftone display method.

In FIG. 16A, position coordinates x, fixed on the retina, are plotted along the horizontal axis. When the image moves from right to left, since the eye follows the moving pattern, the pixels projected on the retina correspondingly move from left to right on the retina. Accordingly, in FIG. 16A, each pixel moves along a straight line extending downward to the right. In FIG. 16A, the left-hand side is displayed with gray-scale level 127 and the right-hand side with gray-scale level 128. Here, the pixel symbols A to P shown in the upper part of FIG. 16A indicate their positions at time t=0, and the pixels move from left to right with time.

Figure 16B:
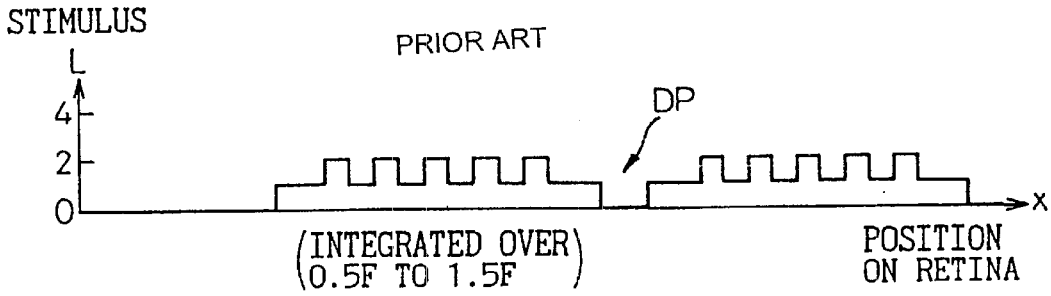
Fig.16B PRIOR ART

FIG. 16B shows the emission intensity perceived by the retina and changing with changing position. The intensity is plotted by integrating over time t=0.5F to 1.5F (F corresponding to the length of one frame). The same applies to FIGS. 17A and 17B and FIGS. 18A and 18B hereinafter given.

As shown in FIG. 16B, a dark emitting part DP appears between the gray-scale levels 127 and 128. In this time period, since three pixels G, H, and I change from gray-scale level 127 to gray-scale level 128 between the first and second frames, a totally OFF period equivalent to one frame (DD) occurs. This causes the dark emitting part DP.

Figure 17A:
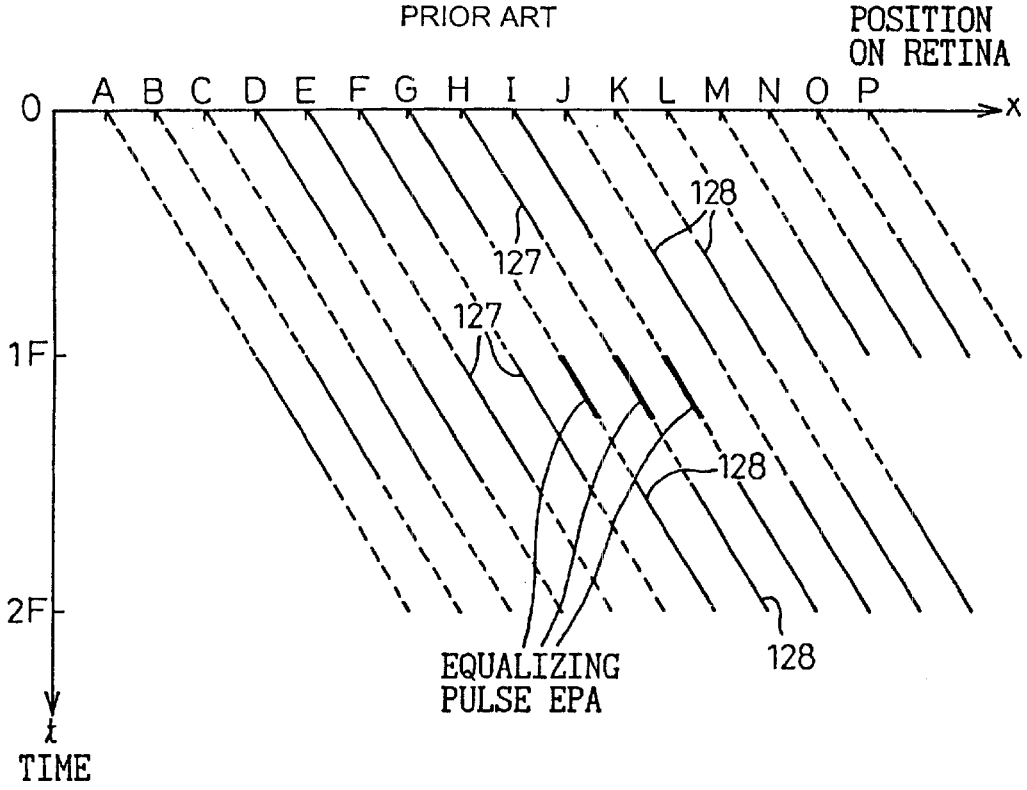
Fig.17A PRIOR ART
FIGS. 17A and 17B are diagrams (part 3) for explaining the further example of the prior art halftone display method.
Figure 17B:
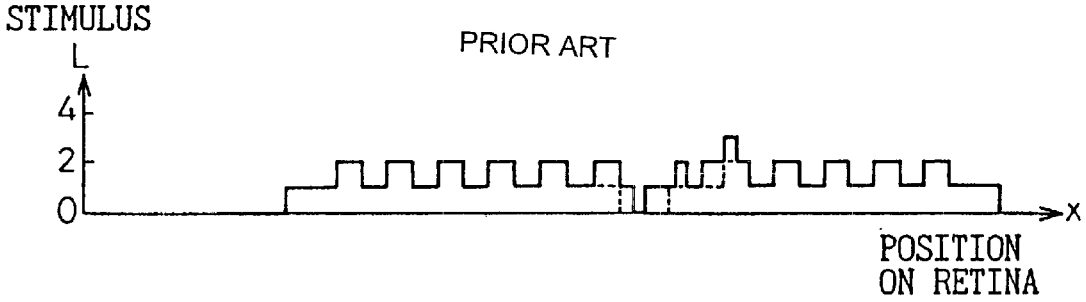
Fig.17B PRIOR ART

It is therefore necessary to add equalizing pulses to the three pixels (G, H, and I). FIGS. 17A and 17B correspond to the prior art halftone display method (equalizing pulse method) proposed by the present inventor et al. in Japanese Unexamined Patent Publication (Kokai) No. 10-133623, and show an example in which an equalizing pulse (weighted positive equalizing pulse) EPA is superimposed on the source signal of each of the pixels G, H, and I. The size of the equalizing pulse EPA is calculated as luminance level 63 (gray-scale level 63), for example, as previously explained with reference to FIGS. 13A to 13I.

As can be seen from a comparison between FIGS. 17B and 16B, the addition of the equalizing pulses EPA serves to improve the emission intensity perceived by the retina, compared with the case of FIG. 16B. In particular, since the amount too bright and the amount too dark, compared with the luminance level (gray scale level) 127 or 128, cancel each other, when the display image is viewed a sufficient distance away from the display panel, halftone disturbances are not discernible by the eye.

However, when the panel is observed at a close distance, variations in luminance are visible; furthermore, as explained with reference to the simulation results shown in FIGS. 15 to 18B, if the image (pixel) moving speed is faster than three pixels per frame (for example, in the case of four pixels or five pixels per frame), these luminance variations become more noticeable.

Figure 18A:
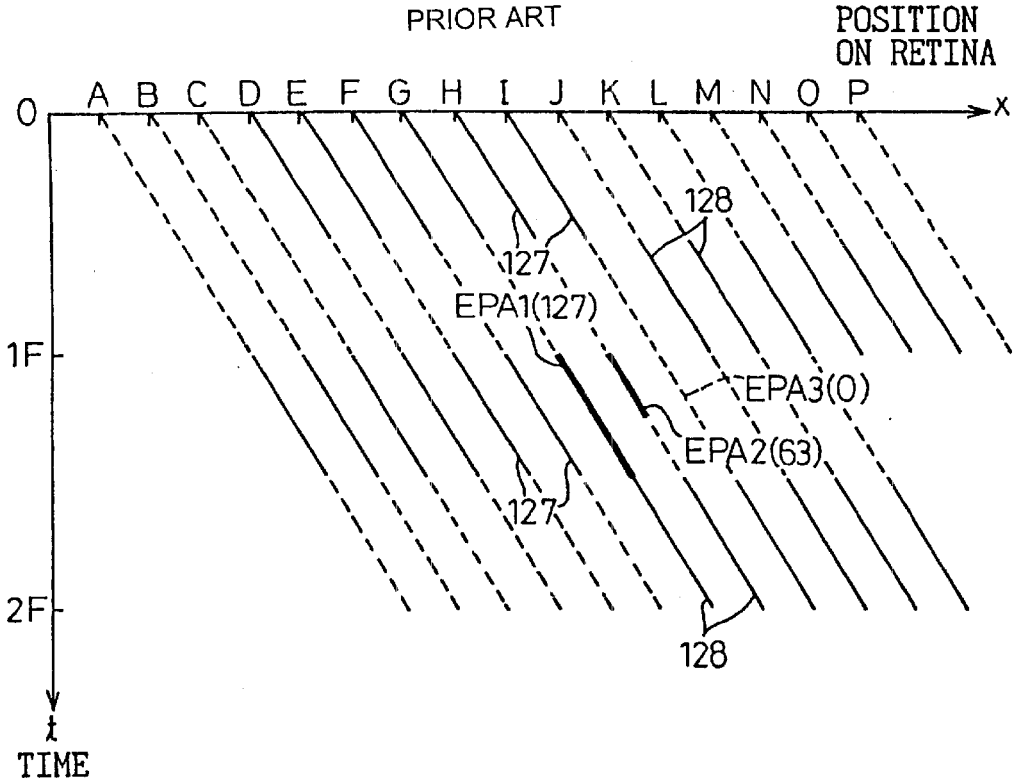
FIGS. 18A and 18B are diagrams (part 4) for explaining the further example of the prior art halftone display method.
Figure 18B:
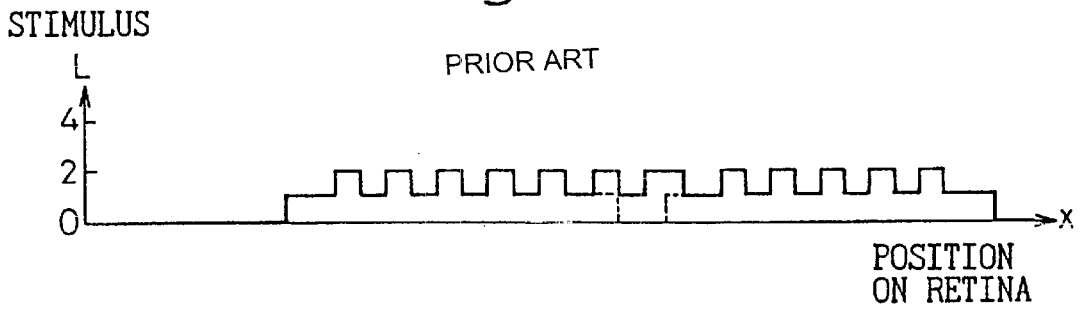

FIGS. 18A and 18B illustrate one embodiment in which the equalizing pulse is weighted according to the halftone display method of the present invention, showing the case where the weighted positive equalizing pulse EPA is applied.

As shown in FIG. 18A, in the present embodiment, an equalizing pulse EPA1 of gray-scale level 127 is applied to the pixel G, an equalizing pulse EPA2 of gray-scale level 63 to the pixel H, and an equalizing pulse EPA3 of gray-scale level 0 to the pixel I (that is, no equalizing pulse is applied to the pixel I). These equalizing pulses are set so that the total amount (EPA1+EPA2+EPA3=127+63+0=190) become approximately equal to the total amount of the equalizing pulses (3·EPA=189) applied in FIG. 17A.

As can be seen from FIG. 18B, the emission intensity perceived by the retina is further improved compared with that shown in FIG. 17B.

The traditional subframe activation sequence has used a plurality of luminance blocks SF0, SF1, SF2, . . . SF(N−1) whose luminance weight ratios are set as $2^0$, $2^1$, $2^2$, . . . , $2^{N-1}$, as previously shown in FIG. 1, but the subframe activation sequence that is becoming predominant today is such that more than one luminance block is assigned a large luminance weight (for example, more than one luminance block is assigned the largest luminance weight) so that one gray-scale level can be expressed by any one of a plurality of combinations of subframes (luminance blocks).

Figure 19:
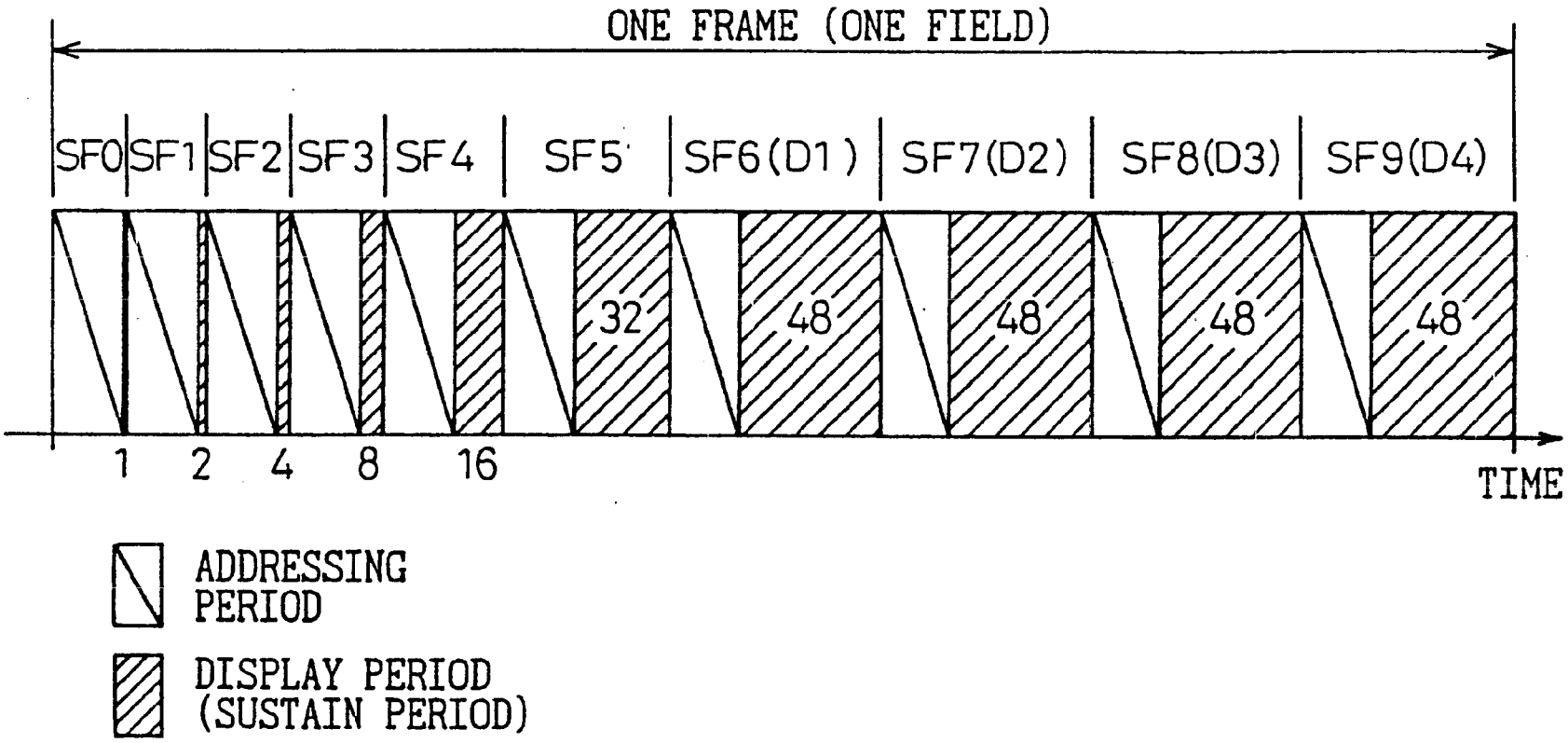
Fig.19 PRIOR ART
FIG. 19 is a diagram showing one example of the prior art subframe activation sequence to which the present invention is applied.

FIG. 19 is a diagram showing one example of a prior art subframe activation sequence to which the present invention is applied; the activation sequence shown is one that can express one gray-scale level by any one of a plurality of combinations of subframes as described above.

As shown in FIG. 19, one frame (one field) consists of 10 (N=0 to 9) subframes (luminance blocks) labeled SF0, SF1, . . . , SF9 in increasing order of their luminance weights. There are four luminance blocks, SF6, SF7, SF8, and SF9, that have the largest luminance weight, each block representing gray-scale level 48 (luminance level 48). In the following description, these gray-level-48 luminance blocks SF6, SF7, SF8, and SF9 may also be referred to as D1, D2, D3, and D4, respectively.

In the activation sequence of FIG. 19, the sum of the gray-scale levels (64+128=192) of the two most heavily weighted luminance blocks SF6 and SF7 (the most significant two bits) in the activation sequence of FIG. 1 is distributed among the four luminance blocks SF6, SF7, SF8, and SF9, so that each of the four blocks is assigned the largest luminance weight of gray-scale level 48 (48+48+48+48=192). The luminance blocks SF0 to SF5 in the activation sequence of FIG. 19 correspond to the luminance blocks SF0 to SF5 in the activation sequence of FIG. 1.

Figure 20:
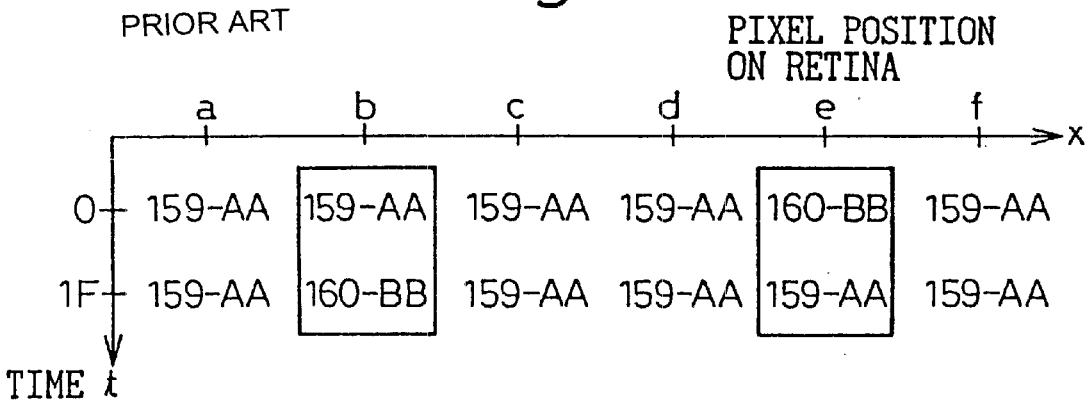
Fig.20 PRIOR ART
FIG. 20 is a diagram for explaining the problem associated with the activation sequence of FIG. 19.

FIG. 20 is a diagram for explaining the problem associated with the activation sequence of FIG. 19. In FIG. 20, the horizontal axis represents the position coordinates x fixed on the retina, and the vertical axis shows time t. Here, 0 and 1F plotted along the vertical axis t indicate an image (0) in a frame (field) at a given time and an image (1F) in the next frame. Reference character AA indicates that gray scale is displayed using two gray-level-48 luminance blocks (luminance blocks with the largest luminance weight) (D1 and D2), and BB indicates that gray scale is displayed using three gray-level-48 luminance blocks (D1, D2, and D3). More specifically, 159-AA indicates a pixel that displays gray-scale level 159 by using two gray-level-48 luminance blocks, and 160-BB represents a pixel that displays gray-scale level 160 by using three gray-level-48 luminance blocks.

The halftone display method (motion compensation equalizing pulse method) explained with reference to FIGS. 15 to 18B achieves the reduction of false contours by comparing the luminance levels of pixels between two successive frames and by superimposing a weighted equalizing pulse on any pixel whose bit state has changed. This prior art halftone display method is effective when the gray-scale level increases or decreases smoothly, but has not been effective when the gray-scale level changes finely.

More specifically, when there is only one pixel of gray-scale level 160 among pixels of gray-scale level 159, as shown in FIG. 20, and when the image moves from right to left at a speed of three pixels per frame, for example, the pixel e changes from gray-scale level 160 to gray-scale level 159 while the pixel b changes from gray-scale level 159 to gray-scale level 160.

Here, the gray-scale level 159 can theoretically be displayed by the subframes SF0 to SF5 plus two of the gray-level-48 subframes (two of SF6 to SF9; for example, SF6 and SF7 (D1 and D2)) (1+2+4+8+16+32+48+48=159), but it can also be displayed by the subframes SF0 to SF4 plus three of the gray-level-48 subframes (three of SF6 to SF9; for example, SF6, SF7, and SF8 (D1, D2, and D3)) (1+2+4+8+48+48+48=159). That is, in the case of the gray-scale level 159, by using two or three luminance blocks having the largest luminance weight (gray-scale level 48), one gray scale image can be displayed using one of two possible combinations of subframes (there are two possible combinations for the selectable number of luminance blocks having the largest luminance weight). If we consider all the four luminance blocks D1 to D4 (SF6 to SF9) having the largest luminance weight, there are 10 possible combinations.

On the other hand, the gray-scale level 160 can be displayed by the subframes SF1 to SF4 plus three of the gray-level-48 subframes (three of SF6 to SF9; for example, SF6, SF7, and SF8 (D1, D2, and D3)) (16+48+48+48=160). That is, the gray-scale level 160 necessarily requires the use of three of the luminance blocks having the largest luminance weight, and the number of possible combinations of luminance blocks is limited to one.

However, in the prior art, when displaying the gray-scale level 159, for example, it has been practiced to select the least number (two) of luminance blocks from among the luminance blocks having the largest luminance weight (gray-scale level 48), and it totally lacked the idea of making effective use of theoretically available two possible combinations (there are two possible combinations for the selectable number of luminance blocks having the largest luminance weight).

More specifically, in the prior art, the desired gray scale has been displayed, for example, by applying a positive equalizing pulse to the pixel b because in that pixel one luminance block (D) of gray-scale level 48 changes state from OFF to ON and by applying a negative equalizing pulse to the pixel e because in that pixel one luminance block (D) of gray-scale level 48 changes state from ON to OFF, as shown in FIG. 20. If the gray-scale level change is smooth, that is, if the pitch (number of pixels) over which the same luminance block having the largest weight changes is greater than the image moving distance per frame, then correct motion compensation is possible since the number of pixels to which equalizing pulses are applied is equal to the moving speed. However, in the case of a fine pattern such as shown in FIG. 20, it is difficult to detect the correct speed, and the moving speed may be detected, for example, as being one pixel per frame, resulting in an inability to reduce the disturbances sufficiently.

In view of the above-described problem with the prior art halftone displaying technique, it is an object of the present invention to provide a halftone display method and display apparatus which, when using an activation sequence having redundancy that enables one gray-scale level to be displayed by any one of a plurality of combinations of subframes (luminance blocks), can reduce the occurrence of moving-image false contours (false color contours) in video by actively utilizing the redundancy.

According to a first mode of the present invention, there is provided a halftone display method which predefines a plurality of luminance blocks in each frame or field to display an image, and which is capable of displaying one gray-scale level by any one of a plurality of combinations of luminance blocks, wherein when determining luminance blocks for use to display gray scale of an arbitrary first pixel, the luminance blocks to be used for the first pixel are selected in accordance with a predetermined rule, based on how the luminance blocks are used for a second pixel located in close proximity to the first pixel.

According to a second mode of the present invention, there is provided a display apparatus which predefines a plurality of luminance blocks in each frame or field to display an image, and which is capable of displaying one gray-scale level by any one of a plurality of combinations of luminance blocks, comprising: an image display; driving means for driving the image display; control means for controlling the driving means; and luminance block selection and luminance adjusting luminance block insertion means for selecting luminance blocks, and for inserting a luminance adjusting luminance block into a source signal, and wherein: when determining luminance blocks for use to display gray scale of an arbitrary first pixel, the luminance block selection and luminance adjusting luminance block insertion means selects the luminance blocks to be used for the first pixel in accordance with a predetermined rule, based on how the luminance blocks are used for a second pixel located in close proximity to the first pixel.

The present invention preadjusts the selection of luminance blocks so that the motion compensation equalizing pulse method can be effectively applied to fine patterns as well, and the present invention is applied to a method and to an apparatus that use an activation sequence having redundancy that enables one gray scale level to be displayed by any one of a plurality of possible combinations of luminance blocks. That is, the invention is applied to a halftone display method and display apparatus that use an activation sequence in which one frame (one field) consists of a plurality of luminance blocks of which two or more luminance blocks are assigned large luminance weights (the largest luminance weight).

More specifically, the invention is applied to a halftone display method and display apparatus that use an activation sequence, such as that shown in FIG. 19, in which one frame consists of 10 (N=0 to 9: SF0 to SF9) luminance blocks of which four luminance blocks (SF6 to SF9: gray scale bit data b6 to b9) are assigned the largest luminance weight. In this activation sequence, the gray-scale levels of the luminance blocks (SF0 to SF9) are 1 (SF0), 2 (SF1), 4 (SF2), 8 (SF3), 16 (SF4), 32 (SF5), 48 (SF6: D1), 48 (SF7: D2), 48 (SF8: D3), and 48 (SF9: D4).

For the activation sequence shown in FIG. 19, the gray-scale level L (luminance level 0 to 255) of pixel A (first pixel) or pixel B (second pixel) is divided into nine groups, as shown in Table 1 below.

TABLE 1

| LUMINANCE | GROUP | NUMBER OF LUMINANCE BLOCKS (D1 TO D4) USED BY PIXEL A | |
|---|---|---|---|
| LEVEL OF PIXEL A OR B [L] | NUMBER OF PIXEL A OR B [G] | FIRST DESCRIPTION | SECOND DESCRIPTION |
| 0–47 | 1 | 0 | 0 |
| 48–63 | 2 | 0 | 1 |
| 64–95 | 3 | 1 | 1 |

TABLE 1-continued

| LUMINANCE | GROUP | NUMBER OF LUMINANCE BLOCKS (D1 TO D4) USED BY PIXEL A | |
|---|---|---|---|
| LEVEL OF PIXEL A OR B [L] | NUMBER OF PIXEL A OR B [G] | FIRST DESCRIPTION | SECOND DESCRIPTION |
| 96–111 | 4 | 1 | 2 |
| 112–143 | 5 | 2 | 2 |
| 144–159 | 6 | 2 | 3 |
| 160–191 | 7 | 3 | 3 |
| 192–207 | 8 | 3 | 4 |
| 208–255 | 9 | 4 | 4 |

As shown in Table 1, the gray-scale level (L) is divided into nine groups: group 1 (G=1) of L=0 to 47; group 2 (G=2) of L=48 to 63; group 3 (G=3) of L=64 to 95; group 4 (G=4) of L=96 to 111; group 5 (G=5) of L 112 to 143; group 6 (G=6) of L=144 to 159; group 7 (G=7) of L=160 to 191; group 8 (G=8) of L=192 to 207; and group 9 (G=9) of L=208 to 255.

For groups 2, 4, 6, and 8 (group number G=2, 4, 6, and 8), there are two possible descriptions for gray-scale level 48, the first description using gray scale bit data b4 (SF4: gray-scale level 16) and gray scale bit data b5 (SF5: gray-scale level 32) and the second description using one gray-level-48 luminance block D (one of gray scale bit data b6 to b9 (SF6 to SF9 or D1 to D4)).

The present invention uses the following procedure for the selection (combination) of luminance blocks having the largest luminance weight (gray-level-48 luminance blocks D: D1, D2, D3, and D4). In the following description, an attention pixel (first pixel) is denoted as pixel A, a pixel (second pixel) neighboring the pixel A is denoted as pixel B, and the group numbers (G) of the pixels A and B are designated as GA and GB, respectively.

First, the group number GA of the pixel A is determined in accordance with Table 1. Next, to determine the number of luminance blocks D (gray-level-48 luminance blocks D1 to D4 having the largest luminance weight) to be used by the pixel A, the group number GA of the pixel A is compared with the group number GB of the pixel B neighboring on the left. Then, the number of luminance blocks D (gray-level-48 luminance blocks having the largest luminance weight) to be selected (arranged) for the pixel A is determined based on the result of the comparison between the group number GA of the pixel A and the group number GB of the pixel B neighboring on the left.

In a specific example, when the pixels A and B both belong to group 4 (GA=GB=4), and when the pixel B neighboring on the left is displayed using the first description in Table 1 (using one luminance block D), the pixel A also displays a gray-scale level using the first description that uses one luminance block D.

When the group number GB of the pixel B neighboring on the left is smaller than the group number GA of the pixel A (GB<GA), or more specifically, when the group number of the pixel B neighboring on the left is 3 (GB=3) and the group number of the pixel A is 4 (GA=4), for example, the gray-scale level of the pixel A is produced using the same number of luminance blocks D (one luminance block) as defined by the first description in Table 1.

On the other hand, when the group number GB of the pixel B neighboring on the left is larger than the group number GA of the pixel A (GB>GA), for example, when the group number of the pixel B neighboring on the left is 5 (GB=5) and the group number of the pixel A is 4 (GA=4), the gray-scale level of the pixel A is produced using the same number of luminance blocks D (two luminance blocks) as defined by the second description in Table 1.

To summarize the above procedure, the number of luminance blocks D with the largest luminance weight to be used to display the gray-scale level of an arbitrary pixel A is determined in such a manner that:

when GA<GB, the number as defined by the first description is selected, when GA<GB, the number as defined by the same description as used for pixel B neighboring on the left is selected, and when GA<GB, the number as defined by the second description is selected.

Here, if the pixel A is located at the leftmost position in an image, the pixel B neighboring on the left does not actually exist; in that case, the group number of the pixel B is assumed to be 0 and the number of luminance blocks D used is also assumed to be 0. Alternatively, if the pixel A (first pixel) is located at the upper left corner of the image, for example, its group number may be compared with the group number of the pixel located at the same position in the preceding frame, and if the pixel A is at the leftmost position other than the upper left corner, its group number may be compared with the group number of a pixel located above it. Further, when the pixel B (second pixel) does not exist on the display screen, the group number of the pixel B may be assumed to be any arbitrary number (for example, 9) without limiting it to 0. Moreover, the luminance blocks (gray-scale levels) D to be selected need not necessarily be limited to those having the largest luminance weight, but those with the second largest luminance weight in the activation sequence may be selected, provided that there is more than one luminance block having the second largest luminance weight, and that there is more than one description selectable for displaying one gray-scale level.

Next, which of the gray-level-48 luminance blocks D1 to D4 having the largest luminance weight is to be used is determined in accordance with Table 2 below. In Table 2, "0" indicates an OFF state, and "1" an ON state. For example, the arrangement (setting) of the four luminance blocks D1 to D4 expressed by (D1, D2, D3, D4)=(0101) means that two of the gray-level-48 luminance blocks D having the largest luminance weight are turned on; in this case, the luminance blocks D2 and D4 are turned on, and the luminance blocks D1 and D3 are turned off.

TABLE 2

| ARRANGEMENT OF (D1, D2, D3, D4) | ARRANGEMENT OF (D1, D2, D3, D4) USED BY PIXEL A | | | | |
|---|---|---|---|---|---|
| USED BY PIXEL B | D:0 | D:1 | D:2 | D:3 | D:4 |
| 0000 | 0000 | 1000 | 1100 | 1110 | 1111 |
| 0001 | 0000 | 0001 | 1001 | 1101 | 1111 |
| 0010 | 0000 | 0010 | 1010 | 1110 | 1111 |
| 0011 | 0000 | 0001 | 0011 | 1011 | 1111 |
| 0100 | 0000 | 0100 | 1100 | 1110 | 1111 |
| 0101 | 0000 | 0001 | 0101 | 1101 | 1111 |
| 0110 | 0000 | 0010 | 0110 | 1110 | 1111 |
| 0111 | 0000 | 0001 | 0011 | 0111 | 1111 |

TABLE 2-continued

| ARRANGEMENT OF (D1, D2, D3, D4) | ARRANGEMENT OF (D1, D2, D3, D4) USED BY PIXEL A | | | | |
|---|---|---|---|---|---|
| USED BY PIXEL B | D:0 | D:1 | D:2 | D:3 | D:4 |
| 1000 | 0000 | 1000 | 1100 | 1110 | 1111 |
| 1001 | 0000 | 0001 | 1001 | 1101 | 1111 |
| 1010 | 0000 | 0010 | 1010 | 1110 | 1111 |
| 1011 | 0000 | 0001 | 0011 | 1011 | 1111 |
| 1100 | 0000 | 0100 | 1100 | 1110 | 1111 |
| 1101 | 0000 | 0001 | 0101 | 1101 | 1111 |
| 1110 | 0000 | 0010 | 0110 | 1110 | 1111 |
| 1111 | 0000 | 0010 | 0011 | 0111 | 1111 |

As shown in Table 2, when the arrangement of luminance blocks D used for displaying the gray-scale level of the pixel B neighboring on the left of the pixel A is (0000), for example, if the number of luminance blocks D to be used to display the gray-scale level of the pixel A is 2, then the arrangement of luminance blocks D for the pixel A is (D1, D2, D3, D4)=(1100). When the arrangement of luminance blocks D used for displaying the gray-scale level of the pixel B neighboring on the left is (0111), for example, if the number of luminance blocks D to be used to display the gray-scale level of the pixel A is 3, then the arrangement of luminance blocks D for the pixel A is (D1, D2, D3, D4)=(0111). Further, when the arrangement of luminance blocks D used for displaying the gray-scale level of the pixel B neighboring on the left is (1011), for example, if the number of luminance blocks D to be used to display the gray-scale level of the pixel A is 2, the arrangement of luminance blocks D for the pixel A is (D1, D2, D3, D4)=(0011). That is, the arrangement of luminance blocks D used for displaying the gray-scale level of the pixel A is determined in such a manner as to minimize the change from the arrangement of luminance blocks D used for displaying the gray-scale level of the pixel B neighboring on the left.

Consider, for example, the case where the arrangement of luminance blocks D used for displaying the gray-scale level of the pixel B neighboring on the left is (1011) and the number of luminance blocks D to be used to display the gray-scale level of the pixel A is 2. In this case, instead of selecting (D1, D2, D3, D4)=(0011) as the arrangement of luminance blocks D for the pixel A, it is also possible to select (D1, D2, D3, D4)=(1001) or (D1, D2, D3, D4)=(1010) so that the least number of luminance blocks D (in this example, only one block) change state.

With the above procedure, the activation pattern of every pixel on the display screen is determined. In this way, according to the present invention, when using an activation sequence having redundancy that enables one gray-scale level to be displayed by any one of a plurality of combinations of luminance blocks, the occurrence of moving-image contours (false color contours) in video can be minimized by actively utilizing the redundancy, and the motion compensation equalizing pulse method proposed, for example, in Japanese Unexamined Patent Publication (Kokai) No. 10-133623 can be effectively applied to improve the image display quality.

Referring now to the accompanying drawings, embodiments of the halftone display method and display apparatus according to the present invention will be described in detail below.

First, one example of a display apparatus implementing the halftone display method according to the present invention will be described with reference to FIG. 21.

Figure 21:
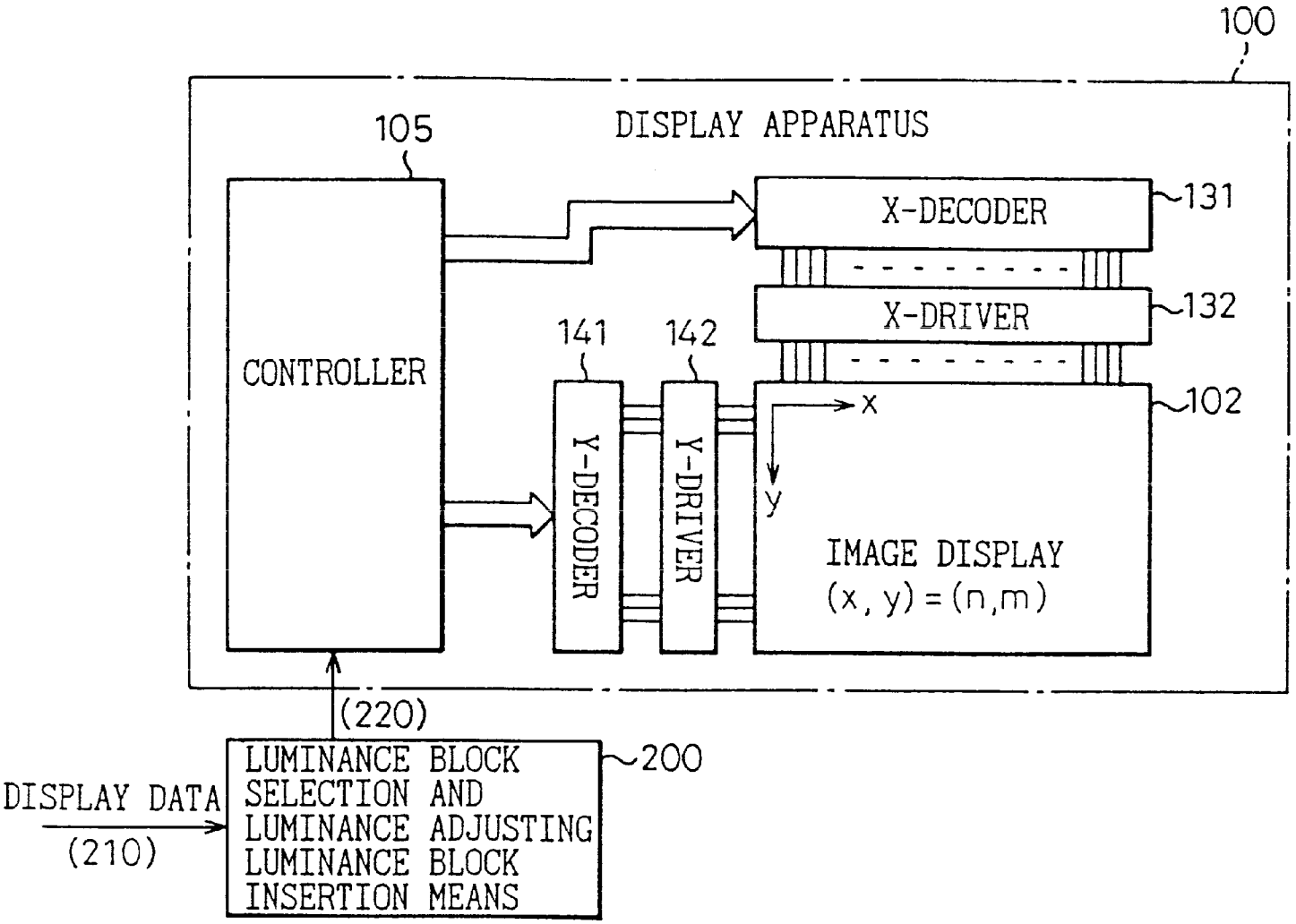
FIG. 21 is a diagram schematically showing one example of a display apparatus to which the present invention is applied.

FIG. 21 is a block diagram showing one example of the display apparatus implementing the halftone display method according to the present invention. In FIG. 21, reference numeral 100 is the display apparatus, and 200 is a luminance block selection and luminance adjusting luminance block insertion means. Here, reference numeral 210 indicates a source signal (display data), and 220 the signal after insertion of a luminance adjusting luminance block.

As shown in FIG. 21, the display apparatus 100 comprises an image display (display panel) 102, an X-decoder 131, X-driver 132, Y-decoder 141, and Y-driver 142 for driving the image display 102, and a controller 5 for controlling the X-driver 132 and Y-driver 142 for driving. The image display 102 has an array of pixels arranged as an n×m matrix with n rows and m pixels in each row.

One frame of an image is displayed on the image display 102 by varying the gray-scale level using a plurality of subframes (luminance blocks), as shown in FIG. 19, and each of the plurality of subframes consists, for example, of an addressing period and a sustained discharge period. It will be noted here that the present invention is applicable not only to gas discharge display panels such as plasma displays, but also to various other display devices, such as the Digital Micromirror Device (DMD) and EL panels, that display halftone gray scale images by using an intraframe or intrafield time-division method.

More specifically, the display apparatus 100 of FIG. 21 can use any kind of panel as long as the panel is constructed to display gray scale images using subframes; the point of the present invention is to supply the display data (source signal 210) to the display apparatus 100 via the luminance block selection and luminance adjusting luminance block insertion means 200. The luminance block selection and luminance adjusting luminance block insertion means 200 is configured to select an appropriate number of luminance blocks D from among the plurality of luminance blocks D1 to D4 having the largest luminance weight, and also to output the signal 220 with a luminance adjusting luminance block (equalizing pulse: subframe) added to or subtracted from the source signal, depending on the presence or absence of a change in the source signal 210 from one frame (field) to the next.

The halftone display method and the display apparatus of the present invention assume the use of an activation sequence, such as previously shown in FIG. 19, in which more than one luminance block is assigned a large luminance weight (for example, the largest luminance weight), and which has redundancy that enables one gray scale level to be displayed by any one of a plurality of combinations of subframes (luminance blocks). Prior to assigning a weight to each equalizing pulse so that the change of the emission intensity pattern with changing position, visually perceived with respect to the motion of the display image, becomes uniform, while maintaining constant the total amount of the equalizing pulses applied, for example, to discharge cells of the plasma display panel (PDP), the present invention actively utilizes the redundancy built in the activation sequence and controls the combinations of luminance blocks, thereby reducing the occurrence of moving-image false contours (false color contours) in video and achieving a further enhancement of display image quality.

In the present invention, one or the other of the two activation patterns (the first description or the second description) in Table 1 is selected according to the activation pattern of the pixel neighboring on the left so that motion compensation equalizing pulses can be applied correctly.

Figure 22:
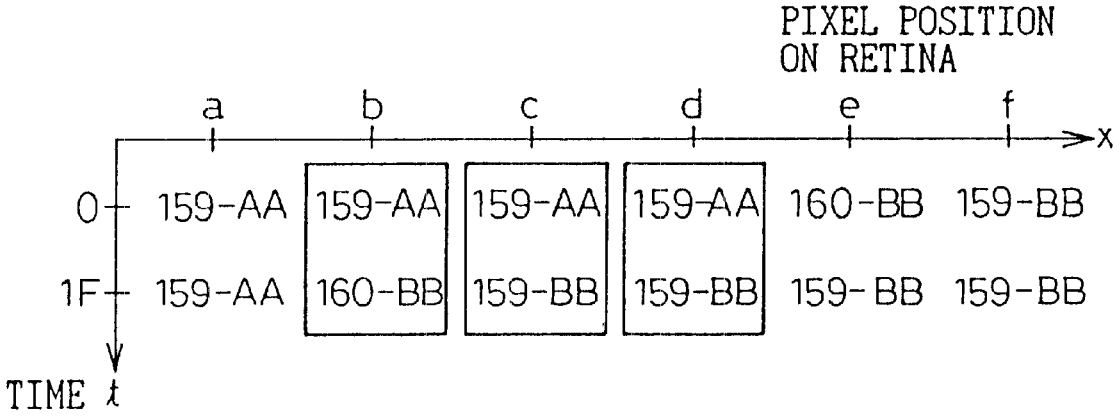
FIG. 22 is a diagram for explaining the basic principle of the halftone display method according to the present invention.

FIG. 22 is a diagram for explaining the basic principle of the halftone display method according to the present invention; this figure corresponds to FIG. 20 previously given.

In FIG. 22, the horizontal axis represents the position coordinates x fixed on the retina, and the vertical axis shows time t. Here, 0 and 1F plotted along the vertical axis t indicate an image (0) in a frame (field) at a given time and an image (1F) in the next frame. Reference character AA indicates that gray scale is displayed using two gray-level-48 luminance blocks (luminance blocks with the largest luminance weight) (for example, D1 and D2), and BB indicates that gray scale is displayed using three gray-level-48 luminance blocks (for example, D1, D2, and D3). More specifically, 159-AA indicates a pixel that displays gray-scale level 159 by using two gray-level-48 luminance blocks, 159-BB indicates a pixel that displays gray-scale level 159 by using three gray-level-48 luminance blocks, and 160-BB represents a pixel that displays gray-scale level 160 by using three gray-level-48 luminance blocks.

As shown in FIG. 22, in the image frame at a given time (time 0), the pixels a, b, c, and d display gray scale by using (turning on) two of the luminance blocks D (the luminance blocks having the largest luminance weight), and the pixel e displays gray scale by using three luminance blocks D. In this case, the pixel f and successive pixels to the right thereof display gray scale by using three luminance blocks D, the same number of luminance blocks D used by the pixel neighboring on the left. That is, in Table 1, the group numbers of the pixels d, e, and f are Gd=6, Ge=7, and Gf=6, and the comparison of the group numbers shows Gd<Ge and Ge>Gf. Accordingly, the pixel e is displayed by using the first description (160-BB), and the pixel f by using the second description (159-BB). As for the pixels a, b, c, and d, their group numbers Ga, Gb, Gc, and Gd are 6, and hence, G0(0)<Ga, Ga=Gb, Gb=Gc, and Gc=Gd, so that the pixel a is displayed by using the first description (159-AA) and the pixels b, c, and d by using the same description (the first description: 159-AA) as that used for the respective pixels (a, b, c) neighboring on the left. Here, the pixel (0) neighboring on the left of the pixel a (the leftmost pixel) does not actually exist, but as previously described, the group number G0 of the pixel 0 is assumed to be 0.

In the next image frame (1F), assuming that the image moves from right to left at a speed of three pixels per frame, the number of luminance blocks D increases by one for each of the three pixels b, c, and d. That is, in Table 1, the group numbers of the pixels a, b, and c are Ga=6, Gb=7, and Gc=6, and the comparison of the group numbers shows G0(0)<Ga, Ga<Gb, and Gb>Gc. Accordingly, the pixel a is displayed by using the first description (159-AA), and the pixel b also by using the first description (160-BB), while the pixel c is displayed by using the second description (159-BB). As for the pixels c, d, e, and f, their group numbers Gc, Gd, Ge, and Gf are 6, and hence, Gc=Gd, Gd=Ge, and Ge=Gf, so that the pixels d, e, and f are displayed by using the same description (the second description: 159-BB) as that used for the respective pixels (c, d, e) neighboring on the left. Accordingly, from the number of contiguous pixels that have undergone the same change in the number of luminance blocks D used, the image moving speed can be correctly detected as three pixels per frame. By applying the motion compensation equalizing pulse method, proposed, for example, in Japanese Unexamined Patent Publication (Kokai) No. 10-133623, to these three pixels, moving-image false contours can be reduced to improve the image display quality.

Next, a description will be given of how the equalizing pulses (motion compensation equalizing pulses) are applied. The present invention not only displays the gray scale of each pixel by performing the above-described processing, but also applies motion compensation using the equalizing pulses by creating a lookup table as described below for the plurality (four) of luminance blocks D (D1 to D4) having the largest luminance weight.

Figure 23:
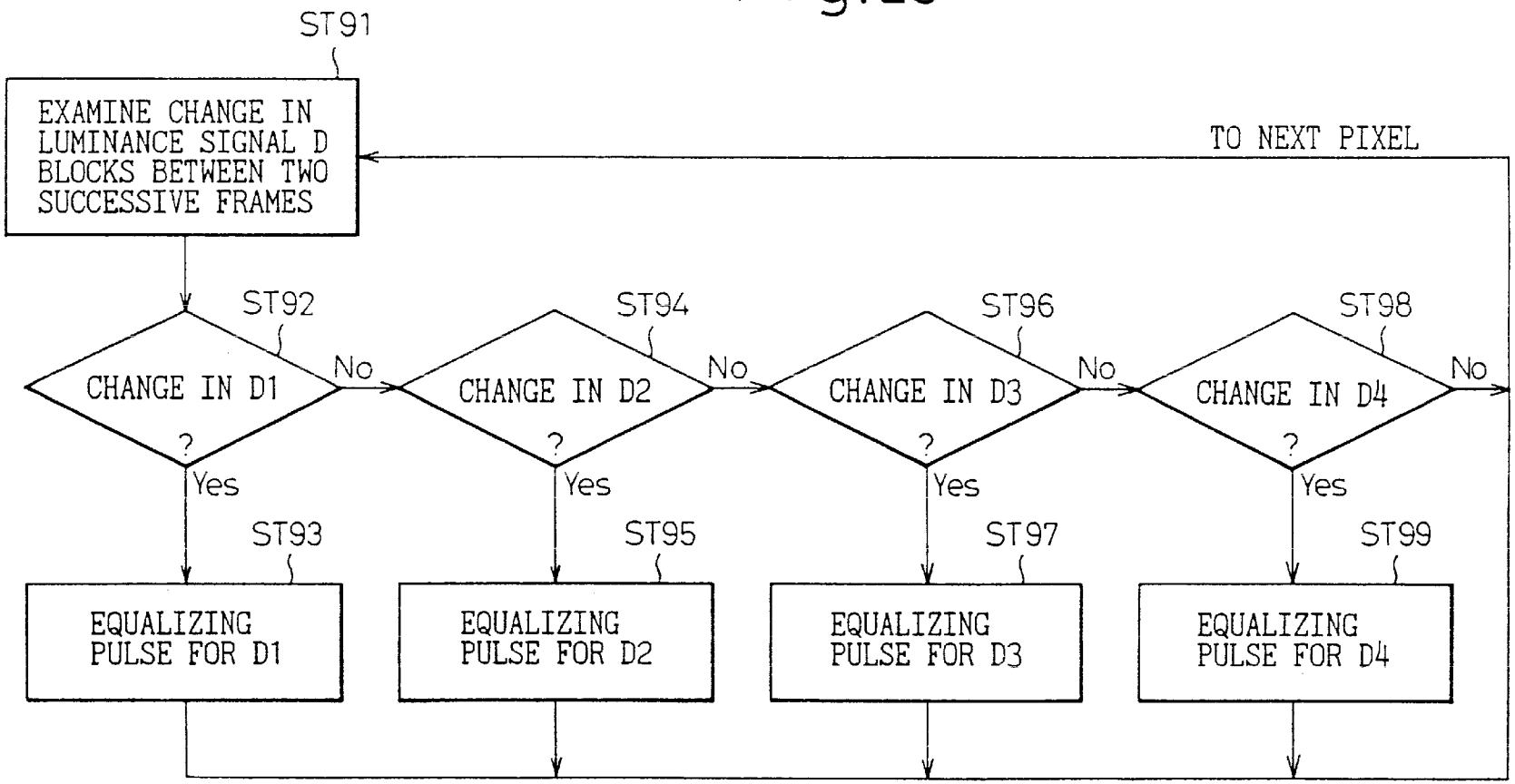
FIG. 23 is a flowchart showing in schematic form the halftone display method according to the present invention.

FIG. 23 is a flowchart showing, in schematic form, the halftone display method according to the present invention, illustrating how the equalizing pulses are applied when a change occurs in the luminance blocks D (D1 to D4).

As shown in the flowchart of FIG. 23, the motion compensation equalizing pulse insertion process (addition/subtraction process) starts with step ST91 where luminance signal D blocks, that is, the luminance blocks D (D1 to D4) having the largest luminance weight and used to display the gray-scale level of a pixel, are checked for a change between successive two frames (fields), before proceeding to step ST92. In step ST92, it is determined whether the first luminance block D1 changes, and if it is determined that the luminance block D1 changes, the process proceeds to ST93; otherwise, the process proceeds to step ST94. In step ST94, similarly to step ST92, it is determined whether the second luminance block D2 changes, and if it is determined that the luminance block D2 changes, the process proceeds to ST95; otherwise, the process proceeds to step ST96.

Further, in step ST96, similarly to steps ST92 and ST94, it is determined whether the third luminance block D3 changes, and if it is determined that the luminance block D3 changes, the process proceeds to ST97; otherwise, the process proceeds to step ST98. In step ST98, similarly to step ST96, it is determined whether the fourth luminance block D4 changes, and if it is determined that the luminance block D4 changes, the process proceeds to ST99; otherwise, the process returns to step ST91 to repeat the processing of ST91 to ST99 on the next pixel.

In step ST93, insertion (addition/subtraction) of equalizing pulses is performed for the first luminance block D1 that changes between the two successive frames; in step ST95, insertion of equalizing pulses is performed for the second luminance block D2 that changes between the two successive frames; in step ST97, insertion of equalizing pulses is performed for the third luminance block D3 that changes between the two successive frames; and in step ST99, insertion of equalizing pulses is performed for the fourth luminance block D4 that changes between the two successive frames. After each processing step, the process returns to step ST91 to perform the processing of steps ST91 to ST99 on the next pixel.

Here, the equalizing pulses (motion compensation equalizing pulses) to be inserted when the luminance blocks D1 to D4 change are obtained from Tables 3 to 6 (lookup table) shown below.

TABLE 3

| CHANGE IN LUMINANCE BLOCK D | NUMBER OF CONTIGUOUS PIXELS EXHIBITING SAME CHANGE | SIZE OF LUMINANCE ADJUSTING LUMINANCE BLOCK |
|---|---|---|
| D1: 0 → 1 | 1 | 9 |
| | 2 | 19, 0 |
| | 3 | 29, 0, 0 |
| | 4 | 31, 7, 1, 0 |
| | 5 | 47, 1, 0, 0, 0 |
| | 6 | 47, 11, 0, 0, 0, 0 |
| | 7 | 47, 15, 6, 0, 0, 0, 0 |

TABLE 3-continued

| CHANGE IN LUMINANCE BLOCK D | NUMBER OF CONTIGUOUS PIXELS EXHIBITING SAME CHANGE | SIZE OF LUMINANCE ADJUSTING LUMINANCE BLOCK |
|---|---|---|
| | 8 | 47, 15, 15, 0, 0, 0, 0, 0 |
| | 9 | 47, 15, 15, 8, 0, 0, 0, 0, 0 |
| D2: 0 → 1 | 1 | 19 |
| | 2 | 31, 5 |
| | 3 | 47, 9, 0 |
| | 4 | 47, 27, 0, 0 |
| | 5 | 47, 47, 0, 0, 0 |
| | 6 | 47, 47, 15, 3, 0, 0 |
| | 7 | 47, 47, 23, 13, 0, 0, 0 |
| | 8 | 47, 47, 47, 7, 0, 0, 0, 0 |
| | 9 | 47, 47, 47, 15, 11, 0, 0, 0, 0 |

0 → 1 indicates that the state of D changes from OFF to ON between successive frames (fields).

TABLE 4

| CHANGE IN LUMINANCE BLOCK D | NUMBER OF CONTIGUOUS PIXELS EXHIBITING SAME CHANGE | SIZE OF LUMINANCE ADJUSTING LUMINANCE BLOCK |
|---|---|---|
| D3: 0 → 1 | 1 | 28 |
| | 2 | 47, 7 |
| | 3 | 47, 31, 4 |
| | 4 | 47, 47, 15, 0 |
| | 5 | 47, 47, 31, 13, 0 |
| | 6 | 47, 47, 47, 23, 0, 0 |
| | 7 | 47, 47, 47, 47, 5, 0, 0 |
| | 8 | 47, 47, 47, 47, 15, 15, 1, 0 |
| | 9 | 47, 47, 47, 47, 47, 11, 0, 0, 0 |
| D4: 0 → 1 | 1 | 37 |
| | 2 | 47, 25 |
| | 3 | 47, 47, 15 |
| | 4 | 47, 47, 47, 4 |
| | 5 | 47, 47, 47, 31, 10 |
| | 6 | 47, 47, 47, 47, 23, 6 |
| | 7 | 47, 47, 47, 47, 47, 15, 4 |
| | 8 | 47, 47, 47, 47, 47, 47, 7, 1 |
| | 9 | 47, 47, 47, 47, 47, 47, 23, 22, 0 |

0 → 1 indicates that the state of D changes from OFF to ON between successive frames (fields).

TABLE 5

| CHANGE IN LUMINANCE BLOCK D | NUMBER OF CONTIGUOUS PIXELS EXHIBITING SAME CHANGE | SIZE OF LUMINANCE ADJUSTING LUMINANCE BLOCK |
|---|---|---|
| D1: 1 → 0 | 1 | −9 |
| | 2 | −19, 0 |
| | 3 | −29, 0, 0 |
| | 4 | −31, −7, −1, 0 |
| | 5 | −47, −1, 0, 0, 0 |
| | 6 | −47, −11, 0, 0, 0, 0 |
| | 7 | −47, −15, −6, 0, 0, 0, 0 |
| | 8 | −47, −15, −15, 0, 0, 0, 0, 0 |
| | 9 | −47, −15, −15, −8, 0, 0, 0, 0, 0 |
| D2: 1 → 0 | 1 | −19 |
| | 2 | −31, −5 |

TABLE 5-continued

| CHANGE IN LUMINANCE BLOCK D | NUMBER OF CONTIGUOUS PIXELS EXHIBITING SAME CHANGE | SIZE OF LUMINANCE ADJUSTING LUMINANCE BLOCK |
|---|---|---|
| | 3 | −47, −9, 0 |
| | 4 | -47, -27, 0, 0 |
| | 5 | −47, −47, 0, 0, 0 |
| | 6 | −47, −47, −15, −3, 0, 0 |
| | 7 | −47, −47, −23, −13, 0, 0, 0 |
| | 8 | −47, −47, −47, −7, 0, 0, 0, 0 |
| | 9 | −47, −47, −47, −15, −11, 0, 0, 0, 0 |

1 → 0 indicates that the state of D changes from ON to OFF between successive frames (fields).

TABLE 6

| CHANGE IN LUMINANCE BLOCK D | NUMBER OF CONTIGUOUS PIXELS EXHIBITING SAME CHANGE | SIZE OF LUMINANCE ADJUSTING LUMINANCE BLOCK |
|---|---|---|
| D3: 1 → 0 | 1 | −28 |
| | 2 | −47, −7 |
| | 3 | −47, −31, −4 |
| | 4 | −47, −47, −15, 0 |
| | 5 | −47, −47, −31, −13, 0 |
| | 6 | −47, −47, −47, −23, 0, 0 |
| | 7 | −47, −47, −47, −47, −5, 0, 0 |
| | 8 | −47, −47, −47, −47, −15, −15, −1, 0 |
| | 9 | −47, −47, −47, −47, −47, −11, 0, 0, 0 |
| D4: 1 → 0 | 1 | −37 |
| | 2 | -47, -25 |
| | 3 | −47, −47, −15 |
| | 4 | −47, −47, −47, −4 |
| | 5 | −47, −47, −47, −31, −10 |
| | 6 | −47, −47, −47, −47, −23, −6 |
| | 7 | −47, −47, −47, −47, −47, −15, −4 |
| | 8 | −47, −47, −47, −47, −47, −47, −7, −1 |
| | 9 | −47, −47, −47, −47, −47, −47, −23, −22, 0 |

1 → 0 indicates that the state of D changes from ON to OFF between successive frames (fields).

In tables 3 to 6, "0" indicates that the luminance block D (D1 to D4) is OFF, and "1" indicates that the luminance block D is ON. Accordingly, D1: 0→1 means that, of the luminance blocks D having the largest luminance weight, the first luminance block D1 changes from OFF to ON, and in accordance with the number of continuous pixels exhibiting the same change at this time, luminance adjusting luminance blocks (equalizing pulses) are inserted in (added to or subtracted from) the respective pixels. Likewise, D2: 1→0 means that, of the luminance blocks D having the largest luminance weight, the second luminance block D2 changes from ON to OFF, and in accordance with the number of contiguous pixels exhibiting the same change at this time, luminance adjusting luminance blocks (equalizing pulses) are inserted in (added to or subtracted from) the respective pixels.

In a specific example, as shown in Table 3, when the first luminance block D1 changes from OFF to ON (D1: 0→1) between two successive frames (fields), if there are, for example, three contiguous pixels exhibiting the same change, and equalizing pulses of gray-scale levels 29, 0, and 0 are applied to (inserted in) the respective pixels. Likewise, as shown in Table 4, when the third luminance block D3 changes from OFF to ON (D3: 0→1) between two successive frames, if there are, for example, five contiguous pixels exhibiting the same change, and equalizing pulses of gray-scale levels 47, 47, 31, 13, and 0 are applied to the respective pixels.

Further, as shown in Table 5, when the second luminance block D2 changes from ON to OFF (D2: 1→0) between two successive frames, if there are, for example, four contiguous pixels exhibiting the same change, and equalizing pulses of gray-scale levels −47, −27, 0, and 0 are applied to the respective pixels. Likewise, as shown in Table 6, when the fourth luminance block D4 changes from ON to OFF (D4: 1→0) between two successive frames, if there are, for example, two contiguous pixels exhibiting the same change, and equalizing pulses of gray-scale levels −47 and −25 are applied to the respective pixels.

Figure 24A:
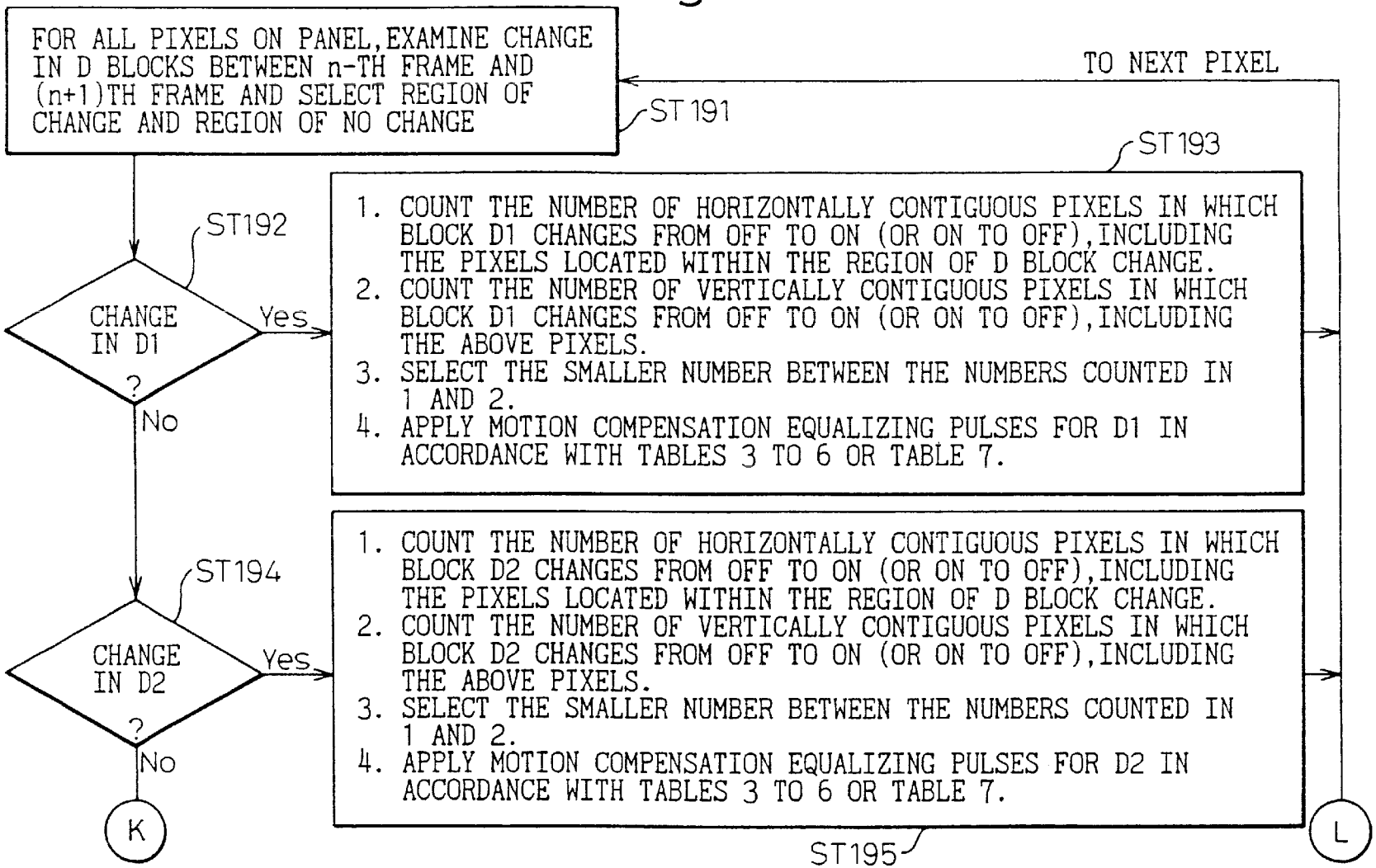
FIGS. 24A and 24B are flowcharts for explaining one example of the halftone display method according to the present invention.
Figure 24B:
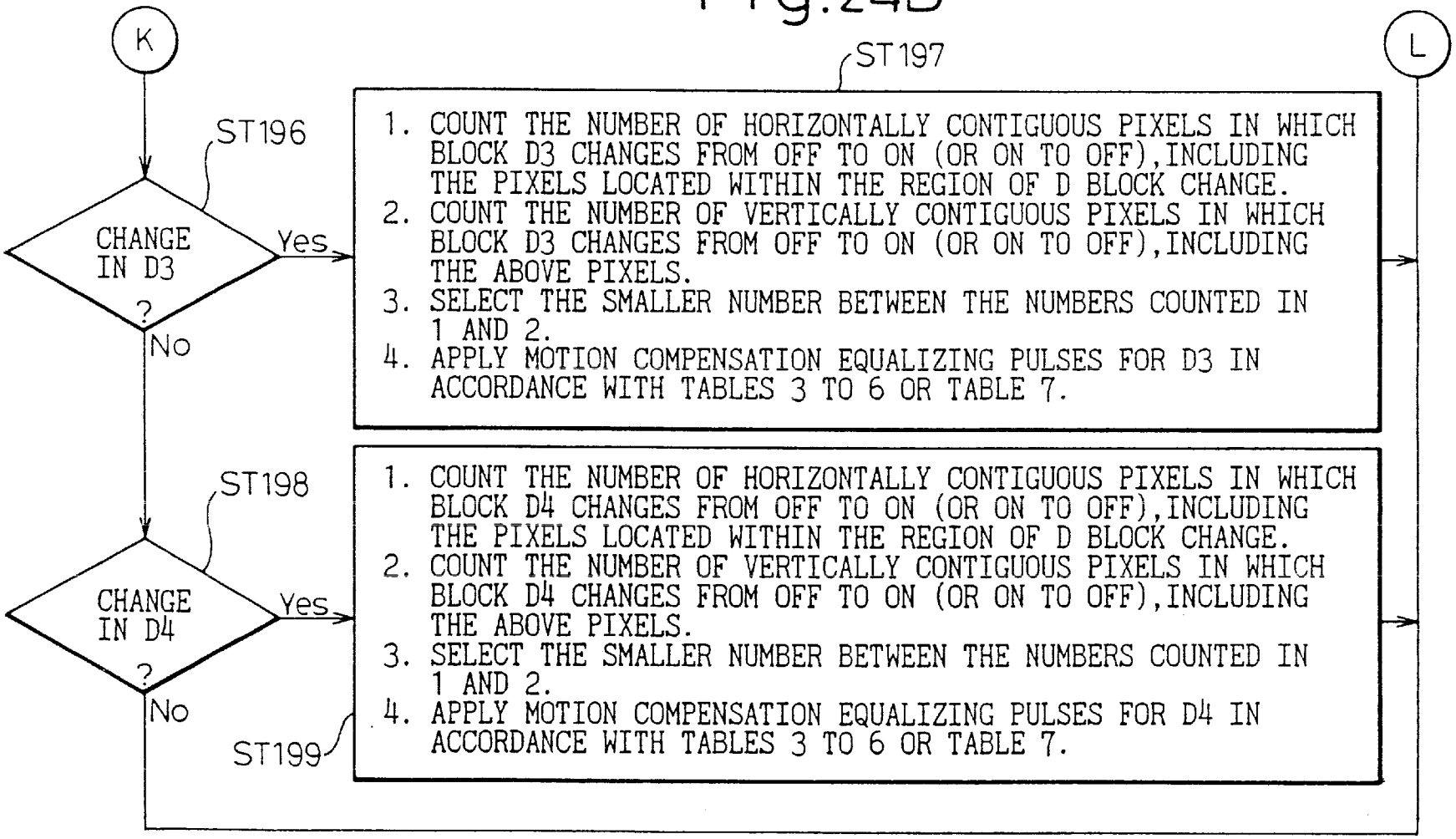

FIGS. 24A and 24B are flowcharts for explaining one example of the halftone display method according to the present invention, illustrating how the motion compensation equalizing pulses are applied in relation to movements in arbitrary directions. The steps ST191 to ST199 in FIG. 24A and 24B basically correspond to the steps ST91 to ST99 in FIG. 23 described earlier.

As shown in the flowcharts of FIGS. 24A and 24B, the motion compensation equalizing pulse insertion (addition/subtraction) process starts with step ST191 where all pixels on the panel are examined to check the states, in the n-th frame (field) and in the (n+1)th frame (field), of the luminance blocks D (D1 to D4) having the largest luminance weight, and to select a region where there is a change and a region where there is no change, after which the process proceeds to step ST192. In step ST192, it is determined whether, of the luminance blocks D having the largest luminance weight, the first luminance block D1 changes or not, and if it is determined that the luminance block D1 changes, the process proceeds to step ST193; otherwise, the process proceeds to step ST194.

In step ST194, similarly to step ST192, it is determined whether the second luminance block D2 changes or not, and if it is determined that the luminance block D2 changes, the process proceeds to step ST195; otherwise, the process proceeds to step STP196. In step ST196, similarly to steps ST192 and ST194, it is determined whether the third luminance block D3 changes or not, and if it is determined that the luminance block D3 changes, the process proceeds to step ST197; otherwise, the process proceeds to step STP198. In step ST198, similarly to step ST196, it is determined whether the fourth luminance block D4 changes or not, and if it is determined that the luminance block D4 changes, the process proceeds to step ST199; otherwise, the process returns to step STP191 to repeat the steps ST191 to ST199 on the next pixel.

In step ST193, insertion (addition/subtraction) of equalizing pulses is performed for the first luminance block D1 that changes between the two successive frames. First, in the region where the first luminance block D1 changes, the number of horizontally contiguous pixels in which D1 changes from 0 to 1 (from OFF to ON) or from 1 to 0 (from ON to OFF) is counted. Further, in the region where the first luminance block D1 changes, the number of vertically contiguous pixels in which D1 changes from 0 to 1 or from 1 to 0 is counted. Between the number of horizontally contiguous pixels and the number of vertical contiguous pixels in which D1 changes from 0 to 1 or 1 to 0, the smaller one (vertical or horizontal) is selected. Then, referring to Tables 3 to 6 previously given, or Table 7 hereinafter given, motion compensation equalizing pulses for the first luminance block D1 are applied (inserted).

In step ST195, the same processing as in ST193 is performed for the second luminance block D2, and motion compensation equalizing pulses for the second luminance block D2 are applied. Likewise, in step ST197, motion compensation equalizing pulses for the third luminance block D3 are applied, and in step ST199, motion compensation equalizing pulses for the fourth luminance block D4 are applied.

In this way, in the present embodiment, when an image moves in a certain direction, the number of contiguous pixels that undergo the same change in the luminance blocks D (D1 to D4) having the largest luminance weight is counted horizontally and vertically and, between the numbers counted horizontally and vertically, the smaller one (horizontal or vertical) is selected as representing the moving direction of the image. Then, for the thus determined moving direction of the image, the size of each motion compensation equalizing pulse is selected so that appropriately weighted equalizing pulses are superimposed on the source signal.

TABLE 7

| CHANGE IN LUMINANCE BLOCK D | NUMBER OF CONTIGUOUS PIXELS EXHIBITING SAME CHANGE | SIZE OF LUMINANCE ADJUSTING LUMINANCE BLOCK |
|---|---|---|
| D1: 0 → 1 | 1 | 12, -4 |
| | 2 | 31, −13, 0 |
| | 3 | 35, −3, −5, 0 |
| D2: 0 → 1 | 1 | 26, −9 |
| | 2 | 43, −8, 0 |
| | 3 | 47, 10, −4, 0 |
| D3: 0 → 1 | 1 | 32, −9 |
| | 2 | 47, 9, -4 |
| | 3 | 47, 42, −6, −3 |
| D4: 0 → 1 | 1 | 41, −7 |
| | 2 | 47, 32, −11 |
| | 3 | 47, 48, 15, −3 |
| D1: 1 → 0 | 1 | −7, −3 |
| | 2 | −1, −15, −3 |
| | 3 | 0, −3, −24, −2 |
| D2: 1 → 0 | 1 | −13, −5 |
| | 2 | 0, −32, −6 |
| | 3 | 0, −10, −40, −4 |
| D3: 1 → 0 | 1 | −23, −5 |
| | 2 | −11, −32, −5 |
| | 3 | −3, −31, −46, −1 |
| D4: 1 → 0 | 1 | −31, −3 |
| | 2 | −22, −43, −51 |
| | 3 | -14, -48, -50, 2 |

0 → 1 indicates that the state of D changes from OFF to ON between successive frames (fields).
1 → 0 indicates that the state of D changes from ON to OFF between successive frames (fields).

Tables 3 to 6 previously given showed one example of how equalizing pulses are inserted (added or subtracted) when there occurs a change in each of the luminance blocks D1 to D4. Table 7 given above shows another example, as contrasted with Tables 3 to 6.

That is, in Tables 3 to 6, for image moving speed v [pixels/frame], equalizing pulses were applied to v pixels. In contrast, in the example shown in Table 7, equalizing pulses are applied to (inserted in) v+1 pixels including the pixel neighboring on the right.

More specifically, as shown in Table 7, when the first luminance block D1 changes from OFF to ON (D1: 0–1) between two successive frames (fields), if the number of pixels exhibiting the same change is 1, for example, equalizing pulses of gray-scale levels 12 and −4 are applied to two pixels, that is, the designated one pixel and the pixel neighboring on the right, respectively. When the third luminance block D2 changes from OFF to ON (D3: 0→1) between two successive frames, if the number of pixels exhibiting the same change is 2, for example, equalizing pulses of gray-scale levels 47, 9, and −4 are applied to three pixels, that is, the designated two pixels and the pixel neighboring on the right, respectively. Further, when the fourth luminance block D4 changes from ON to OFF (D4: 1→0) between two successive frames, if the number of pixels exhibiting the same change is 3, for example, equalizing pulses of gray-scale levels −14, −48, −50, and 2 are applied to four pixels, that is, the designated three pixels and the pixel neighboring on the right, respectively.

Tables 3 to 6 and Table 7 respectively show examples of the motion compensation equalizing pulse insertion process, and it will be recognized that the present invention is not limited to the illustrated examples.

Figure 25A:
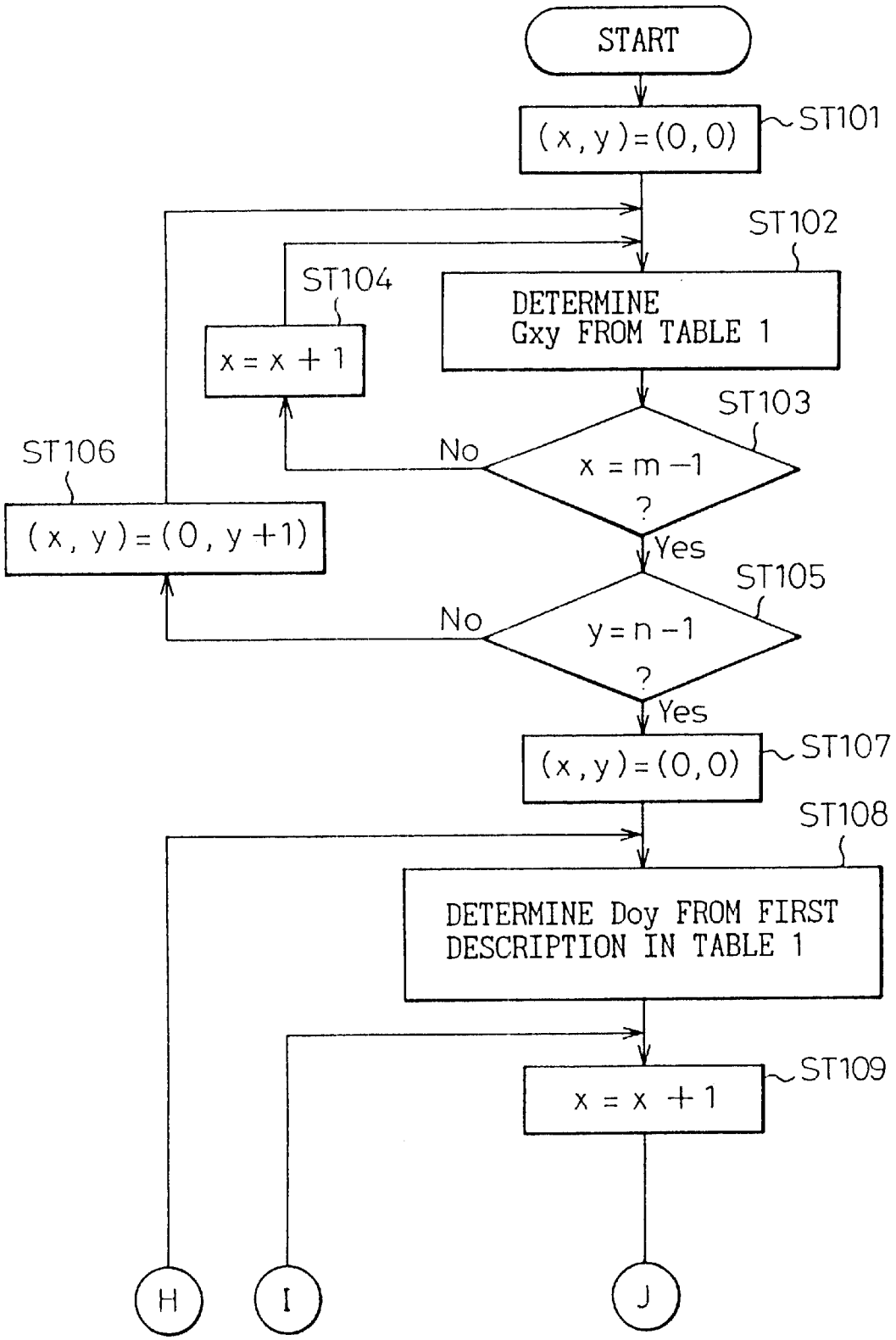
FIGS. 25A and 25B are flowcharts illustrating the operation of one example of the halftone display method according to the present invention.
Figure 25B:
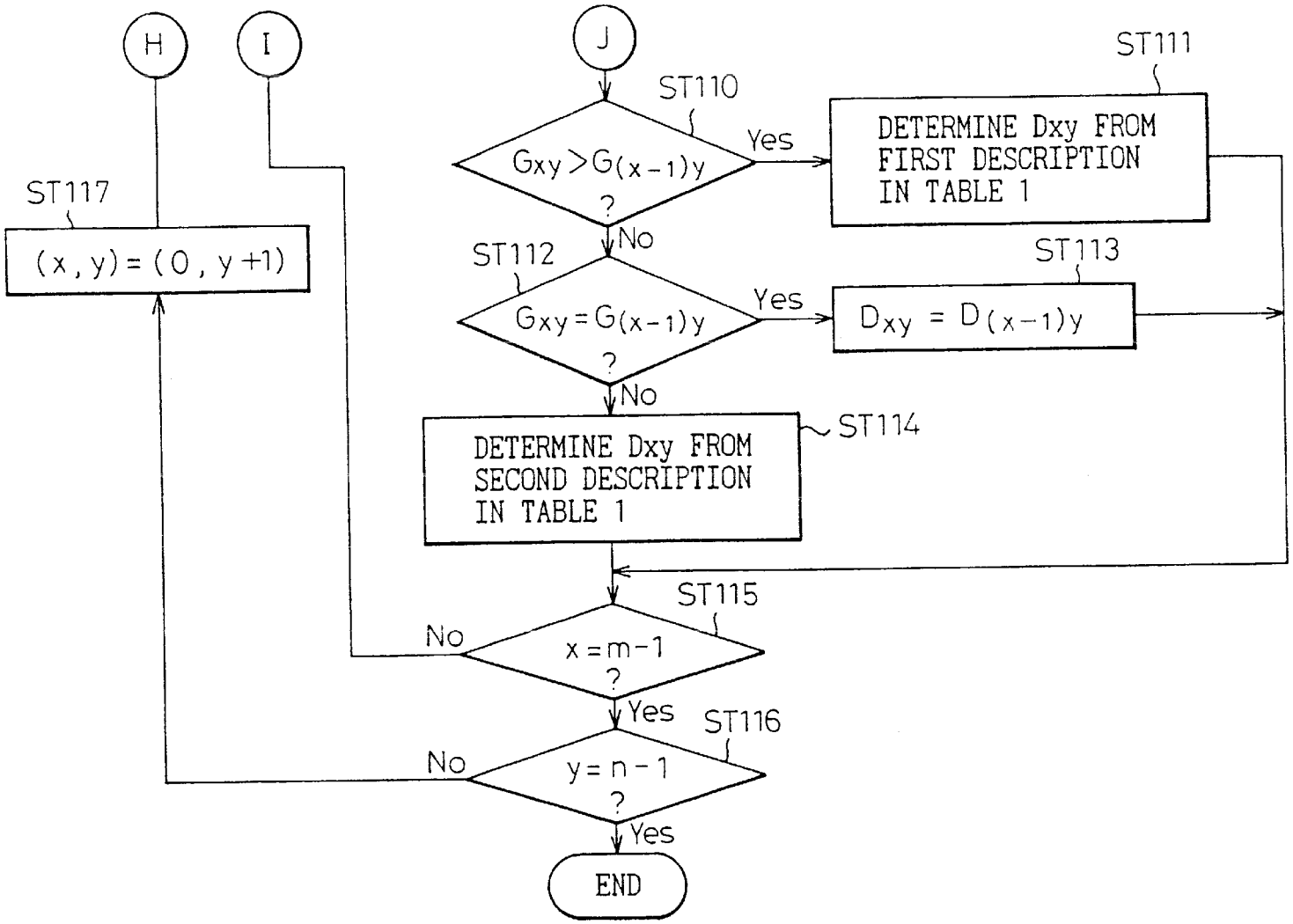

FIGS. 25A and 25B are flowcharts illustrating the operation of one example of the halftone display method according to the present invention.

As shown in FIGS. 25A and 25B, when the halftone display process is started, the pixel at coordinates (x, y)=(0, 0) is selected in step ST101, and the process proceeds to step ST102. Here, the displayed image (the image display 102) consists of an array of pixels arranged as an n×m matrix with n rows and m columns, that is, from (0, 0) to (n, m). The processing hereinafter is performed by assuming that there is a pixel of gray-scale level 0 neighboring on the left of each of the leftmost pixels (0, 0) to (0, m) in the displayed image.

In step ST102, group number $G_{xy}$ is determined in accordance with Table 1, before proceeding to step ST103. In step ST103, it is determined whether x=m−1 is satisfied or not, that is, whether or not x has reached the last pixel (m-th pixel) in the current row. If x=m−1, then the process proceeds to step ST105; otherwise, the process proceeds to step ST104. In step ST104, x+1 is substituted for x, and the process returns to step ST102 to determine the group number $G_{xy}$ of the next pixel in accordance with Table 1, after which the processing of steps ST102 to ST104 is repeated until x=m−1 is satisfied.

In step ST105, it is determined whether y=n−1 is satisfied or not, that is, whether or not y has reached the last row (the n-th row). If y=n−1, then the process proceeds to step ST107; otherwise, the process proceeds to step ST106. In step ST106, (0, y+1) is substituted for (x, y), and the process returns to step ST102 to determine the group number Gy of the first pixel in the next row in accordance with Table 1, after which the processing of steps ST102 to ST104 and ST106 is repeated until y=n−1 is satisfied. In this way, group numbers $G_{xy}$ are assigned to all the pixels.

In step ST107, (x, y) is cleared to (0, 0), and the process proceeds to step ST108 where the number, Doy, of luminance blocks D having the largest luminance weight is determined in accordance with the first description in Table 1. In step ST109, x+1 is substituted for x, and the process proceeds to step ST110. In step ST110, it is determined whether the group numbers of two adjacent pixels satisfy the relation $G_{xy}>G_{(x-1)y}$. If the relation $G_{xy}>G_{(x-1)y}$ is satisfied, that is, if the group number $G_{xy}$ of the pixel (x, y) is larger than the group number $G_{(x-1)y}$ of the pixel (x−1, y) neighboring on the left, the process proceeds to step ST111; otherwise, the process proceeds to step ST112.

In step ST111, the number, $D_{xy}$, of luminance blocks (D) having the largest luminance weight is determined in accordance with the first description in Table 1. That is, if the group number $G_{xy}$ of the pixel (x, y) is larger than the group number $G_{(x-1)y}$ of the pixel (x−1, y) neighboring on the left, the number, $D_{xy}$, of luminance blocks having the largest luminance weight, for the pixel (x, y), is determined in accordance with the first description in Table 1.

In step ST112, it is determined whether the group numbers of the two adjacent pixels satisfy the relation $G_{xy}=G_{(x-1)y}$. If the relation $G_{xy}=G_{(x-1)y}$ is satisfied, that is, if the group number $G_{xy}$ of the pixel (x, y) is the same as the group number $G_{(x-1)y}$ of the pixel (x−1, y) neighboring on the left, the process proceeds to step ST113; otherwise (if $G_{xy}<G_{(x-1)y}$), the process proceeds to step ST114.

In step ST113, $D_{xy}$ is set equal to $D_{(x-1)y}$, that is, the number, $D_{xy}$ of luminance blocks D having the largest luminance weight, for the pixel (x, y), is set equal to the number, $D_{(x-1)y}$, of luminance blocks D having the largest luminance weight used for the pixel (x−1, y). Accordingly, when the group number $G_{xy}$ of the pixel (x, y) is the same as the group number $G_{(x-1)y}$ of the pixel (x−1, y) neighboring on the left, the number, $D_{xy}$, of luminance blocks having the largest luminance weight, for the pixel (x, y), is determined in accordance with the first description in Table 1.

In step ST114, that is, if $G_{xy}<G_{(x-1)y}$, $D_{xy}$ is determined in accordance with the second description in Table 1. In this way, if the group number $G_{xy}$ of the pixel (x, y) is smaller than the group number $G_{(x-1)y}$ of the pixel (x−1, y) neighboring on the left, the number, $D_{xy}$, of luminance blocks having the largest luminance weight, for the pixel (x, y), is determined in accordance with the second description in Table 1.

After step ST111, ST113, or ST114, the process proceeds to ST115 where, as in step ST103, it is determined whether x=m−1 is satisfied or not, that is, whether or not x has reached the last pixel (the m-th pixel) in the current row. If x=m−1, the process proceeds to step ST116; otherwise, the process returns to step ST109, to repeat the processing of steps ST109 to ST114 until x=m−1 is satisfied.

In step ST116, it is determined whether y=n−1 is satisfied, that is, whether or not y has reached the last row (the n-th row). If y=n−1, the halftone display process is terminated; otherwise, the process proceeds to step ST117. In step ST117, (0, y+1) is substituted for (x, y), as in step ST106, and the process returns to step ST108 to repeat the processing of steps ST108 to ST115 and ST117 until y=n−1 is satisfied. In this way, the number, $D_{xy}$, of luminance blocks having the largest luminance weight is determined for all the pixels. When the number, $D_{xy}$, of luminance blocks having the largest luminance weight is determined for each pixel, the combination of luminance blocks used to display the gray-scale level of the pixel is also determined.

Next, the process implementing the halftone display method (equalizing pulse method) is performed. This equalizing pulse process will be described with reference to the flowcharts of FIGS. 26 to 31B. The halftone display method can be implemented using hardware circuits. The method can also be implemented as a software program for a computer that performs processing in accordance with the flowcharts hereinafter described. The program for the computer is delivered in the form of a magnetic storage medium, such as a flexible disk or a hard disk, or an optical storage medium, such as a CD-ROM or MO disk, or by being written in a nonvolatile memory device or the like.

Gray scale bit data b0 to b9 are defined as shown in Table 8 below.

TABLE 8

| | GRAY SCALE BIT DATA | | | | | | | | | |
|---|---|---|---|---|---|---|---|---|---|---|
| | b0 | b1 | b2 | b3 | b4 | b5 | b6 | b7 | b8 | b9 |
| GRAY-SCALE LEVEL | 1 | 2 | 4 | 8 | 16 | 32 | 48 D1 | 48 D2 | 48 D3 | 48 D4 |

Figure 26:
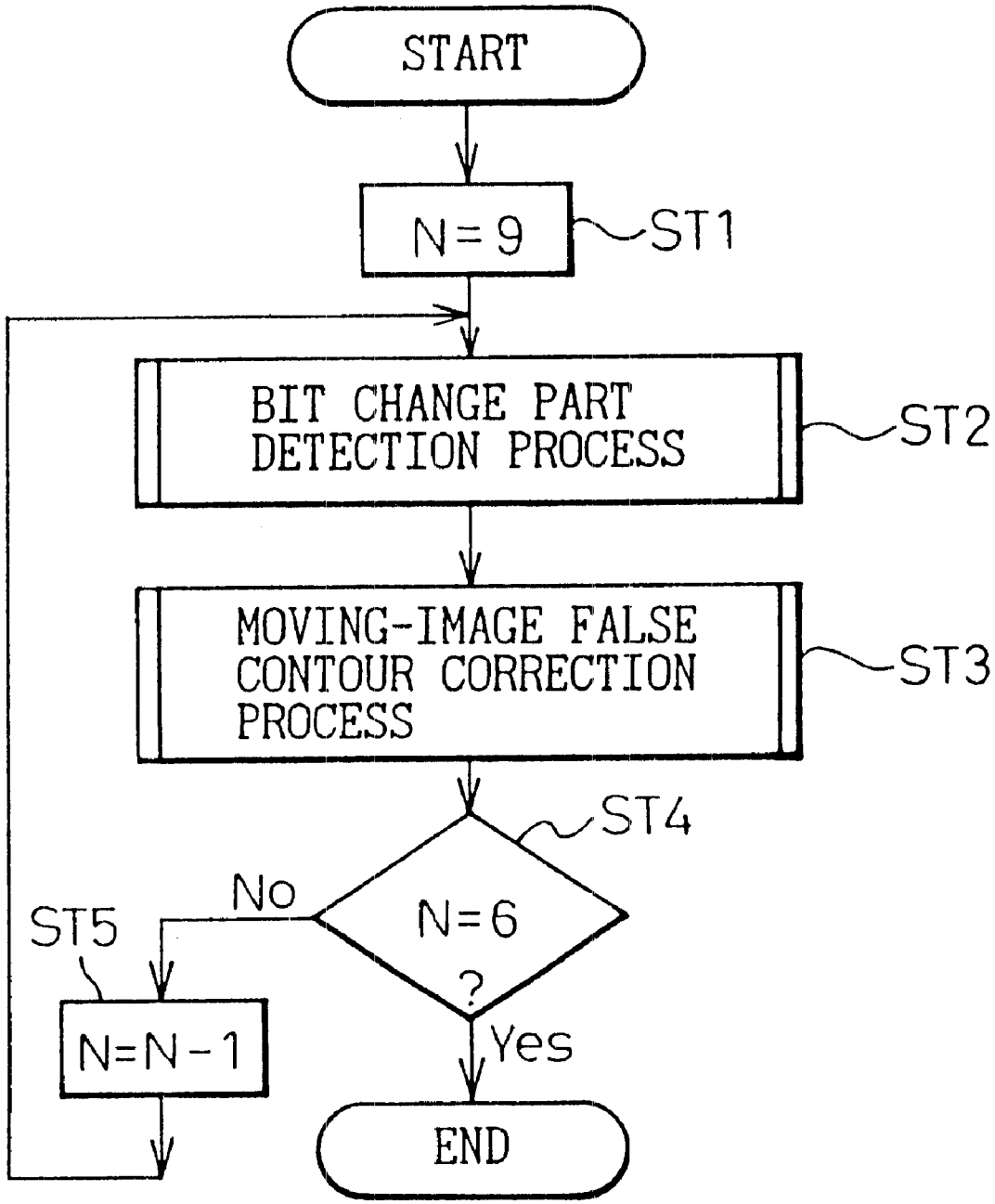
FIG. 26 is a flowchart showing one processing example of the halftone display method to which the present invention is applied.

FIG. 26 is a flowchart showing one processing example of the halftone display method to which the present invention is applied. The main path (main routine) of the equalizing pulse process is shown in this flowchart. The halftone display method to which the present invention is applied assumes the use of an activation sequence, such as the one previously shown in FIG. 19, that comprises a plurality of luminance blocks having high luminance weights.

As shown in FIG. 26, when the equalizing pulse process (halftone display process) is started, N is set to 9 in step ST1, before proceeding to step ST2. Here, the reference character N indicates the bit number of the luminance signal; for example, N=9 indicates the most significant signal bit (SF9: D4 with gray-scale level 48), and N=5 the next lower luminance signal bit (SF5: gray-scale level 32). The gray scale bit data for gray-scale level 48, for example, include not only b9 but also b6, b7, and b8, that is, there are a total of four gray scale bit data b6 to b9 representing the gray-scale level 48.

Next, in step ST2, BIT CHANGE PART DETECTION PROCESS is performed for the luminance signal of N=bit 9 in the n-th frame and the (n+1)th frame, to detect a bit change part in each pixel, and the result of the detection is stored in a storage means. In step ST3, MOVING-IMAGE FALSE CONTOUR CORRECTION PROCESS is performed on the result of the detection obtained in the bit change part detection processing performed in step ST2, after which the process proceeds to step ST4.

In step ST4, it is determined whether N=6 (representing SF6 at the lowest bit position in the gray-level-48 group of SF6 to SF9) is satisfied. If N=6 (true: YES), the equalizing pulse process is terminated; if not (false: NO), the process proceeds to step ST5. In step ST5, N−1 is substituted for N, and the process returns to step ST2 and proceeds to step ST3, then to step ST4, repeating the steps ST2 and ST3 until N=6 becomes true in step ST4. The determination of N=6 in step ST4 corresponds to performing the equalizing pulse processing on all of the four maximum gray-scale level data (SF6 to SF9 with gray-scale level 48). Accordingly, the processing differs depending on the activation sequence configuration, the bit format that requires equalizing pulse processing, etc. For example, when there are seven luminance blocks that are assigned the largest luminance weight with gray-scale level 32 (that is, SF0 to SF4 are the same as those shown in FIG. 19, but SF5 to SF11 are all configured as gray-level-32 blocks), N=bit 9 in step ST2 is replaced by N=bit 11, and N=6 in step ST4 by N=5.

Figure 27:
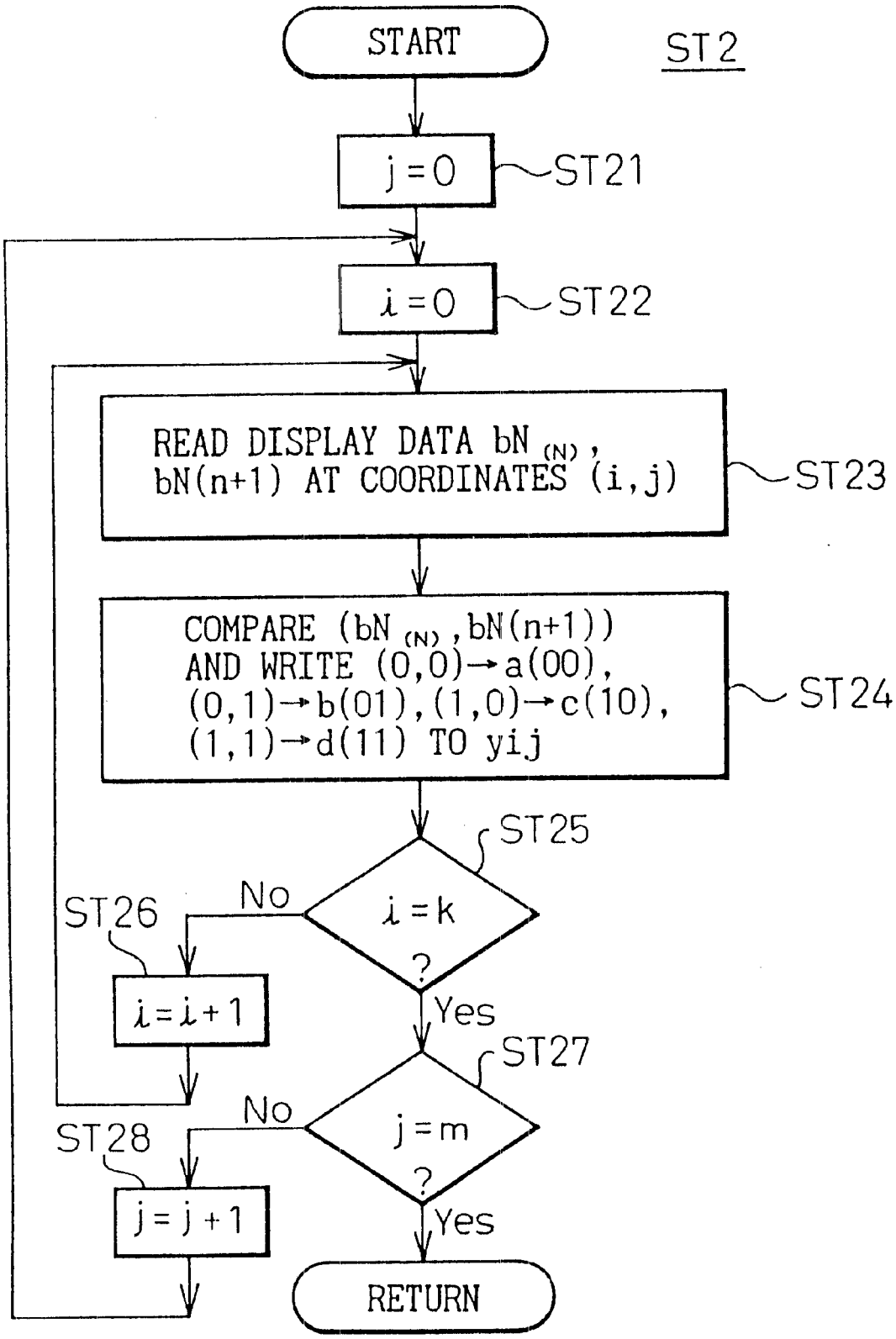
FIG. 27 is a flowchart illustrating one example of a bit change part detection process performed in the flowchart of FIG. 26.

FIG. 27 is a flowchart illustrating one example of the bit change part detection process (step ST2) performed in the flowchart of FIG. 26.

As shown in FIG. 27, when BIT CHANGE PART DETECTION PROCESS ST2 is started, j is initialized to 0 in step ST21, and i is initialized to 0 in step ST22. Here, the reference characters i and j are pixel numbers (coordinates) defining the position of a pixel in the horizontal and vertical directions, respectively. The horizontal pixel number i and the vertical pixel number j both begin with 0, increasing up to k in the horizontal direction and up to m in the vertical direction. That is, there are (k+1) pixels horizontally and (m+1) pixels vertically.

Next, the process proceeds to step ST23 where gray scale bit data $b9_{(n)}$ and $b9_{(n+1)}$ for the pixel at coordinates (0, 0) in frames n and (n+1) are read, after which the process proceeds to step ST24. In step ST24, the gray scale bits read in step ST23 are compared with each other, and the value ($y_{ij}$) obtained in accordance with Table 9 below is stored in a storage means.

TABLE 9

| ITEM | $(b9_{(n)}, b9_{(n+1)})$ | $y_{ij}$ | REMARKS |
|---|---|---|---|
| 1 | (0, 0) | 00 (a) | NO CARRY-OVER OR CARRY-DOWN |
| 2 | (0, 1) | 01 (b) | CARRY-OVER |
| 3 | (1, 0) | 10 (c) | CARRY-DOWN |
| 4 | (1, 1) | 11 (d) | NO CARRY-OVER OR CARRY-DOWN |

The process then proceeds to step ST25 where the horizontal coordinate value i is checked to determine whether i=k; if the horizontal coordinate value i is not equal to k (that is, if the horizontal pixel value i is found to be smaller than the number, k, of pixels in the horizontal direction), the process proceeds to step ST26 where i+1 is substituted for i, after which the process returns to step ST23 to repeat the above processing until i=k is satisfied in step ST25 (that is, until the processing is completed for all the pixels from the beginning to the end of the same line). If it is determined in step ST25 that i=k is satisfied, the process proceeds to step ST27.

In step ST27, the vertical coordinate value j is checked to determine whether j=m; if the vertical coordinate value j is not equal to m (that is, if the vertical coordinate value j is smaller than the maximum number, m, of display lines), the process proceeds to step ST28 where j+1 is substituted for j, after which the process returns to step ST22 to repeat the above processing until j=m is satisfied in step ST27. If it is determined in step ST27 that j=m is satisfied, the bit change part detection process ST2 is terminated, and the process returns to the main routine (proceeds to step ST3 in FIG. 26).

Figure 28:
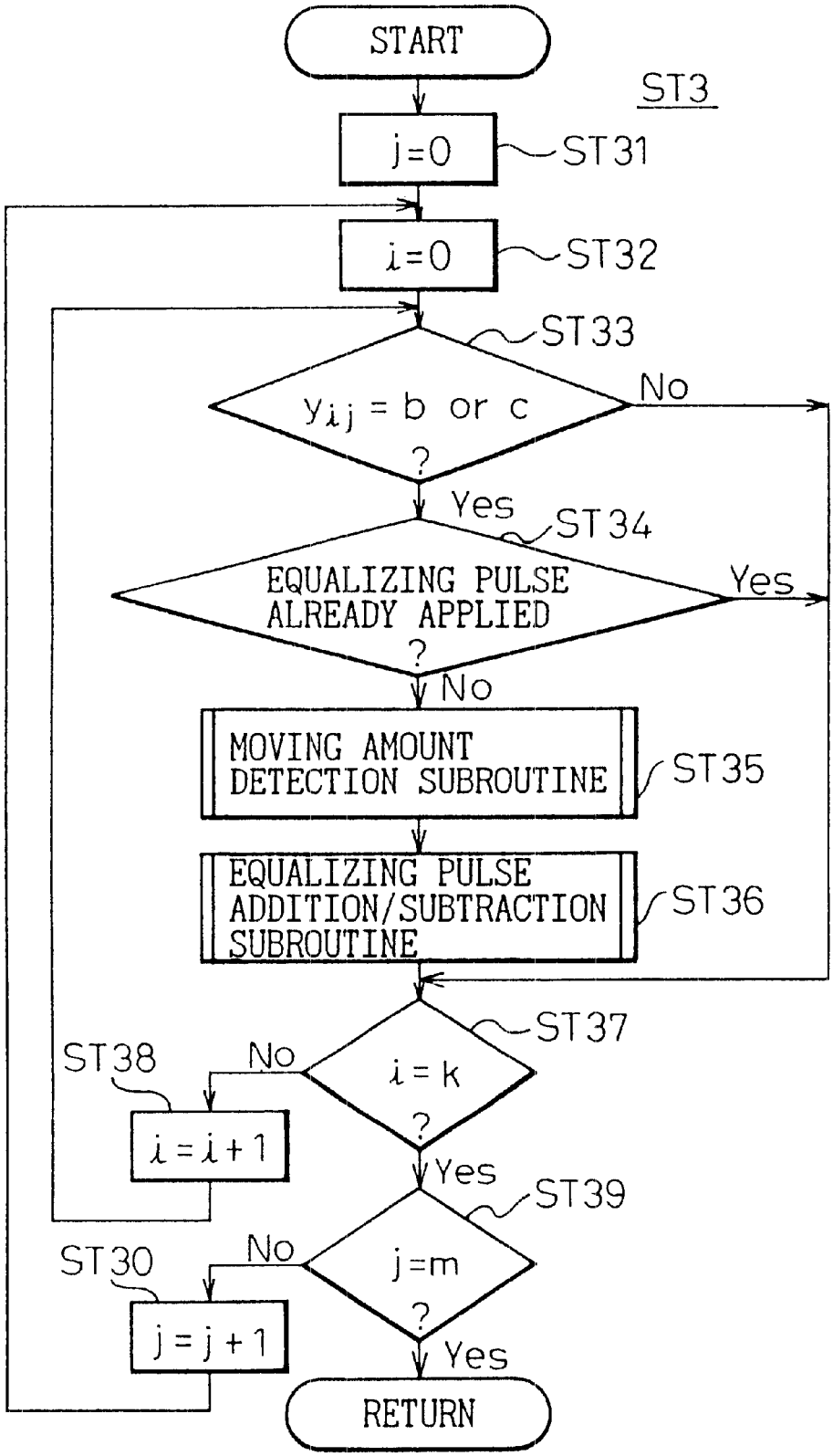
FIG. 28 is a flowchart illustrating one example of a moving-image false contour correction process performed in the flowchart of FIG. 26.

FIG. 28 is a flowchart illustrating one example of the moving-image false contour correction process (step ST3) performed in the flowchart of FIG. 26. The flowchart of FIG. 28 consists primarily of MOTION AMOUNT DETECTION SUBROUTINE (ST35) and EQUALIZING PULSE ADDITION/SUBTRACTION SUBROUTINE (ST36). These subroutines will be described in detail later with reference to FIGS. 29A to 29C and FIGS. 30A to 31B, respectively. The following description deals with the general processing flow, not going into the details of the subroutines in steps ST35 and ST36.

As shown in FIG. 28, when MOVING-IMAGE FALSE CONTOUR CORRECTION PROCESS ST3 is started, j is initialized to 0 in step ST31, and i is initialized to 0 in step ST32. Here, the reference characters i and j correspond to the pixel number defining the horizontal position of a pixel (the dot to be processed) and the line number defining the vertical position of the pixel (the line to be processed).

Next, the process proceeds to step ST33 where $y_{00}$ for coordinates (0, 0) is read to determine whether the value of $y_{00}$ is either b or c (that is, whether there is a carry-over/carry-down of the gray-scale level). If it is determined in step ST33 that there is a carry-over or carry-down, the process proceeds to step ST34; if it is determined that there is no carry-over or carry-down, the process proceeds to step ST37.

In step ST34, it is determined whether or not the pixel currently being processed has been subjected to the addition/subtraction of an equalizing pulse as the result of the processing of some other pixel in the current frame. If it is determined in step ST34 that an equalizing pulse has already been applied to the pixel, the process proceeds to step ST37. Otherwise, the process proceeds to step ST35 to execute the motion amount detection subroutine, and then to step ST36 to execute the equalizing pulse addition/subtraction subroutine, after which the process proceeds to step ST37.

In step ST37, it is determined whether the horizontal position, i, of the current pixel is equal to the maximum value, k, of the horizontal pixel position; if the horizontal pixel number i is not equal to the maximum value k, the process proceeds to step ST38 where i+1 is substituted for i, after which the process returns to step ST33 to repeat the above processing until i=k is satisfied in step ST37 (that is, until the processing is completed for all the pixels from the beginning to the end of the same line). If it is determined in step ST37 that i=k is satisfied, the process proceeds to step ST39.

If it is determined in step ST39 that the vertical line number j is not equal to the maximum number, m, of display lines, the process proceeds to step ST30 where j+1 is substituted for j, after which the process returns to step ST32 to repeat the above processing until j=m is satisfied in step ST39. If it is determined in step ST39 that j=m is satisfied, the moving-image false contour correction subroutine ST3 is terminated, and the process returns to the main routine (proceeds to step ST4 in FIG. 26).

Figure 29A:
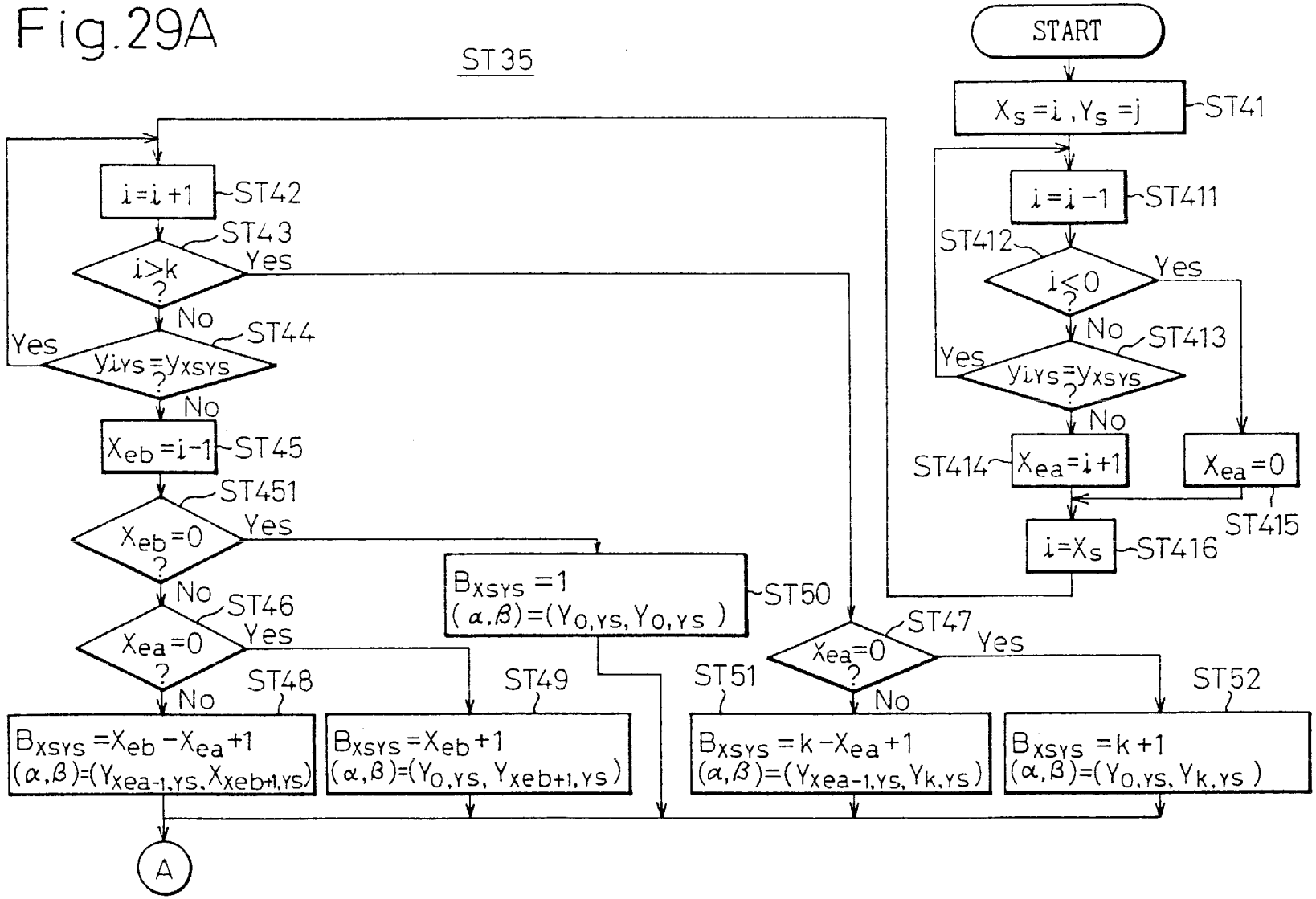
FIGS. 29A, 29B, and. 29C are flowcharts illustrating one example of a motion amount detection subroutine executed in the flowchart of FIG. 28.
Figure 29B:
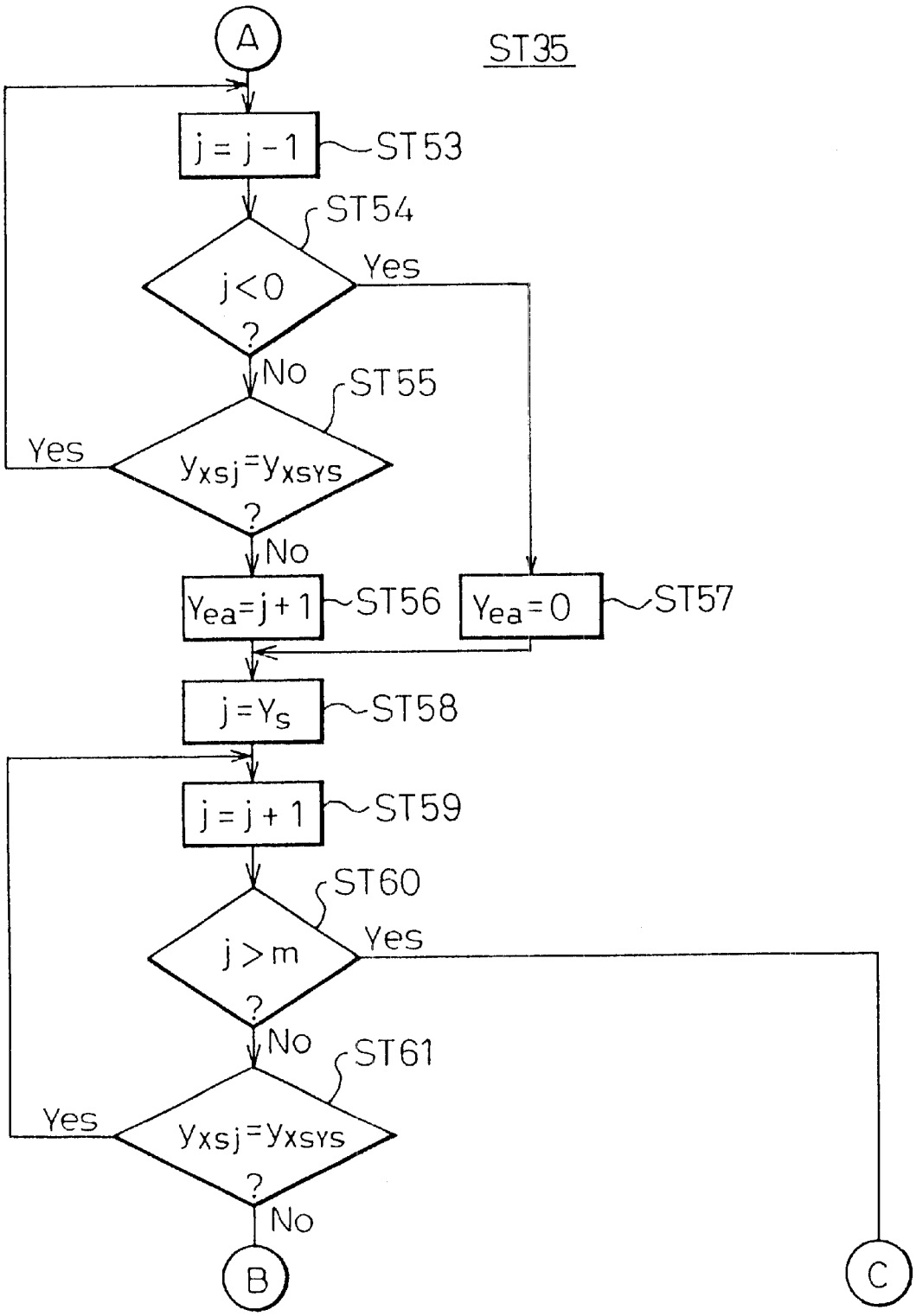
Figure 29C:
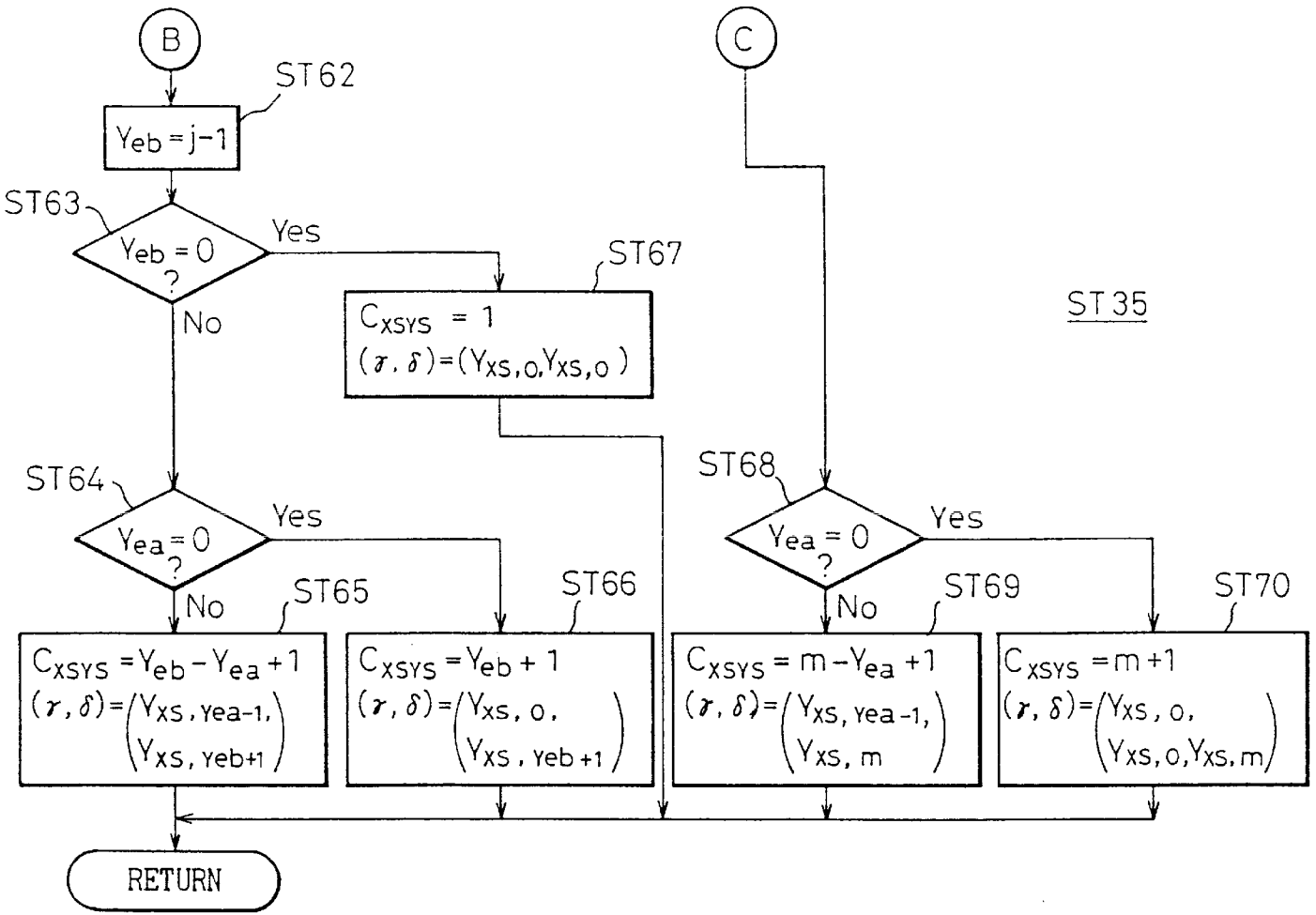

FIGS. 29A to 29C are flowcharts illustrating one example of the motion amount detection subroutine ST35 executed in the flowchart of FIG. 28. The flowchart of FIG. 29A shows the processing for detecting the amount of motion in a horizontal direction, and the flowchart of FIGS. 29B and 29C illustrates the processing for detecting the amount of motion in a vertical direction. The subroutine (motion amount detection subroutine ST35) shown in FIGS. 29A to 29C is initiated when a carry-over or carry-down occurs for the pixel ij ($y_{ij}$=b or c).

As shown in FIG. 29A, when the motion amount detection subroutine (horizontal motion amount detection) is started, in step ST41 a pixel (i, j), for which a carry-over or carry-down has occurred, but which is not yet subjected to the addition/subtraction of an equalizing pulse, is taken as the starting pixel for motion detection, and its coordinates are redefined as ($X_s$, $Y_s$) and stored in memory until the subroutine is terminated.

Next, in step ST411, 1 is subtracted from the horizontal motion detection starting position i, and the result is now set as i (i=i−1), after which the process proceeds to step ST412. In step ST412, it is determined whether the pixel position i is outside the panel display area (i <0). If it is determined that the pixel position is outside the panel display area, the process proceeds to step ST415; otherwise, the process proceeds to step ST413.

In step ST413, the state change $Y_{iys}$ of the pixel at the current coordinates ($Y_s$, i) is compared with the state change $Y_{XsYs}$ of the pixel at the detection starting coordinates. If they are different, the process proceeds to step ST414, and if they are identical, the process returns to step ST411 to repeat the above processing until they become different, and until the pixel position reaches the end of the display screen in the horizontal direction. In step ST414, 1 is added to the detected pixel position i, and the start point coordinate position $X_{ea}$ ($X_{ea}$=i+1) of the horizontal carry-over/carry-down (carry-over or carry-down) state is obtained. In step ST415, if the horizontal carry-over/carry-down state reaches the end of the display area, $X_{ea}$=0 is set. In this way, the motion amount detection in the leftward horizontal direction (upward direction) is performed.

After step ST414 or ST415, the process proceeds to step ST416 to initiate the motion amount detection in the rightward horizontal direction hereinafter described. In step ST416, the horizontal motion detection starting position i is redefined as i=$X_s$, and the process proceeds to step ST42 where 1 is added to the horizontal motion detection starting position i and the result is set as i (i=i+1). Next, in step ST43, it is determined whether the position i obtained in step ST42 is outside the display area k in the horizontal direction (i>k). If it is determined that the position i is outside the display area k, the detection operation is terminated and the process jumps to step ST47; if not, the process proceeds to step ST44.

In step ST44, it is determined whether the state change of the pixel at the current coordinates (i, $y_s$) is the same as the bit change state of the pixel at the detection starting position. If the former state is the same as the latter state ($y_{iYs}$=$y_{XsYs}$), the process returns to step ST42 to repeat the above processing until it is determined in step ST44 that the states are different. When it is determined in step ST44 that the states are different, the detection processing is terminated, and the process proceeds to step ST45 which is carried out when the detection pixel end position in the horizontal direction falls short of the end of the display screen. In step ST45, 1 is subtracted from the coordinate i of the horizontal detection end position, and the resulting value is stored as $X_{eb}$ ($X_{eb}$=i−1).

Further, in step ST451, it is determined whether the value $X_{eb}$ obtained in step ST45 is equal to 0 ($X_{eb}$=0). If it is determined in step ST451 that $X_{eb}$=0, the process proceeds to step ST50; otherwise, the process proceeds to step ST46. In step ST46, it is determined whether $X_{ea}$ is equal to 0 ($X_{ea}$=0). If it is determined that $X_{ea}$=0, the process proceeds to step ST49; otherwise, the process proceeds to step ST48.

On the other hand, in step ST47, it is determined whether the pixel $X_{ea}$ started from the display start position. If it is determined that the detection starting pixel started from the display start position ($X_{ea}$=0), the process proceeds to step ST52; otherwise, the process proceeds to step ST51.

In step ST48, the amount of horizontal motion, $B_{XsYs}$, is set as $B_{XsYs}$=$X_{eb}$−$X_{ea}$+1, and the states of the pixels on both sides of the sequence of pixels that have undergone a bit change in the horizontal direction are obtained and stored as (α, β)=($Y_{Xea-1,\ Ys}$, $Y_{Xeb+1,\ Ys}$) Likewise, in step ST49, $B_{XsYs}$=$X_{eb}$+1 and (α, β)=($Y_{0\ Ys}$, $Y_{Xeb+1,\ Ys}$) are obtained and stored; in step ST50, $B_{XsYs}$=1 and (α, β)=($Y_{0,\ Ys}$, $Y_{0,\ Ys}$) are obtained and stored; in step ST51, $B_{XsYs}$=k−$X_{ea}$+1 and (α, β)=($Y_{Xea-1}$, $Y_{k,\ Ys}$) are obtained and stored; and in step ST52, $B_{XsYs}$=k+1 and (α, β)=($Y_{0,\ Ys}$, $Y_{k,\ Ys}$) are obtained and stored. In this way, in each of the steps ST48, ST49, ST50, ST51, and ST52, the amount of motion in the horizontal direction and the states of the two pixels on both sides of the contiguous pixel sequence are detected. Thereafter, the process proceeds to step ST53.

As shown in FIG. 29B, in step ST53, 1 is subtracted from the vertical motion detection starting position j, and the result is set as j (j=j−1), after which the process proceeds to step ST54. At this time, the horizontal detection pixel position is XS. In step ST54, it is determined whether the pixel position j is outside the panel display area (j <0). If it is determined that the pixel position is outside the panel display area, the process proceeds to step ST57; otherwise, the process proceeds to step ST55.

In step ST55, the state change $Y_{xsj}$ of the pixel at the current coordinates ($X_s$, j) is compared with the state change $Y_{XsYs}$ of the pixel at the detection starting coordinates. If they are different, the process proceeds to step ST56, and if they are identical, the process returns to step ST53 to repeat the above processing until they become different, and until the pixel position reaches the end of the display screen in the vertical direction. In step ST56, 1 is added to the detected pixel position j, and the start point coordinate position $Y_{ea}$ ($Y_{ea}$=j+1) of the vertical carry-over/carry-down (carry-over or carry-down) state is obtained. In step ST57, if the vertical carry-over/carry-down state reaches the end of the display area, $Y_{ea}$=0 is set. In this way, the motion amount detection in the vertical direction (upward direction) is performed.

After step ST56 or ST57, the process proceeds to step ST58 to initiate the motion amount detection in the vertical direction (downward direction) hereinafter described. In step ST58, the vertical motion detection starting position j is redefined as j=$Y_s$, and the process proceeds to step ST59 where 1 is added to the vertical motion detection starting position j and the result is set as j (j=j+1).

Next, in step ST60, it is determined whether the detection pixel position j is outside the display area m in the vertical direction (j>m). If j is outside the display area m, the process jumps to step ST68; if not, the process proceeds to step ST61. In step ST61, the state change $Y_{xsj}$ of the pixel at the current coordinates ($X_x$, j) is compared with the state change $Y_{XsYs}$ of the pixel at the detection starting coordinates. If they are different, the process proceeds to step ST62, and if they are identical ($Y_{xsj}$=$Y_{XsYs}$), the process returns to step ST59 to repeat the above processing until they become different, and until the pixel position reaches the end of the display screen in the vertical direction.

As shown in FIG. 29C, in step ST62, 1 is subtracted from the detected pixel position j, and the endpoint coordinate position $Y_{eb}$ ($Y_{eb}$=j−1) of the vertical carry-over/carry-down (carry-over or carry-down) state is obtained, after which the process proceeds to step ST63. In step ST63, the value $Y_{eb}$ obtained in step ST62 is examined to determine whether $Y_{eb}$=0. If it is determined that the endpoint coordinate position $Y_{eb}$ of the vertical carry-over/carry-down state is equal to 0, the process proceeds to step ST67; otherwise, the process proceeds to step ST64.

In step ST64, it is determined whether the start point coordinate $Y_{ea}$ of the state change is at the end of the screen ($Y_{ea}$=0). If it is not at the end of the screen, the process proceeds to step ST65, and if it is at the end of the screen ($Y_{ea}$=0), the process proceeds to step ST66. Likewise, in step ST68, it is determined whether the start point coordinate $Y_{ea}$ of the state change is at the end of the screen. If it is not at the end of the screen, the process proceeds to step ST69, and if it is at the end of the screen ($Y_{ea}$=0), the process proceeds to step ST70.

In step ST65, the amount of vertical motion, $C_{XsYs}$, is set as $C_{XsYs}$=$Y_{eb}$−$Y_{ea}$+1, and the states of the pixels on both sides of the sequence of pixels that have undergone a bit change in the vertical direction are obtained and stored as (γ, δ)=($Y_{Xs,\ Yea-1}$, $Y_{Xs,\ Yeb+1}$). Likewise, in step ST66, $C_{XsYs}$=$Y_{eb}$+1 and (α, δ)=($Y_{Xs,\ 0}$, $Y_{Xs,\ Yeb+1}$) are obtained and stored; in step ST67, $C_{XsYs}$=1 and (γ, δ)=($Y_{Xs,\ 0}$, $Y_{Xs,\ 0}$) are obtained and stored; in step ST69, $C_{XsYs}$=m−$Y_{ea}$+1 and (γ, δ)=

($Y_{Xs,\ Yea-1}$, $Y_{Xs,\ m}$) are obtained and stored; and in step ST70, $C_{XsYs}$=m+1 and (γ, δ)=($Y_{Xs,\ 0}$, $Y_{Xs,\ m}$) are obtained and stored. In this way, the amount of vertical motion as well as the amount of horizontal motion is detected, and the motion amount detection subroutine ST35 is terminated, whereupon the process returns to the main routine (proceeds to step ST36 in FIG. 28).

Figure 30A:
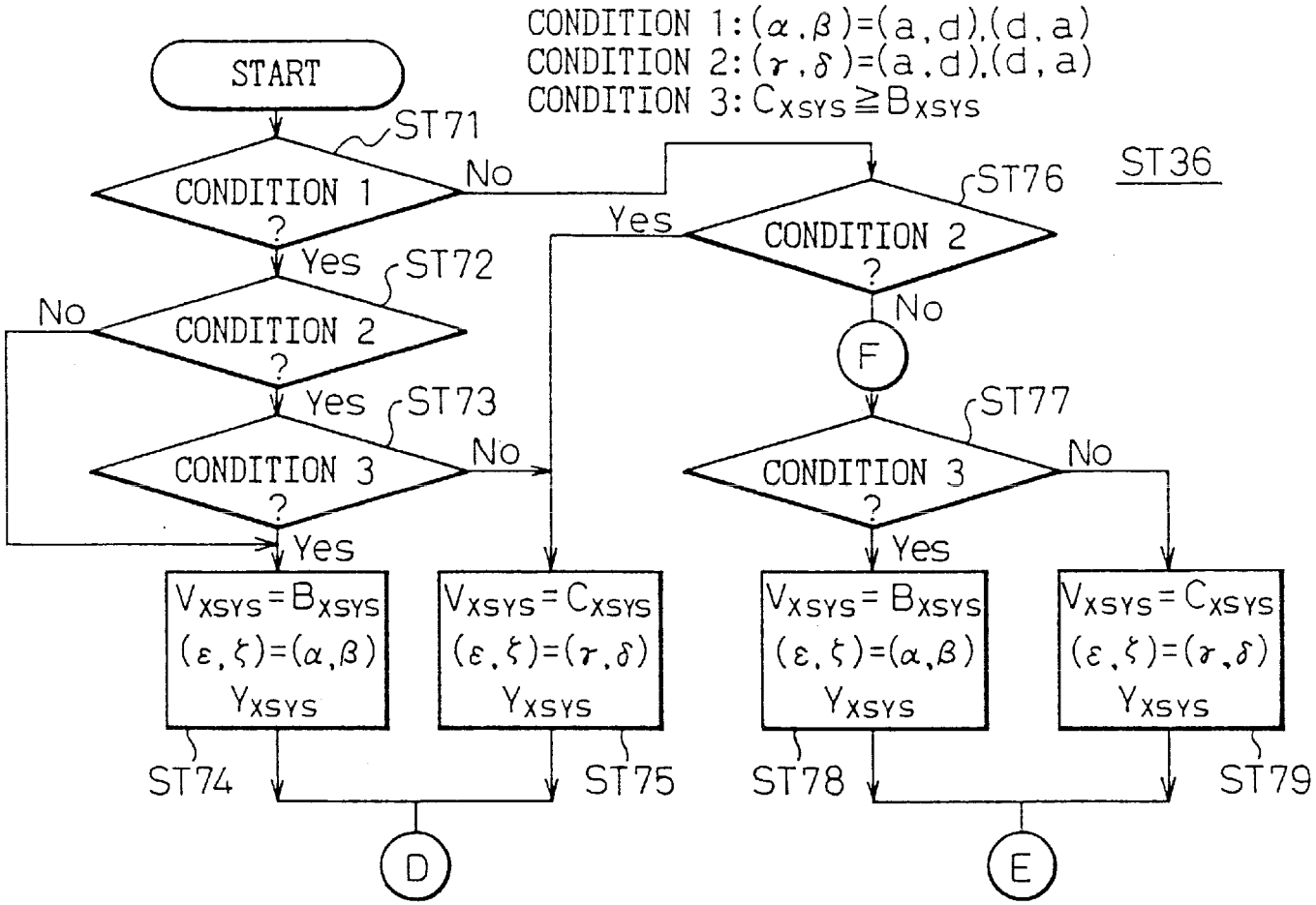
FIGS. 30A and 30B are flowcharts illustrating one example of an equalizing pulse addition/subtraction subroutine executed in the flowchart of FIG. 28.
Figure 30B:
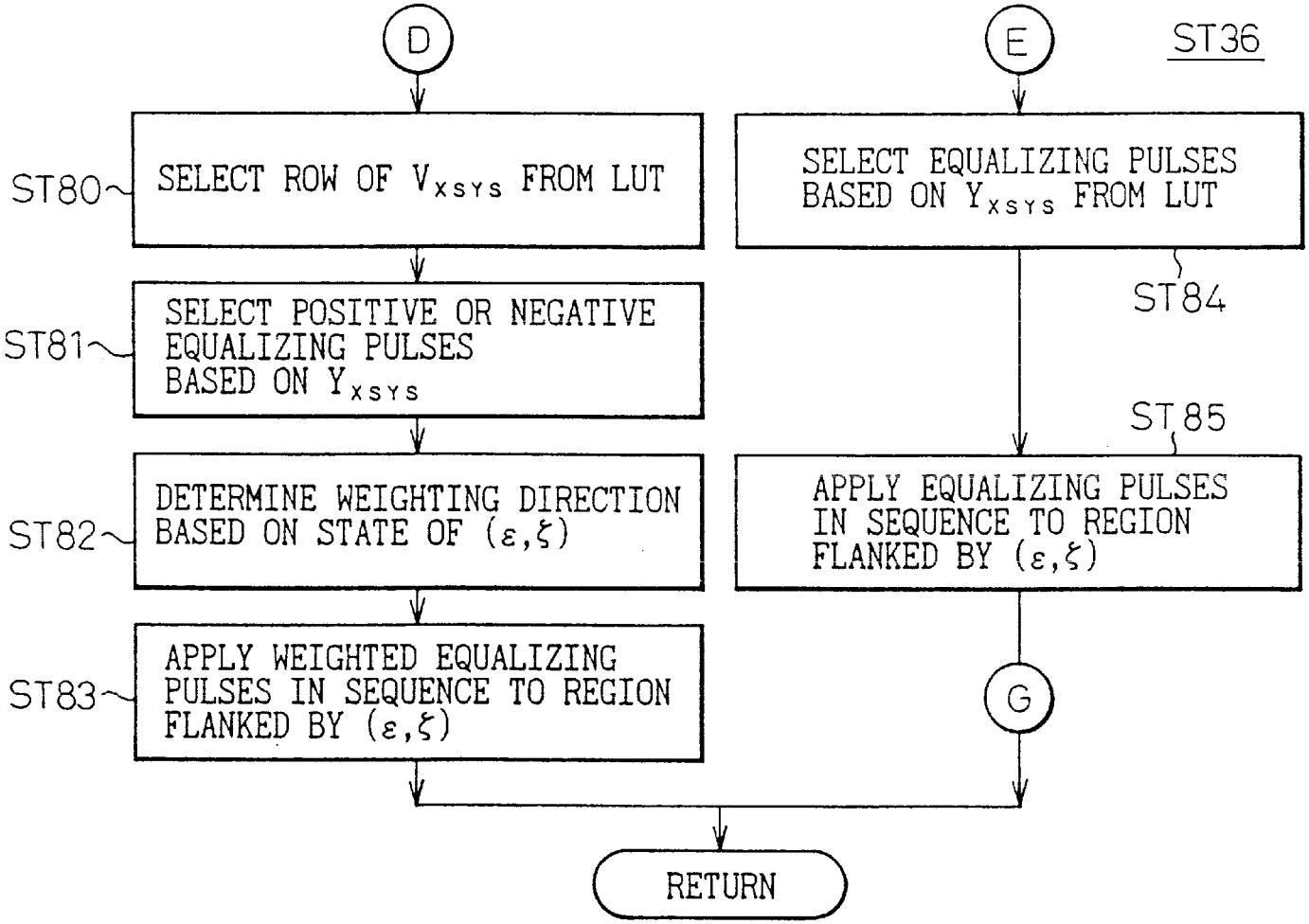

FIGS. 30A and 30B (FIGS. 31A and 31B) are flowcharts illustrating one example of the equalizing pulse addition/subtraction subroutine ST36 performed in the flowchart of FIG. 28.

As shown in FIG. 30A, when the equalizing pulse addition/subtraction subroutine ST36 is started, it is determined in step ST71 whether the pixels (α, β) horizontally bounding the detected motion region are (a, d) and (d, a) (condition 1). If the result is true (YES), the process proceeds to step ST72, and if the result is false (NO), the process proceeds to step ST76.

In step ST72, it is determined whether the pixels (γ, δ) vertically bounding the detected motion region are (a, d) and (d, a) (condition 2). If the result is true (YES), the process proceeds to step ST73, and if the result is false (NO), the process proceeds to step ST74. In step ST73, the horizontal and vertical motion amounts, $B_{XsYs}$ and $C_{XsYs}$, are compared with each other to determine whether the relation $C_{XsYs} \geqq B_{XsYs}$ holds (condition 3). If it is determined that the relation $C_{XsYs} \geqq B_{XsYs}$ holds, the process proceeds to step ST74; otherwise, the process proceeds to step ST75.

Likewise, in step ST76, it is determined whether the pixels (γ, δ) vertically bounding the detected motion region are (a, d) and (d, a) (condition 2). If the result is true (YES), the process proceeds to step ST75, and if the result is false (NO), the process proceeds to step ST77. In step ST77, the horizontal and vertical motion amounts, $B_{XsYs}$, and $C_{XsYs}$, are compared with each other to determine whether the relation $C_{XsYs} \geqq B_{XsYs}$ holds (condition 3). If it is determined that the relation $C_{XsYs} \geqq B_{XsYs}$ holds, the process proceeds to step ST78; otherwise, the process proceeds to step ST79.

In step ST74, the motion amount $V_{XsYs}$, the pixels (ϵ, ζ) bounding the motion amount, and the detection starting pixel $Y_{XsYs}$ are stored ($V_{XsYs}=B_{XsYa}$, (ϵ, ζ)=(α, β), $Y_{XsYs}$) Likewise, in step ST75, $V_{XsYs}=C_{XsYs}$, (ϵ, ζ)=(γ, δ), and $Y_{XsYs}$ are stored. In step ST78, the motion amount $V_{XsYs}$, the pixels bounding the motion amount, and the detection starting pixel $Y_{XsYs}$ are stored ($V_{XsYs}=B_{XsYs}$, (ϵ, ζ)=(α, β), $Y_{XsYs}$) In step ST79, $V_{XsYs}=C_{XsYs}$, (ϵ, ζ)=(γ, δ), and $Y_{XsYs}$ are stored. After step ST74 or ST75, the process proceeds to step ST80, and after step ST78 or ST79, the process proceeds to step ST84, for addition or subtraction of motion compensation equalizing pulses.

As shown in FIG. 30B, in step ST80, a row corresponding to the detected motion amount $V_{XsYs}$ is selected by referring to a prescribed lookup table (LUT), after which the process proceeds to step ST81 where positive equalizing pulses or negative equalizing pulses are selected according to the state of $Y_{XsYs}$. In step ST82, the weighting direction of the equalizing pulses is determined based on the pixels (ϵ, ζ) bounding the motion amount, and in step ST83, the weighted equalizing pulses are applied in sequence to the region flanked by the pixels (ϵ, ζ) bounding the motion amount, whereupon the equalizing pulse addition/subtraction subroutine ST36 is terminated and the process returns to the main routine (proceeds to step ST37 in FIG. 28).

On the other hand, in step ST84, equalizing pulses similar to those in the prior art (the equalizing pulses shown in FIG. 26 and FIGS. 31A and 31B) are selected based on the state of the detection starting pixel $Y_{XsYs}$ by referring to the lookup table (LUT). In step ST85, the equalizing pulses are applied in sequence to the region flanked by the pixels (ϵ, ζ) bounding the motion amount, after which the equalizing pulse addition/subtraction subroutine ST36 is terminated and the process returns to the main routine (proceeds to step ST37 in FIG. 28).

Figure 31A:
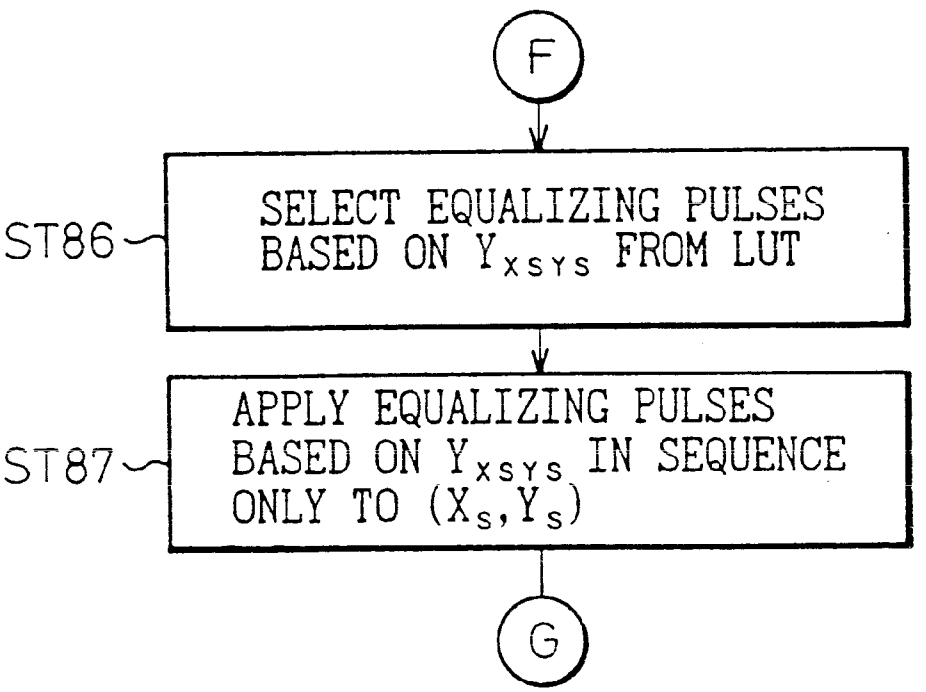
FIGS. 31A and 31B are diagrams for explaining modified examples of the equalizing pulse addition/subtraction subroutine shown in FIGS. 30A and 30B.
Figure 31B:
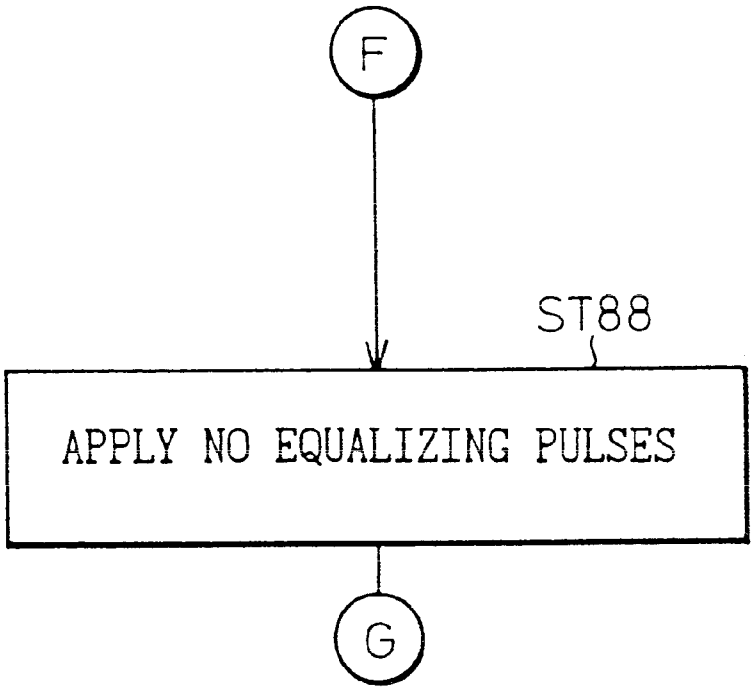

FIGS. 31A and 31B are diagrams for explaining modified examples of the equalizing pulse addition/subtraction subroutine shown in FIGS. 30A and 30B. FIGS. 31A and 31B show modified examples of the processing performed between reference characters F to G in the equalizing pulse addition/subtraction subroutine shown in FIGS. 30A and 30B. More specifically, steps ST77 to ST79, ST84, and ST85 in FIGS. 30A and 30B can be replaced by steps ST86 and ST87 shown in FIG. 31A or step ST88 shown in FIG. 31B.

As shown in FIGS. 30A, 30B, and 31A, if it is determined in step ST76 that the pixels (γ, δ) vertically bounding the detected motion region are neither (a, d) nor (d, a), the process proceeds, not to step ST77 in FIG. 30A, but to step ST86 in FIG. 31A. In step ST86, equalizing pulses are selected based on the state of the detection starting pixel $Y_{XsYs}$ by referring to the look-up table LUT, and in step ST87, the equalizing pulses based on the state of $Y_{XsYs}$ are applied in sequence only to the pixels at coordinates ($X_s$, $Y_s$), after which the equalizing pulse addition/subtraction subroutine ST36 is terminated and the process returns to the main routine (proceeds to step ST37 in FIG. 28). In this way, steps ST77 to ST79, ST84, and ST85 in FIGS. 30A and 30B can be replaced by steps ST86 and ST87 shown in FIG. 31A.

Likewise, as shown in FIGS. 30A, 30B, and 31B, if it is determined in step ST76 that the pixels (γ, δ) vertically bounding the detected motion region are neither (a, d) nor (d, a), the process proceeds, not to step ST77 in FIG. 30A, but to step ST88 in FIG. 31B, and the equalizing pulse addition/subtraction subroutine ST36 is terminated without applying equalizing pulses, after which the process returns to the main routine (proceeds to step ST37 in FIG. 28). In this way, steps ST77 to ST79, ST84, and ST85 in FIGS. 30A and 30B can be replaced by step ST88 shown in FIG. 31B.

As explained with reference to the flowcharts of FIGS. 26 to 31B, the halftone display method to which the present invention is applied can reduce halftone disturbances and alleviate the problem of moving-image false contours in video for moving images moving at various speeds and in various direction; in particular, such as fast-moving images moving at a speed, for example, faster than five pixels per frame.

FIG. 32 is a diagram showing an example of a display image in a display apparatus to which the halftone display method according to the present invention is applied. FIG. 33 is a diagram related to FIGS. 20 and 22 described above for explaining the problem of the invention as it is applied to the display image shown in FIG. 32.

According to an aspect (first aspect) of the halftone display method of the present invention described above, assume a display panel having only one pixel PXL 32 of 160-BB and other pixels of 159-AA, for example. As shown in FIG. 33, the pixel PXL 33 displays 159 gray scales (159-BB) using three luminance blocks of 48 gray scale levels in accordance with the left adjacent PXL 32 (160BB: display of 160 gray-scale levels using three luminance blocks of 48 gray-scale levels). Also, the pixels PXL 34 and PXL 35 assume 159-BB. Specifically, the halftone display method described above uses the weighting of a redundant luminance block for determining a natural luminance pattern thereof by the luminance pattern of adjoining pixels. As shown in FIG. 33, the speed detection for each line is accurately carried out by setting the luminance pattern of pixels PXL 33 to PXL 35 in order (159-BB) with respect to the adjoining pixel PXL 32 (160-BB).

As in the aforementioned case, reference character AA designates the gray-scale display using two (D1, D2) luminance blocks (the luminance blocks having the largest weight of luminance) of 48 gray-scale levels, for example, and reference character BB designates the gray-scale display using three luminance blocks (D1, D2, D3) of 48 gray-scale levels. Thus, 159-AA indicates the pixel for displaying 159 gray-scale levels using two luminance blocks of 48 gray-scale levels, 159-BB the pixel for displaying 159 gray-scale levels using three luminance blocks of 48 gray-scale levels, and 160-BB the pixel for displaying 160 gray-scale levels using three luminance blocks of 48 gray-scale levels.

The foregoing description involves one line. In the actual flat display panel, however, the following problem is to be solved.

Specifically, as shown in FIGS. 32 and 33, assume that only the pixel PXL 32 is 160-BB and the other pixels are 159-AA and the image on the display panel moves in horizontal (transverse) direction. In this case, the speed can be detected accurately and no problem is posed. If the image moves vertically, however, a problem similar to the one described with reference to FIG. 20 occurs in one vertical line (column). This not only substantially prevents the moving image false contour from being reduced but also causes the disturbance in lines since the luminance is put in order in terms of line (a plurality of pixels). This line disturbance appears at a place different from 31, the normal place of occurrence of the moving image false contour and therefore is liable to be visually recognized easily.

In another embodiment of the invention described below, even in the presence of singular points such as noises different in gray-scale level than the surrounding pixels, for example, the line disturbance is eliminated which otherwise might be caused by the determination of the luminance pattern in the adjoining pixels. The luminance patterns are put in order as far as possible in both horizontal and vertical directions. At the same time, the adverse effect due to the singular points such as noises is reduced to make a more effective motion-compensated equalizing pulse method. Also, this embodiment of the invention is applicable as it is to the display apparatus shown in FIG. 2 described above.

This embodiment of the invention is also applicable to a halftone display method and a display apparatus utilizing the lighting sequences having a plurality of luminance blocks of the largest luminance weight (the luminance block having the largest luminance weight) among the luminance blocks making up one frame (one field).

FIGS. 34 to 37 are diagrams for explaining the halftone display method according to another embodiments of another aspect (second aspect) of the present invention. In each diagram, the original luminance pattern of each pixel is indicated in FIG. 32 (for example, the luminance pattern is specified with a minimum number of luminance blocks of largest luminance), and the pixel (intended pixel) to be processed is assumed to be PXL 33. By the way, in the description of the embodiments that follows, the original luminance pattern of each pixel other than shown in FIG. 32 will also be referred to for facilitating the understanding.

FIG. 34 is a diagram for explaining the halftone display method according to the first embodiment of another aspect of the present invention.

As shown in FIG. 34, according to this first embodiment, the luminance block used by the intended pixel PXL 33 is specified with reference to the luminance blocks used by the four surrounding pixels (reference pixels) PXL 22, PXL 23, PXL 24, PXL 32. Specifically, in the case of FIG. 34, the three reference pixels PXL 22, PXL 23, PXL 24 are 159-AA, and one reference pixel PXL 32 is 160-BB. Therefore, deciding by majority of these four reference pixels, the luminance pattern of the intended pixel PXL 33 is specified as 159-AA (two luminance blocks of 48 gray-scale levels are used) from the state in which the luminance blocks exceeding the majority is used. In FIG. 34, the three reference pixels PXL 22, PXL 23, PXL 24 are assumed to be 160-BB and one reference pixel PXL 32 is assumed to be 159-AA. From the state in which the luminance blocks exceeding the majority (160-BB, three luminance blocks of 48 gray-scale levels are used) are used, the luminance pattern of the intended pixel PXL 33 is specified as 159-BB (three luminance blocks of 48 gray-scale levels are used).

If in FIG. 34, for example, two reference pixels PXL 22, PXL 23 are 159-AA and two reference pixels PXL 24, PXL 32 are 160-BB, i.e. the opposite results of decision by majority are equally divided, 159-A is determined (the luminance pattern is specified with a minimum number of luminance blocks of highest luminance) without changing the luminance pattern of the intended pixel PXL 33. In the case where the intended pixel is PXL 11 located at the upper leftmost position, on the other hand, there exists no reference pixel for the intended pixel PXL 11. In such a case, the number of luminance blocks of highest luminance (the luminance blocks of 48 gray-scale levels, for example) is taken as zero for the processing (in which case the intended pixel PXL 11 maintains the original luminance pattern).

As a result, as in the foregoing explanation of the halftone display method according to the invention, if two methods of expression are available, one with a small number of luminance blocks of largest luminance weight in one gray scale and the other with a great number of luminance blocks having the largest luminance weight, the number of luminance blocks used having the largest luminance weight in the intended PXL 33 is determined by the majority of the number of the luminance blocks used having the largest luminance weight in the reference pixels PXL 22, PXL 23, PXL 24, PXL 32. Specifically, in the case where the number of luminance blocks used having the largest luminance weight is different in the reference pixels PXL 22, PXL 23, PXL 24, PXL 32 (group Nos. GA and GB, Table 1), the number of the luminance blocks used having the largest luminance weight in the intended pixel PXL 33 is determined by the majority between the number NA of the reference pixels of the group No. GA and the number NB of the reference pixels of the group No. GB, as follows.

NB<NA . . . First expression (expression by group No. GA)

NB=NA . . . (original expression of intended pixel)

NB>NA . . . Second expression (expression by group No. GB)

FIG. 35 is a diagram for explaining the halftone display method according to a second embodiment of another aspect of the present invention.

In the first embodiment described above, reference was made to the case in which the reference pixels are even numbered, and therefore opposite decisions are sometimes equally divided in the majority decision. According to the second embodiment, the reference pixels are odd numbered. Specifically, in the second embodiment, one reference pixel PXL 42 is added to the four reference pixels PXL 22, PXL 23, PXL 24, PXL 32 in FIG. 34 for a total of five (odd-numbered) reference pixels. The original luminance pattern of each pixel (specified with a minimum number of the luminance blocks having the largest luminance) may be used as a reference pixel. Nevertheless, the luminance pattern after sequential processing may be used with equal effect. Assume, for example, that the intended pixel is moved on each line (Y1, for example) rightward (PXL 11→PXL 12→PXL 13→, and so on), and further downward (Y1→Y2→Y3→, and so on). According to this embodiment, the pixels having a luminance pattern after the processing are used as the reference pixels PXL 22, PXL 23, PXL 24, PXL 32, while the reference pixel PXL 42 is the one having the original luminance pattern before the processing.

FIG. 36 is a diagram for explaining the halftone display method according to a third embodiment of another aspect of the present invention.

In the first and second embodiments shown in FIGS. 34 and 35 above, the majority decision was made using as reference pixels (PXL 22, PXL 23, PXL 24, PXL 32, PXL 42) directly adjoining the intended pixel PXL 33. According to the third embodiment shown in FIG. 36, on the other hand, not only the four pixels (PXL 22, PXL 23, PXL 24, PXL 32) directly adjoining the intended pixel PXL 33 but also seven pixels (PXL 11, PXL 12, PXL 13, PXL 14, PXL 15, PXL 21, PXL 31) in proximity to the intended pixel PXL 33 through other pixels are also used as reference pixels for majority decision. Thus, the majority decision is made based on the 11 reference pixels around the intended pixel PXL 33.

FIG. 37 is a diagram for explaining the halftone display method according to a fourth embodiment of another aspect of the present invention.

In the fourth embodiment, the same pixels PXL 22, PXL 23, PXL 24, PXL 32, PXL 42 as used in the second embodiment of FIG. 35 are used as reference pixels, except that the reference pixels have a weight. Specifically, the reference pixel PXL 22 has a weight of "3", the reference pixels PXL 23, PXL 32 have weights of "2", and the reference pixels PXL 24, PXL 42 have weights of "1". Thus, the majority decision is made by multiplying each reference pixel by the designated magnitude of weight before making a decision by majority.

In the processing based on the original luminance pattern, for example, it is assumed that the reference pixel PXL 22 is also 160-BB, i.e. the reference pixel PXL 22 of weight "3" and the reference pixel PXL 32 of weight "2" are 160-BB, and the other reference pixels PXL 23, PXL 24, PXL 42 are 159-AA in FIG. 37, for example. In the aforementioned second embodiment, the intended pixel PXL 33 is 159-AA, whereas in the fourth embodiment, the intended pixel PXL 33 is 159-BB.

In the foregoing explanation of the first to fourth embodiments of another aspect (second aspect) of the present invention, the manner in which the reference pixels are determined, the number of such reference pixels and the manner in which weighting is attached to each reference pixel are only illustrative, and can of course be modified in various ways.

As described above, according to embodiments of the second aspect of the present invention, even in the presence of singular points such as noise different in gray scale level than the surrounding pixels, a uniform luminance of each pixel can be two-dimensionally assured, thereby making it possible to add more accurate motion compensated equalizing pulses effectively.

As already noted, the second aspect of the present invention is applicable not only to gas discharge display panels such as plasma displays, but also to various other display devices, such as the Digital Micromirror Device (DMD) and EL panels, that display halftone gray scale images by using an intraframe or intrafield time-division method.

As described in detail above, according to the present invention, when using an activation sequence having redundancy that enables one gray scale level to be displayed by any one of a plurality of combinations of subframes (luminance blocks), the occurrence of moving-image contours (false color contours) in video can be minimized by actively utilizing the redundancy, and the display image quality can be further improved by effectively applying the motion compensation equalizing pulse method.

Many different embodiments of the present invention may be constructed without departing from the spirit and scope of the present invention, and it should be understood that the present invention is not limited to the specific embodiments described in this specification, except as defined in the appended claims.

What is claimed is:

1. A halftone display method which predefines a plurality of luminance blocks in each frame or field to display an image, and which is capable of displaying one gray-scale level by any one of a plurality of combinations of said luminance blocks, wherein:

when determining luminance blocks, to be used to display a gray scale of an arbitrary first pixel, the luminance blocks to be used for said first pixel are selected in accordance with a predetermined rule, based on how the luminance blocks are used for a second pixel located on a common image display with, and in close proximity to, said first pixel.

2. A halftone display method as claimed in claim 1, wherein:

said second pixel is a pixel that is producing the same color as said first pixel, and that is located closest to said first pixel horizontally or vertically.

3. A halftone display method as claimed in claim 2, wherein:

if said second pixel does not exist on a display screen, said second pixel is assumed to be displaying an arbitrarily set gray-scale level.

4. A halftone display method as claimed in claim 1, wherein:

said plurality of luminance blocks predefined in each frame or field are provided with redundancy such that more than one luminance block is assigned the largest luminance weight.

5. A halftone display method as claimed in claim 4, wherein:

how the luminance blocks with the largest luminance weight are to be used for said first pixel is determined based on how the luminance blocks with the largest luminance weight are used for said second pixel.

6. A halftone display method as claimed in claim 5, wherein:

how many luminance blocks with the largest luminance weight are to be used for said first pixel is determined based on how many luminance blocks with the largest luminance weight are used for said second pixel.

7. A halftone display method as claimed in claim 6, wherein:

all gray-scale levels are classified into groups according to the number of luminance blocks with the largest luminance weight that are allowed to be used;

said first and said second pixels are assigned group numbers from said classified groups according to the gray-scale levels that said first and said second pixel display; and the group numbers assigned to said first and said second pixels are compared with each other and, in accordance with the result of which, one of said plurality of combinations of said luminance blocks is selected to display the gray-scale level of said first pixel.

8. A halftone display method as claimed in claim 7, wherein:

the gray-scale level to be displayed by each pixel is expressible by one of two descriptions, the first description using a smaller number of luminance blocks with the largest luminance weight than the second description; and the number of luminance blocks with the largest luminance weight to be used for said first pixel is determined by comparing the group number, denoted as GA, of said first pixel with the group number, denoted as GB, of said second pixel, and by selecting one of said two descriptions in such a manner that:

when GB<GA said first description is selected;

when GB=GA, the same description as used for second pixel is used; and when GB<GA, said second description is selected.

9. A halftone display method as claimed in claim 6, wherein:

how the luminance blocks with the largest luminance weight to be used for said first pixel are selected, from among said luminance blocks with the largest luminance weight, is determined according to how the luminance blocks with the largest luminance weight are selected and used for said second pixel.

10. A halftone display method as claimed in claim 6, wherein, when there occurs a state change between successive frames or fields in any one of the luminance blocks with the largest luminance weight in said first pixel:

the number of linearly contiguous pixels on a display screen that exhibit the same change as the change in said one of the luminance blocks with the largest luminance weight in said first pixel is detected;

a predetermined luminance adjusting luminance block is selected based on said detected number of contiguous pixels and on the change in said one of the luminance blocks with the largest luminance weight in said first pixel; and said selected luminance adjusting luminance block is applied to a source signal of each of said contiguous pixels.

11. A halftone display method as claimed in claim 10, wherein:

said selected luminance adjusting luminance block is applied not only to the source signal of each of said detected contiguous pixels but also to the source signal of an additional pixel located on the opposite side of said contiguous pixels from said second pixel.

12. A halftone display method as claimed in claim 10, wherein:

the detection of a state change between successive frames or fields in said luminance blocks with the largest luminance weight is performed in sequence, starting with the luminance block located on the smaller luminance weight side of said luminance blocks with the largest luminance weight.

13. A halftone display method as claimed in claim 6, wherein, when there occurs a state change between successive frames or fields in any one of the luminance blocks with the largest luminance weight in said first pixel:

the number of linearly contiguous pixels on a display screen that exhibit the same change as the change in said one of the luminance blocks with the largest luminance weight in said first pixel is detected in a horizontal and a vertical direction; and a predetermined luminance adjusting luminance block is selected based on said detected number of horizontally or vertically contiguous pixels, whichever is smaller, and on the change in said one of the luminance blocks with the largest luminance weight in said first pixel; and said selected luminance adjusting luminance block is applied to a source signal of each of said contiguous pixels.

14. A halftone display method as claimed in claim 13, wherein:

said selected luminance adjusting luminance block is applied not only to the source signal of each of said horizontally or vertically detected contiguous pixels, whichever are smaller in number, but also to the source signal of an additional pixel located on the opposite side of said contiguous pixels from said second pixel.

15. A halftone display method as claimed in claim 13, wherein:

the detection of a state change between successive frames or fields in said luminance blocks with the largest luminance weight is performed in sequence, starting with the luminance block located on the smaller luminance weight side of said luminance blocks with the largest luminance weight.

16. A halftone display method as claimed in claim 4, wherein:

said plurality of luminance blocks are 10 in number, and the luminance weights of said luminance blocks are set to provide gray-scale levels 1, 2, 4, 8, 16, 32, 48, 48, 48, and 48, respectively.

17. A display apparatus which predefines a plurality of luminance blocks in each frame or field to display an image, and which is capable of displaying one gray-scale level by any one of a plurality of combinations of said luminance blocks, comprising:

an image display;

a driving unit driving said image display;

a control unit controlling said driving unit; and a luminance block selection and luminance adjusting luminance block insertion unit selecting luminance blocks and inserting a luminance adjusting luminance block into a source signal, and wherein:

when determining luminance blocks to be used to display gray scale of an arbitrary first pixel on said image display, said luminance block selection and luminance adjusting luminance block insertion unit selects the luminance blocks to be used for said first pixel in accordance with a predetermined rule, based on how the luminance blocks are used for a second pixel located on said image display in close proximity to said first pixel.

18. A display apparatus as claimed in claim 17, wherein:

said second pixel is a pixel that is producing the same color as said first pixel, and that is located closest to said first pixel horizontally or vertically.

19. A display apparatus as claimed in claim 18, wherein:

if said second pixel does not exist on a display screen, said second pixel is assumed to be displaying an arbitrarily set gray-scale level.

20. A display apparatus as claimed in claim 17, wherein:

said plurality of luminance blocks predefined in each frame or field are provided with redundancy such that more than one luminance block is assigned the largest luminance weight.

21. A display apparatus as claimed in claim 20, wherein:

how the luminance blocks with the largest luminance weight are to be used for said first pixel is determined based on how the luminance blocks with the largest luminance weight are used for said second pixel.

22. A display apparatus as claimed in claim 20, wherein:

how many luminance blocks with the largest luminance weight are to be used for said first pixel is determined based on how many luminance blocks with the largest luminance weight are used for said second pixel.

23. A display apparatus as claimed in claim 22, wherein said luminance block selection and luminance adjusting luminance block insertion unit comprises:

a group number assigning unit assigning group numbers to said first and said second pixel from predefined groups according to the gray-scale levels that said first and said second pixel display, said groups being predefined by classifying all gray-scale levels according to the number of luminance blocks with the largest luminance weight that are allowed to be used; and a luminance block combination selection unit comparing the group numbers assigned to said first and said second pixel with each other, and selecting one of said plurality of combinations of said luminance blocks to display the gray-scale level of said first pixel.

24. A display apparatus as claimed in claim 23, wherein:

the gray-scale level to be displayed by each pixel is expressible by one of two descriptions, the first description using a smaller number of luminance blocks with the largest luminance weight than the second description; and the number of luminance blocks with the largest luminance weight to be used for said first pixel is determined by comparing the group number, denoted as GA, of said first pixel with the group number, denoted as GB, of said second pixel, and by selecting one of said two descriptions in such a manner that:

when GB<GA, said first description is selected;

when GB=GA, the same description as used for said second pixel is used; and when GB>GA, said second description is selected.

25. A display apparatus as claimed in claim 22, wherein:

how the plurality of luminance blocks with the largest luminance weight to be used for said first pixel are selected from among said luminance blocks with the largest luminance weight is determined according to how the luminance blocks with the largest luminance weight are selected and used for said second pixel.

26. A display apparatus as claimed in claim 22, wherein said luminance block selection and luminance adjusting luminance block insertion unit comprises:

a luminance block state change detection unit detecting the occurrence of a state change between successive frames or fields in any one of the luminance blocks with the largest luminance weight in said first pixel;

a number-of-contiguous-pixels detection unit detecting the number of linearly contiguous pixels on a display screen that exhibit the same change as the change in said one of the luminance blocks with the largest luminance weight in said first pixel;

a luminance adjusting luminance block selection unit selecting a predetermined luminance adjusting luminance block, based on said detected number of contiguous pixels and on the change in said one of the luminance blocks with the largest luminance weight in said first pixel; and a luminance adjusting luminance block applying unit applying said selected luminance adjusting luminance block to the source signal of each of said contiguous pixels.

27. A display apparatus as claimed in claim 26, wherein:

said selected luminance adjusting luminance block is applied not only to the source signal of each of said detected contiguous pixels but also to the source signal of an additional pixel located on the opposite side of said contiguous pixels from said second pixel.

28. A display apparatus as claimed in claim 26, wherein said luminance block state change detection unit performs the detection of a state change between successive frames or fields in said luminance blocks with the largest luminance weight, in sequence, starting with the luminance block located on the smaller luminance weight side of said luminance blocks with the largest luminance weight.

29. A display apparatus as claimed in claim 22, wherein said luminance block selection and luminance adjusting luminance block insertion unit comprises:

a luminance block state change detection unit detecting the occurrence of a state change between successive frames or fields in any one of the luminance blocks with the largest luminance weight in said first pixel;

a number-of-contiguous-pixels detection unit detecting, in a horizontal and a vertical direction, the number of linearly contiguous pixels on a display screen that exhibit the same change as the change in said one of the luminance blocks with the largest luminance weight in said first pixel;

a luminance adjusting luminance block selection unit selecting a predetermined luminance adjusting luminance block, based on said detected number of horizontally or vertically contiguous pixels, whichever is smaller, and on the change in said one of the luminance blocks with the largest luminance weight in said first pixel; and a luminance adjusting luminance block applying unit applying said selected luminance adjusting luminance block to the source signal of each of said contiguous pixels.

30. A display apparatus as claimed in claim 29, wherein:

said selected luminance adjusting luminance block is applied not only to the source signal of each of said horizontally or vertically detected contiguous pixels, whichever are smaller in number, but also to the source signal of an additional pixel located on the opposite side of said contiguous pixels from said second pixel.

31. A display apparatus as claimed in claim 29, wherein said luminance block state change detection unit performs the detection of a state change between successive frames or fields in said luminance blocks with the largest luminance weight, in sequence starting with the luminance block located on the smaller luminance weight side of said luminance blocks with the largest luminance weight.

32. A display apparatus as claimed in claim 20, wherein:

said plurality of luminance blocks are 10 in number, and the luminance weights of said luminance blocks are set to provide gray-scale levels 1, 2, 4, 8, 16, 32, 48, 48, 48, and 48, respectively.

33. A halftone display method which predefines a plurality of luminance blocks in each frame or field to display an image, and which is capable of displaying one gray-scale level by any one of a plurality of combinations of said luminance blocks, wherein:

when determining luminance blocks to be used to display a gray scale of an arbitrary first pixel, the luminance blocks to be used for said first pixel are selected in accordance with a predetermined procedure based on respective states of the luminance blocks in at least two reference pixels around said first pixel.

34. A halftone display method as claimed in claim 33, wherein:

said reference pixels are located directly adjacent to said first pixel.

35. A halftone display method as claimed in claim 33, wherein:

said reference pixels are located directly adjacent to or in proximity to said first pixel through other pixels.

36. A halftone display method as claimed in claim 33, wherein:

the luminance blocks to be used for said first pixel are selected based on respective states of the luminance blocks exceeding a majority of said reference pixels.

37. A halftone display method as claimed in claim 36, wherein:

said reference pixels are an even number, and in a case where said reference pixels of different luminance blocks are equally divided in number, the luminance blocks to be used for said first pixel are maintained without changing.

38. A halftone display method as claimed in claim 33, wherein:

said reference pixels are weighted according to the relative position thereof with said first pixel, respectively, and the luminance blocks to be used for said first pixel are selected based on respective states of said luminance blocks of said weighted reference pixels.

39. A halftone display method as claimed in claim 38, wherein:

in a case where said weighted reference pixels of different luminance blocks are the same, the luminance blocks to be used for said first pixel are maintained without being changed.

40. A display apparatus which predefines a plurality of luminance blocks in each frame or field to display an image, and which is capable of displaying one gray-scale level by any one of a plurality of combinations of said luminance blocks, comprising:

an image display;

a driving unit driving said image display;

a control unit controlling said driving unit; and a luminance block selection and luminance adjusting luminance block insertion unit selecting luminance blocks, and inserting a luminance adjusting luminance block into a source signal, wherein:

when determining luminance blocks to be used to display a gray scale of an arbitrary first pixel, the luminance blocks to be used for said first pixel are selected in accordance with a predetermined procedure based on respective states of the luminance blocks in at least two reference pixels around said first pixel.

41. A display apparatus as claimed in claim 40, wherein:

said reference pixels are located directly adjacent to said first pixel.

42. A display apparatus as claimed in claim 40, wherein:

said reference pixels are located directly adjacent to or in proximity to said first pixel through other pixels.

43. A display apparatus as claimed in claim 40, wherein:

the luminance blocks to be used for said first pixel are selected based on respective states of the luminance blocks exceeding a majority of said reference pixels.

44. A display apparatus as claimed in claim 43, wherein:

said reference pixels are an even number, and in a case where said reference pixels of different luminance blocks are equally divided in number, the luminance blocks to be used for said first pixel are maintained without changing.

45. A display apparatus as claimed in claim 40, wherein:

said reference pixels are weighted according to the respective positions thereof relatively to said first pixel and the luminance blocks to be used for said first pixel are selected based on the respective states of said luminance blocks of said weighted reference pixels.

46. A display apparatus as claimed in claim 45, wherein:

in a case where said weighted reference pixels of different luminance blocks are the same, the luminance blocks to be used for said first pixel are maintained without being changed.

47. A display apparatus as claimed in claim 40, further comprising:

a lighting pattern setting unit for setting the whole display screen in a predetermined lighting pattern.

48. A display apparatus as claimed in claim 47, wherein:

said lighting pattern setting unit sets each pixel of the whole display screen in a luminance state using a maximum number of luminance blocks having the largest luminance weight.

* * * * *